US005716046A

United States Patent [19]

Katamoto et al.

[11] Patent Number: 5,716,046

[45] Date of Patent: Feb. 10, 1998

[54] APPARATUS FOR FEEDING ORIGINAL DOCUMENT WITH IMPROVED SPEED AND RELIABILITY

[75] Inventors: Koji Katamoto, Yamatokoriyama; Yuji Okamoto; Naoya Okamura, both of Nara, all of Japan

[73] Assignee: Sharp Kabushiki Kaisha, Osaka, Japan

[21] Appl. No.: 579,261

[22] Filed: Dec. 27, 1995

[30] Foreign Application Priority Data

Dec. 27, 1994 [JP] Japan ..... 6-325512

[51] Int. Cl.[6] ..... B65H 5/22

[52] U.S. Cl. ..... 271/3.08; 271/3.11; 271/155; 271/152; 271/30.1; 271/147

[58] Field of Search ..... 271/3.08, 3.09, 271/3.11, 3.14, 212, 147, 30.1, 152, 154, 155

[56] References Cited

U.S. PATENT DOCUMENTS

| | | | |
|---|---|---|---|
| 4,368,973 | 1/1983 | Silverberg . | |
| 5,022,641 | 6/1991 | Okada | 271/3.08 |
| 5,078,383 | 1/1992 | Shiina et al. | 271/212 |
| 5,091,755 | 2/1992 | Tashiro . | |
| 5,419,542 | 5/1995 | Yamada et al. | 271/212 X |

FOREIGN PATENT DOCUMENTS

| | | | |
|---|---|---|---|
| 1256429 | 10/1989 | Japan . | |
| 4256631 | 9/1992 | Japan . | |
| 92482 | 4/1994 | Japan | 271/212 |

*Primary Examiner*—Boris Milef

[57] ABSTRACT

In an apparatus for feeding an original document, the time which is needed until the first original document is transported onto a transportation path after storing original documents is shortened. The original documents stacked on an original document supporting plate are successively supplied one by one in order from an uppermost original document. A discharged original document is steadily and easily inserted between the original document supporting plate and the original documents stacked on the original document supporting plate. When a hopper sensor detects that the original documents are stacked on the original document supporting plate, the original document supporting plate is moved upward until the upper surface of the uppermost one of the original documents contact a level sensor. At this stage, the original documents are supplied successively one by one from the uppermost original document by a paper feeding mechanism. An image from an original document which has traveled along a transportation path is read by a reading part of the copying machine on which the apparatus is mounted. When a document discharge sensor is turned on, the original document supporting plate is moved downward to a home position at a high speed, and the discharged original document is inserted into a space which is created at this stage between the original document supporting plate and the original documents stacked on the original document supporting plate.

4 Claims, 48 Drawing Sheets

FIG. 6
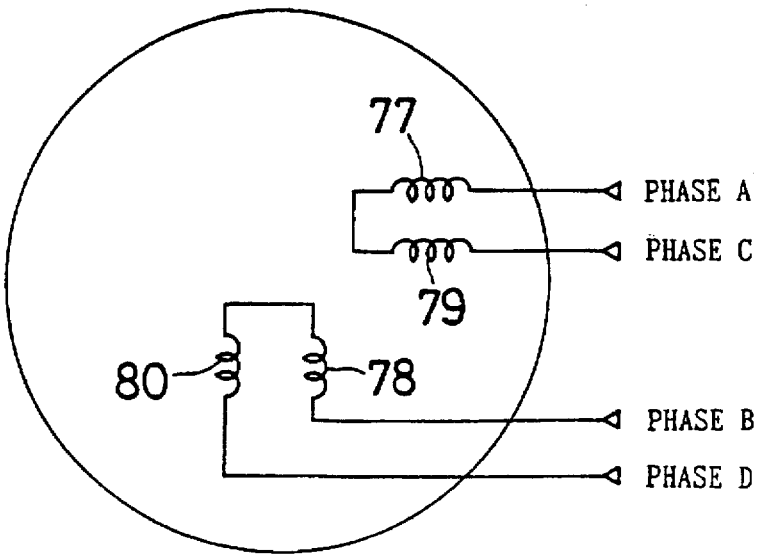
FIG. 7A
FIG. 7B
FIG. 7C
FIG. 7D
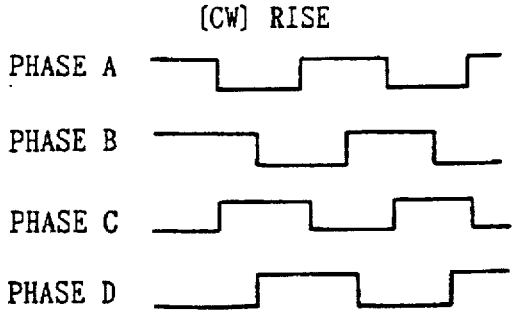
FIG. 7E
FIG. 7F
FIG. 7G
FIG. 7H
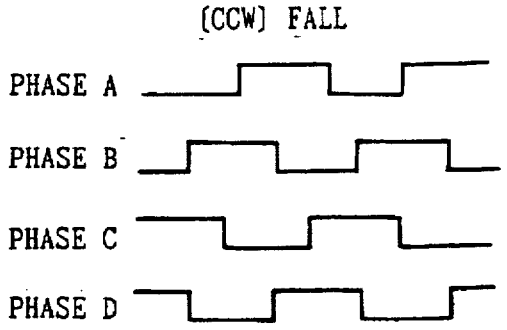

APPARATUS FOR FEEDING ORIGINAL DOCUMENT WITH IMPROVED SPEED AND RELIABILITY

BACKGROUND OF THE INVENTION

1. Field of the Invention

The present invention relates to an original document feeding apparatus for successively feeding sheet-shaped original documents to a reading region, for use within an electrostatic copying machine or the like.

2. Description of the Related Art

Conventionally, an optical reading apparatus for exposing a surface of an original document in the shape of a slit and optically reading the surface of the original document, e.g., a transfer-type electrostatic copying machine, comprises first exposing means for fixing the original document and exposing and reading the original document while moving an optical system, and second exposing means for fixing the optical system and exposing and reading the original document while moving the original document. The second exposing means in some cases uses a circulation-type original document feeding apparatus (hereinafter "RDH") for performing automatic transportation in which sheet-shaped original documents are supplied successively one at a time to a reading region, read while exposed, and then returned to an original document position.

FIG. 58 is a cross-sectional view showing a simplified structure of a conventional RDH 201. The RDH 201 is disclosed in Japanese Unexamined Patent Publication JPA 2-175574 (1990) by the inventor of the invention. Generally, the RDH 201 comprises an original document container part 202, a first support cylinder 203, a second support cylinder 204, first original document reversing means 205 and second original document reversing means 206.

Original documents 207 stacked and stored in the original document container part 202 are transported to a transportation path 209 by a paper feeding roller 208 which forms a paper feeding mechanism, one by one successively from the uppermost original document 207*a*. The original document 207 inserted through an entrance 209*a* of the transportation path 209 is passed over a first transparent plate 212 of a first reading part 211 of the electrostatic copying machine to which the RDH 201 is mounted, by means of the first support cylinder 203 which rotates in the direction of an arrow 210. An image of one surface of the original document 207 is read by the first reading part 211.

Following this, the original document 207 is reversed by the first original document reversing means 205 which is composed of a plurality of paper feeding rollers, and direction change hooks, etc. The reversed original document 207 is passed over a second transparent plate 215 of a second reading part 214 of the electrostatic copying machine, by means of the second support cylinder 204 which rotates in the direction of an arrow 213. An image of the other surface of the original document 207 is read by the second reading part 214.

The original document 207 is further reversed by the second original document reversing means 206. The second original document reversing means 206 includes a third support cylinder 216 which rotates in the direction of an arrow 217. The original document 207 reversed by the second original document reversing means 206 is discharged from an exit 209*b* of the transportation path 209, and again, stored in the original document container part 202.

FIG. 59 is a cross sectional view showing a simplified structure of another conventional RDH 221. The RDH 221 is disclosed in Japanese Unexamined Patent Publication JPA 57-125950 (1982), and characterized in that transportation means 222 which serves as an original document support plate is movable in a vertical direction. First, the transportation means 222 is located below as shown by the solid line. A transportation mechanism 224 of a paper feeding mechanism 223 is lifted up to form an insertion inlet 231, an original document is inserted from the insertion inlet 231, and the original document is stacked on the transportation means 222 which is located below.

Upon stacking of the original document, the transportation means 222 moves upward as shown by the broken line, and the stacked original document is transported to a transportation path 226 by the paper feeding mechanism 223 which is composed of the transportation mechanism 224 and an air injection device 225. After passing the transportation path 226, the original document is transported to a transportation path 228 by transportation means 227, and stacked onto the transportation means 222 once again. An image of the original document is read on the transportation means 227.

After an original document passed once through the transportation path 226, the transportation means 227 and the transportation path 228 and returned, in order to store the original document between a plurality of original documents which are stacked on the transportation means 222 and the transportation means 222, a lifter 230 lifts up the original documents which are stacked on the transportation means 222. An air injecting device 229 injects air between the original documents which are stacked on the transportation means 222 and the transportation means 222. The transportation means 222 moves so that original documents on the transportation means 222 may be located close to the transportation mechanism 224 of the paper feeding mechanism 223.

The RDHs 201 and 221 are both for transporting the stored original documents one by one successively from the uppermost thereof, and storing the original document which has returned after being read by a predetermined image reading operation between the stored original documents and the original document stacking surface. To handle a large number of original documents in such RDHs, it is necessary to ensure a relatively long distance between the original document stacking surface and the paper feeding mechanism.

In the RDH 201, the paper feeding roller 208 moves in accordance with the height of the stack of the original documents 207. In this case, a paper feeding position, i.e., the position of the uppermost surface of the stack of the original documents 207 changes depending on the number of the original documents. Hence, in order to supply original documents stably, it is necessary to move the entrance 209*a* of the transportation path 209 in accordance with the changing paper feeding position.

On the other hand, in the RDH 221, although the transportation means 222 which serves as an original document support plate is moved, whether the transportation means 222 has moved upward to the paper feeding position without fail is not confirmed. Hence, the uppermost one of the stacked original documents is not necessarily at the paper feeding position without fail. Accordingly, stable supply of original documents is not very reliable. In addition, when the transportation means 222 is moved after an instruction to start copying is issued, it inconveniently takes a relatively long time to complete copying of the first original document. Further, the air injecting device 229 and the lifter 230 are provided in order to store a returned original document between stored original documents and the original document stacking surface. To provide such relatively large means, a large space is needed and complex control is required.

SUMMARY OF THE INVENTION

It is hence an object of the invention to provide an apparatus for feeding original documents which shortens a time needed until the first original document is transported onto the transportation path after storing of the original documents, and which steadily and easily performs a transportation operation of transporting original documents stored in a container mechanism one by one successively from the top and thereafter storing the original document which has passed through the transportation path between original documents which are stored in the container mechanism and an original document stacking surface.

The invention provides an original document feeding apparatus comprising a predetermined transportation path, an original document supporting plate on which original documents to be transported onto the transportation path are stacked, and paper feeding means for feeding the original documents stacked on the original document supporting plate onto the transportation path one by one, wherein in the original document feeding apparatus the original documents stacked on the original document supporting plate are supplied onto the transportation path one by one successively from the top, and the original document discharged from the transportation path is inserted between the original document supporting plate and the lowermost one of the original documents on the original document supporting plate, the apparatus further comprising:

upper surface detecting means for detecting the upper surface of the uppermost one of the original documents stacked on the original document supporting plate when the uppermost one of the original documents stacked on the original document supporting plate is fed to a paper feeding position facing an entrance of the transportation path;

vertical movement means for moving the original document supporting plate upward and downward between the paper feeding position and a waiting position, where the original documents are stacked onto and removed from the original document supporting plate positioned below the paper feeding position;

original document stacking detecting means for detecting that original documents are stacked on the original document supporting plate; and stacking completion detecting means for detecting that stacking of the original documents onto the original document supporting plate is completed, wherein when the original document stacking detecting means detects that the original documents have been stacked on the original document supporting plate, the vertical movement means moves the original document supporting plate upward up to a preliminary waiting position preset between the waiting position and the paper feeding position, and when the stacking completion detecting means detects that stacking of the original documents onto the original document supporting plate has been completed, the vertical movement means moves the original document supporting plate upward until the upper surface detecting means detects the upper surface of the uppermost one of the original documents stacked on the original document supporting plate.

Further, the invention is characterized in that the stacking completion detecting means comprises timing means for timing a predetermined time, and detects that stacking of original documents onto the original document supporting plate has been completed when the timing means finishes timing the predetermined time while the original document supporting plate is at the preliminary waiting position.

Further, the invention is characterized in that the apparatus comprises inputting means for inputting original document feeding operation specifying data which specify a mode of an original document feeding operation from a plurality of modes, and when the original document supporting plate is at the preliminary waiting position, upon input of the original document feeding operation specifying data from the inputting means, the stacking completion detecting means detects that stacking of the original documents onto the original document supporting plate has been completed.

The invention provides an original document feeding apparatus comprising a predetermined transportation path, an original document supporting plate on which original documents to be transported onto the transportation path are stacked, and paper feeding means for feeding the original documents stacked on the original document supporting plate onto the transportation path one by one, wherein in the original document feeding apparatus the original documents stacked on the original document supporting plate are supplied onto the transportation path one by one successively from the top, and the original document discharged from the transportation path is inserted between the original document supporting plate and the lowermost one of the original documents on the original document supporting plate, the apparatus further comprising:

vertical movement means for moving the original document supporting plate upward and downward between a waiting position approximately flush with an exit of the transportation path, where the original documents are stacked onto or removed from the original document supporting plate, and a higher position than the waiting position;

upper surface detecting means for detecting the upper surface of the uppermost one of the original documents stacked on the original document supporting plate when the uppermost one of the original documents stacked on the original document supporting plate is positioned at a paper feeding position facing the entrance of the transportation path set at a higher position than an exit of the transportation path;

original document stacking detecting means for detecting that the original documents are stacked on the original document supporting plate; and original document discharge detecting means provided near the exit of the transportation path, for detecting the existence of an original document to be discharged from the transportation path, wherein when the original document stacking detecting means detects that the original documents are stacked on the original document supporting plate, the vertical movement means moves the original document supporting plate upward until the upper surface detecting means detects the upper surface of the uppermost one of the original documents stacked on the original document supporting plate, and when the original document discharge detecting means detects the existence of an original document to be discharged from the transportation path, the vertical movement means moves the original document supporting plate downward to the waiting position and the discharged document is quickly inserted into a space created between the original document supporting plate and the lowermost one of the original documents stacked on the original document supporting plate.

Further, the invention is characterized in that the length of the downward movement of the end of the original document supporting plate on the side of the entrance of the transportation path is longer than that of the end of the original document supporting plate on the side of the exit of the transportation path.

Further, according to the invention, when the original document discharge detecting means detects the existence of an original document to be discharged from the transportation path, the vertical movement means moves the original document supporting plate upward so that the upper surface of the uppermost one of the original documents stacked on the original document supporting plate is positioned higher than the paper feeding position, and the vertical movement means then moves the original document supporting plate downward.

Further the invention is characterized in that the apparatus comprises: a cover for covering a predetermined insertion inlet for stacking the original documents onto the original document supporting plate, and open and close detecting means for detecting open and close states of the cover, and when the open and close detecting means detects the close state of the cover, the vertical movement means moves the original document supporting plate upward until the upper surface detecting means detects the upper surface of the uppermost one of the original documents stacked on the original document supporting plate, and when open and close detecting means detects the open state of the cover, the vertical movement means moves the original document supporting plate downward to the waiting position.

According to the invention, the original document supporting plate on which the original documents to be transported onto the transportation path are stacked is moved upward and downward by the vertical movement means between the waiting position and the paper feeding position which is higher than the waiting position. First, the original document supporting plate is located at the waiting position and original documents to be transported onto the transportation path are stacked on the original document supporting plate. When the original document stacking detecting means detects that the original documents are stacked on the original document supporting plate, the original document supporting plate is moved upward to the preliminary waiting position which is set between the waiting position and the paper feeding position and then stopped, and further moved upward until the upper surface detecting means detects the upper surface of the uppermost one of original documents stacked on the original document supporting plate. Upward movement from the preliminary waiting position is started in response to the stacking completion detecting means detecting completion of stacking of the original documents. The upper surface detecting means detects the upper surface of the uppermost one of the original documents stacked on the original document supporting plate when the upper surface of the uppermost one of the original documents stacked on the original document supporting plate is positioned at the paper feeding position facing the entrance of the transportation path. At this stage, the original documents on the original document supporting plate are supplied onto the transportation path successively one at a time from the top by the paper feeding means. The original document which has passed through the transportation path is inserted between the original document supporting plate and the lowermost one of the original documents on the original document supporting plate. Such an apparatus for feeding original documents is used, for example, as mounted to a copying machine, and a predetermined copying operation is performed on an original document in the transportation path.

Since the original document supporting plate is moved upward upon detecting completion of stacking of original documents, as compared with a case where the original document supporting plate is moved upward after original documents are stacked and a predetermined input, e.g., an input indicating the start of copying is entered, a time needed until the first original document is supplied onto the transportation path is shortened, whereby a time needed for copying is reduced. Further, it is possible to restack the original documents at the preliminary waiting position due to a change in the number of the original documents, rearrangement of the original documents, etc.

Preferably, the original document supporting plate is moved upward after a predetermined time has elapsed at the preliminary waiting position. Hence, an input indicating completion of restack does not have to be entered, thereby improving the operability of the apparatus for feeding original documents.

Preferably, the original document supporting plate is moved upward in response to the original document feeding operation specifying data inputted while the original document supporting plate is at the preliminary waiting position. Hence, it is possible to steadily restack original documents, and also possible to move the original document supporting plate upward by the input indicating the start of copying, thereby improving the operability of the apparatus for feeding original documents.

Further, since the preliminary waiting position is selected as nearly the middle position between the waiting position and the paper feeding position, an operation of moving the original document supporting plate upward and downward is simplified.

Further, according to the invention, the entrance of the transportation path is positioned higher than the exit of the transportation path, and the waiting position is selected to be approximately flush with the exit of the transportation path. The original document supporting plate is moved upward and downward between the waiting position and a higher position than the waiting position. First, the original document supporting plate is located at the waiting position, and the original documents to be transported onto the transportation path are stacked on the original document supporting plate. When the original document stacking detecting means detects that the original documents are stacked on the original document supporting plate, the original document supporting plate is moved upward until the upper surface detecting means detects the upper surface of the uppermost one of the original documents stacked on the original document supporting plate. When the upper surface of the uppermost one of the original documents stacked on the original document supporting plate is positioned at the paper feeding position facing to the entrance of the transportation path, the upper surface detecting means detects the upper surface of the uppermost one of the original documents stacked on the original document supporting plate. At this stage, the paper feeding means supplies an original document onto the transportation path. When the original document discharge detecting means detects the original document to be discharged from the transportation path, the original document supporting plate is moved downward to the waiting position at a speed which creates a space between the original document supporting plate and the lowermost one of original documents on the original document supporting plate. The original document discharged from the transportation path is inserted into the space which is created between the original document supporting plate and the lowermost one of original documents on the original document supporting plate when the original document supporting plate is moved downward.

Hence, to insert the original document discharged from the transportation path between the original document supporting plate and the lowermost one of the original documents stacked on the original document supporting plate, there is no need to provide means for lifting the original documents stacked on the original document supporting plate, and thus, it is possible to easily store the discharged original document.

Preferably, the length of the downward movement of the original document supporting plate at the entrance side of the transportation path is longer than that at the exit side of the transportation path, and the space which is created when the original document supporting plate is moved downward remains for a longer time period at the entrance side. Hence, the original document discharged from the transportation path is stably stacked onto the original document supporting plate without warp.

Preferably, the original document supporting plate is moved downward after once moved upward. Hence, a wider space is created, so that the original documents are stacked onto the original document supporting plate stably.

Further, it is possible to form one or more openings which penetrate the original document supporting plate in the depth direction thereof. It is further possible to form one or more convex portions on the original document stacking surface. Both of these make it possible to steadily and stably form the space between the original document supporting plate and the original documents stacked on the original document supporting plate. Hence, the original document discharged from the transportation path is stacked onto the original document stacking surface without fail.

Preferably, the cover which covers a predetermined insertion inlet for stacking the original documents onto the original document supporting plate, and the open and close detecting means for detecting an open/close state of the cover are provided, and when the close state of the cover is detected, the original document supporting plate is moved upward until the upper surface detecting means detects the upper surface of the uppermost one of the original documents stacked on the original document supporting plate, and when the open state of the cover is detected, the original document supporting plate is moved downward to the waiting position. Hence, by means of the cover, it is possible to shut out noise which is created while the original document supporting plate is moved upward and downward, and other noise which is created during transportation of the original documents. In addition, since the original document supporting plate is moved upward and downward depending on the open/close state of the cover, the operability of the apparatus for feeding original documents is improved.

Further, it is possible for the paper feeding means to start feeding the original documents onto the transportation path when the close state of the cover is detected, and to stop feeding the original document when the open state of the cover is detected. This reduces a time needed until the first original document is transported onto the transportation path.

BRIEF DESCRIPTION OF THE DRAWINGS

Other and further objects, features, and advantages of the invention will be more explicit from the following detailed description taken with reference to the drawings wherein:

FIG. 6 is a circuit view showing a simplified structure of a stepping motor which realizes a lift motor 54;

FIG. 7A to 7H are waveform diagrams respectively showing signals which are supplied to coils 77 to 80;

DETAILED DESCRIPTION OF THE PREFERRED EMBODIMENTS

Figure 1:
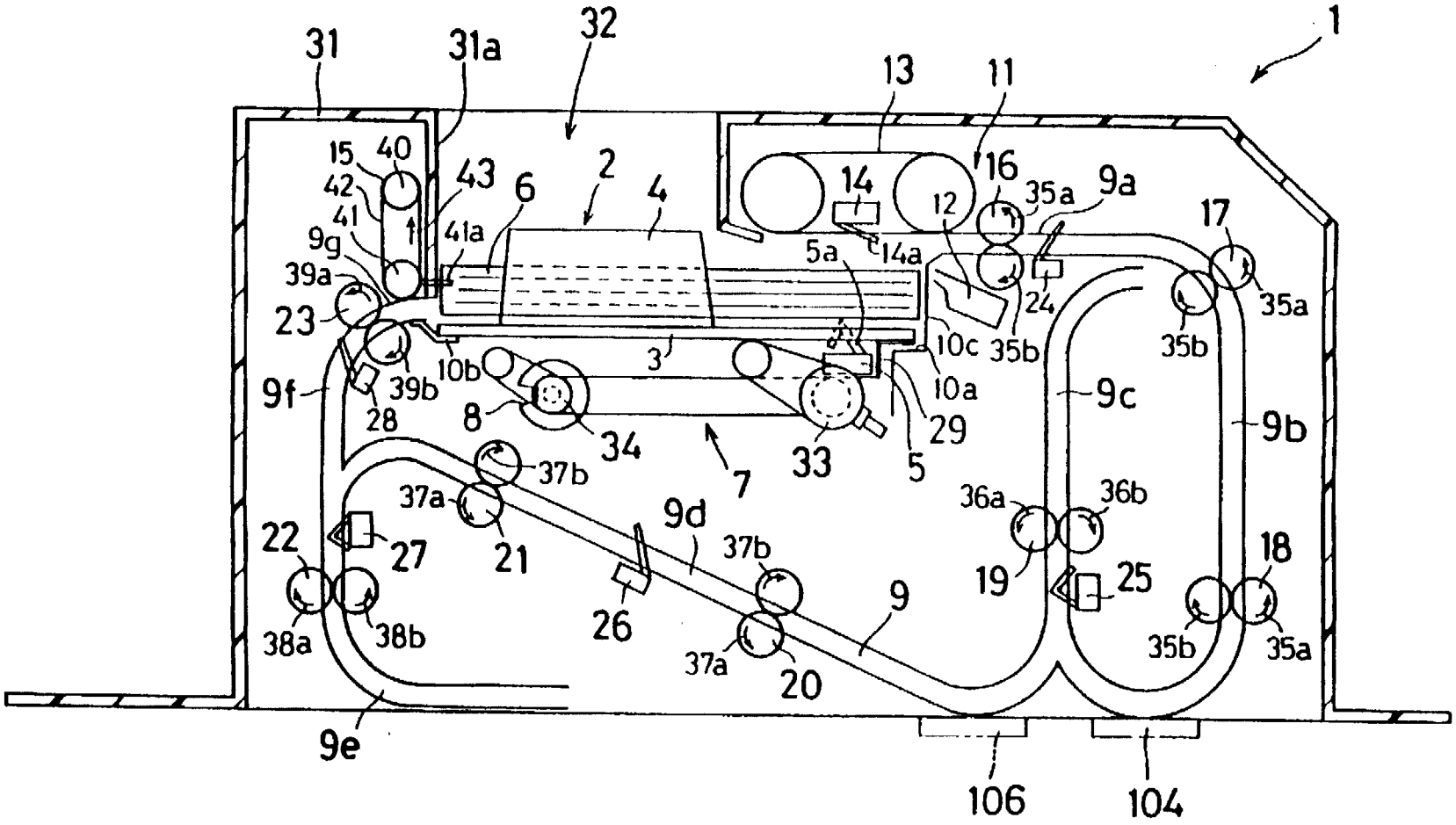
FIG. 1 is a cross-sectional view showing a general structure of an RDH 1 according to a first embodiment of the invention.

Now referring to the drawings, preferred embodiments of the invention are described below.

FIG. 1 is a cross-sectional view showing a general structure of an RDH 1 according to a first embodiment of the invention, with a cover 31 cut in cross section. Roughly described, the RDH 1 comprises an original document container mechanism 2, a vertical movement mechanism 7, a transportation path 9, a paper feeding mechanism 11, and a cover 31. The original document container mechanism 2 comprises an original document supporting plate 3, guide plates 4, a hopper sensor 5 for detecting whether original documents 6 are on the original document supporting plate 3, and a circulation sensor 15 for detecting that all original documents 6 stored in the original document container mechanism 2 have passed through the transportation path 9 and have been stored into the original document container mechanism 2 again.

In an initial state prior to an operation of the RDH 1, the original document supporting plate 3 is mounted on one mounting part 10*a*, the mounting part 10*a* extending horizontally from a guide part 10*c* which extends downward from an entrance side end 9*a* of the transportation path 9, and the other mounting part 10*b*, the mounting part 10*b* extending horizontally from an exit side end 9*g* of the transportation path 9. Such a mounting position of the original document supporting plate 3 will be hereinafter referred to as "HP (home position." On the original document supporting plate 3, original documents 6 inserted through an insertion inlet 32 formed by an opening 31*a* of the cover 31 are stacked. Downstream side ends of the original documents 6 in a feeding direction are aligned to each other by the guide part 10*c*, and side faces of the original documents 6 are aligned to each other by the guide plates 4 which are provided on mutually facing side surface portions of the original document supporting plate 3.

The hopper sensor 5 is attached to the original document supporting plate 3. The hopper sensor 5 includes an actuator 5*a*, which is disposed on a mount piece 29 attached to the surface of the original document supporting plate 3, opposite to the original document stacking surface so that the actuator 5*a* may project from the original document stacking surface.

When the original documents 5 are stacked and the actuator 5*a* is pressed thereby, the hopper sensor 5 detects that the original documents 6 are stacked on the original document supporting plate 3. Hence, a through hole is formed in the original document supporting plate 3 for the actuator 5*a* to penetrate.

The circulation sensor 15 includes a protrusion 41*a* which protrudes toward the original documents 6 stacked on the original document supporting plate 3, and the protrusion 41*a* is positioned between the original documents 6 and the original document supporting plate 3 when the original documents 6 are first stacked on the original document supporting plate 3. An original document which has passed through the transportation path 9 and has been stacked onto the original document supporting plate 3 again is stored between the protrusion 41*a* and the original document supporting plate 3. Hence, when the protrusion 41*a* is positioned on the upper surface of the uppermost one of the original documents 6, it is detected that the original documents 6 have finished circulating. Such protrusion 41*a* of the circulation sensor 15 is attached to a belt 42 which is wound around a driving wheel 40 and a driven wheel 41. By feeding the belt 42 in the direction of an arrow 43, the protrusion 41*a* moves in an upward direction from the original document stacking surface over the original document supporting plate 3. In order to position the protrusion 41*a* on the original document supporting plate 3, a through hole is formed in the cover 31 for the protrusion 41*a* to penetrate.

Such original document container mechanism 2 is moved upward and downward by the vertical movement mechanism 7 which includes cam members 33 and 34, as described later. The vertical movement mechanism 7 also includes a lift HP sensor 8 for detecting HP condition of the original document supporting plate 3 mentioned above.

The paper feeding mechanism 11 is provided near the entrance of the transportation path 9. The paper feeding mechanism 11 includes an air injection device 12, a suction transportation device 13, and a level sensor 14. The suction transportation device 13 and the level sensor 14 are disposed above the original document container mechanism 2. The air injection device 12 is positioned such that air is blown out from diagonally below onto tip portions of the original documents 6 which are moved upward by the vertical movement mechanism 7. The level sensor 14 includes an actuator 14*a* which is pressed by the uppermost face of the original documents 6 in a state moved upward. When the actuator 14*a* is pressed, the level sensor 14 detects that the original documents 6 stacked on the original document supporting plate 3 have arrived at a paper feeding position. The air injection device 12 separates the original documents 6 stacked on the original document supporting plate 3 into the uppermost one and the others by injecting air. The suction transportation device 13 sucks the uppermost original document separated by the air injection device 12 by using a suction mechanism which will be described later, and supplies the uppermost original document onto the transportation path 9.

The transportation path 9 is composed of paths 9*a* to 9*g*, and a plurality of transportation rollers 16 to 23 and a plurality of sensors 24 to 28 for detecting original documents provided on the paths. The sensors 24 to 28 for detecting original documents detect which position the original document 6 is passing. For example, by confirming output from the respective sensors when one of the original documents gets jammed, a jammed position can be detected.

By means of the transportation rollers 16 which are provided at the entrance side end 9*a* and rotate in directions of arrows 35*a* and 35*b* and the transportation rollers 17 and 18 which are provided in the path 9*b* and rotate in the directions of the arrows 35*a* and 35*b*, the original document 6 transported onto the transportation path 9 by the paper feeding mechanism 11 is passed over a first reading part 104 of a transfer-type electrostatic copying machine 101 described later. Further, at the entrance side end 9*a*, an inserted paper sensor 24 for detecting that the original document 6 is inserted onto the transportation path 9 is provided. The first reading part 104 reads an image of one surface of the original document 6. The original document 6 whose image of one surface is read is transported onto the path 9*c* by the transportation rollers 19 which rotate in directions of arrows 36*a* and 36*b*. A first reversing sensor 25 is provided in the path 9*c*.

By rotating the transportation rollers 19 in the opposite directions to the directions of the arrows 36*a* and 36*b*, the original document 6 transported onto the path 9*c* passes over a second reading part 106 of the transfer-type electrostatic copying machine 101. The second reading part 106 reads an image of the other surface of the original document 6. The original document 6 whose image of the other surface is read is passed through the transportation rollers 20 and 21 which are provided in the path 9*d* and rotate in directions of arrows 37*a* and 37*b*, and transported onto the path 9*e* by the transportation rollers 22 which rotate in directions of arrows 38*a* and 38*b*. A transportation detecting sensor 26 is provided in the path 9*d*, and a second reversing sensor 27 is provided in the path 9*e*.

The original document 6 transported onto the path 9*e* is transported onto the path 9*f* by rotating the transportation rollers 22 in the opposite directions to the directions of the arrows 38*a* and 38*b*. By the transportation rollers 23 which are provided at the exit side end 9*g* and rotate in directions of arrows 39*a* and 39*b*, the original document 6 transported onto the path 9*f* is introduced into the original document container mechanism 2 and stored between the original documents 6 stacked on the original document supporting plate 3 and the original document supporting plate 3. A document discharge sensor 28 is provided in the path 9*f*. The original document 6 transported and stored into the original document container mechanism 2 once again in this manner is stored in the same condition as the original document 6 used to be regarding the upper surface and the lower surface.

The original document container mechanism 2, the vertical movement mechanism 7, the transportation path 9, and the paper feeding mechanism 11 as described above are covered by the cover 31 with the opening 31*a* which serves as the insertion inlet 32 for inserting the original documents 6.

Figure 2:
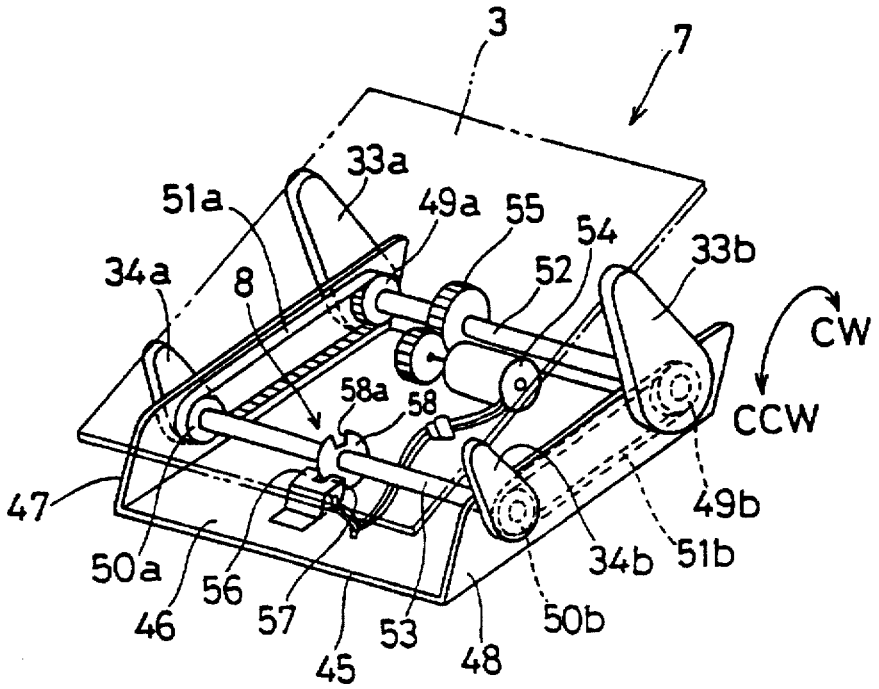
FIG. 2 is a perspective view showing a vertical movement mechanism 7 in detail.

FIG. 2 is a perspective view showing the vertical movement mechanism 7 in detail. The vertical movement mechanism 7 includes a supporting member 45 having a bottom plate 46 and sidewalls 47 and 48, a pair of cam members 33*a* and 33*b*, which serve as the cam members 33 mentioned above, and a pair of cam members 34*a* and 34*b*, which serve as the cam members 34 mentioned above, gear wheels 49*a*, 49*b*, 50*a* and 50*b*, belts 51*a* and 51*b*, axles 52 and 53, a lift motor 54, a gear wheel array 55, and the lift HP sensor 8.

The sidewall 47 is disposed at one end of the bottom plate 46, while the sidewall 48 is disposed at the other end parallel to and opposed to the one end. The cam members 33*a* and 34*a* are disposed outside the sidewall 47, the gear wheels 49*a* and 50*a* are disposed inside the sidewall 47, the cam members 33*b* and 34*b* are disposed outside the sidewall 48, and the gear wheels 49*b* and 50*b* are disposed inside the sidewall 48. The cam member 33*a* of the sidewall 47 side and the cam member 33*b* of the sidewall 48 side are connected to each other by the axle 52 fixed to the gear wheels 49*a* and 49*b* so as to move together, while the cam member 34*a* of the sidewall 47 side and the cam member 34*b* of the sidewall 48 side are connected to each other by the axle 53 fixed to the gear wheels 49*a* and 50*a* so as to move together. The belt 51*a* is wound around the gear wheels 49*a* and 50*a* of the sidewall 47 side, the belt 51*b* is wound around the gear wheels 49*b* and 50*b* of the sidewall 48 side, the cam members 33*a* and 34*a* interlock, and the cam members 33*b* and 34*b* interlock.

Driving force is transmitted from the lift motor 54 to the axle 52 through the gear wheel array 55. Together with rotation of the axle 52 and angular displacement of the cam members 33*a* and 33*b* caused by this driving force, angular displacement of the cam members 34*a* and 34*b* is caused. When angular displacement of the cam members 34*a* and 34*b* is caused. When 34*b* is caused, the original document supporting plate 3 of the original document container mechanism 2 contacts taper-shaped tip portions of the cam members. For example, when the axle 52 is rotated in a CW-direction, the original document supporting plate 3 is moved upward, and if the axle 52 is rotated in a CCW-direction opposite to the CW-direction, the original document supporting plate 3 is moved downward.

A light emitting diode 56 and a photodiode 57 are disposed on the bottom plate 46 of the axle 53 side with a predetermined space from each other, and a disk-shaped detection object 58 attached to the axle 53 is disposed between the light emitting diode 56 and the photodiode 57. A notch 58*a* is formed in the detection object 58, so that the HP condition of the original document supporting plate 3 mentioned above is detected by observing a change in the quantity of light received by the photodiode 57. That is, the detection object 58 is attached to the axle 53 so that the notch 58*a* may be located between the light emitting diode 56 and the photodiode 57 when the original document supporting plate 3 is located at the HP. The lift HP sensor 8 mentioned above is constructed in this manner.

Figure 3:
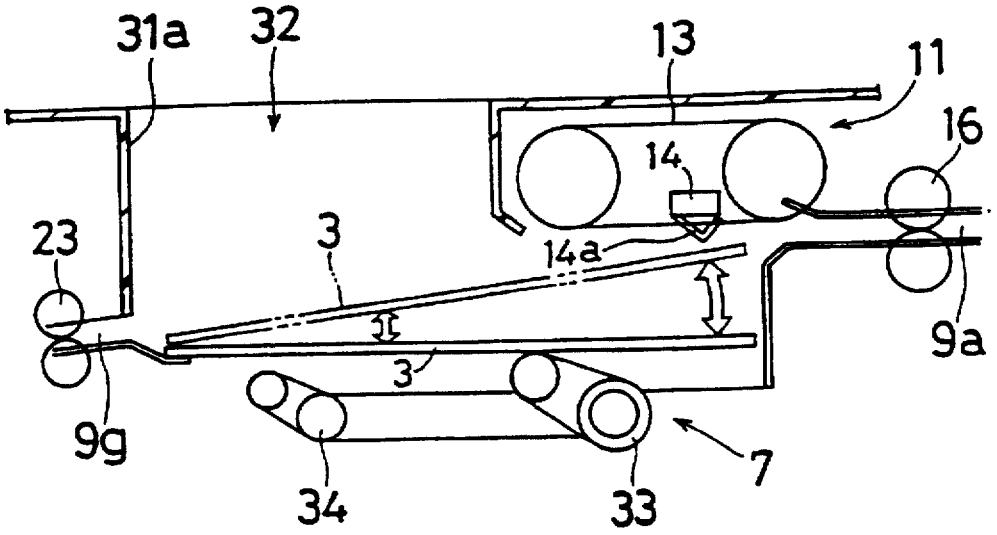
FIG. 3 is a cross-sectional view showing a state in which an original document supporting plate 3 is moved upward and downward by the vertical movement mechanism 7.

FIG. 3 is a cross-sectional view showing a state in which the original document supporting plate 3 is moved upward and downward by the vertical movement mechanism 7. The cam member 33 is larger than the cam member 34, and hence, when angular displacement of the cam members 33 and 34 is caused, the tip portion of the cam member 33 moves a longer distance than the tip portion of the cam member 34. The larger cam member 33 is disposed on the entrance side of the transportation path 9, and the smaller cam member 34 is disposed on the exit side of the transportation path 9. Therefore, the traveling distance of the original document supporting plate 3 becomes shorter from the cam member 33 side toward the other cam member 34 side, i.e., from the end portion positioned on the entrance side of the transportation path 9 toward the end portion positioned on the exit side of the transportation path 9.

Figure 4:
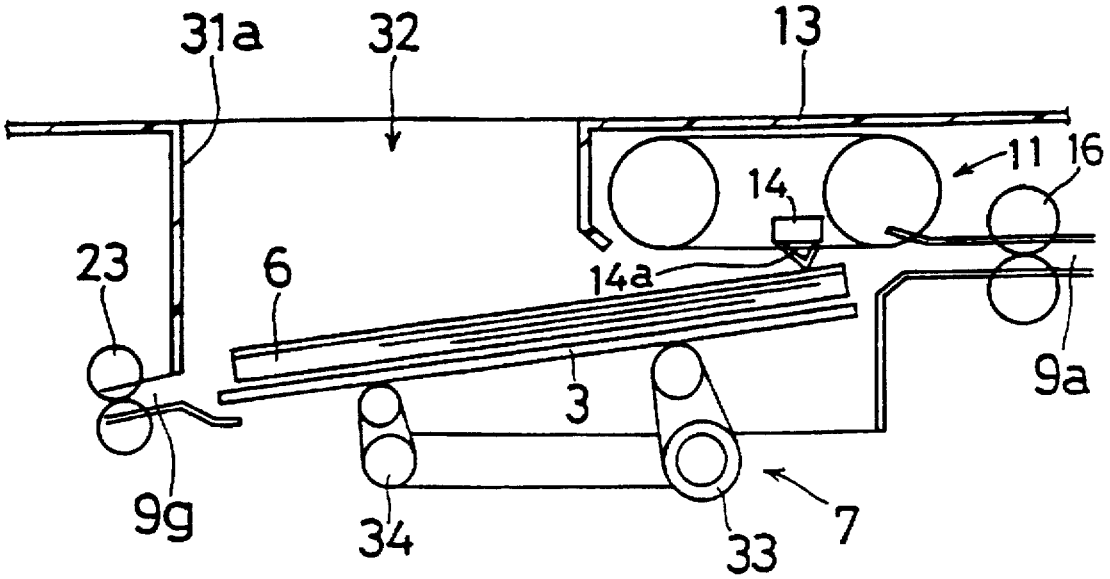
FIG. 4 is a cross-sectional view showing a state in which the original document supporting plate 3 is moved upward with original documents 6 stacked on the original document supporting plate 3.
Figure 5:
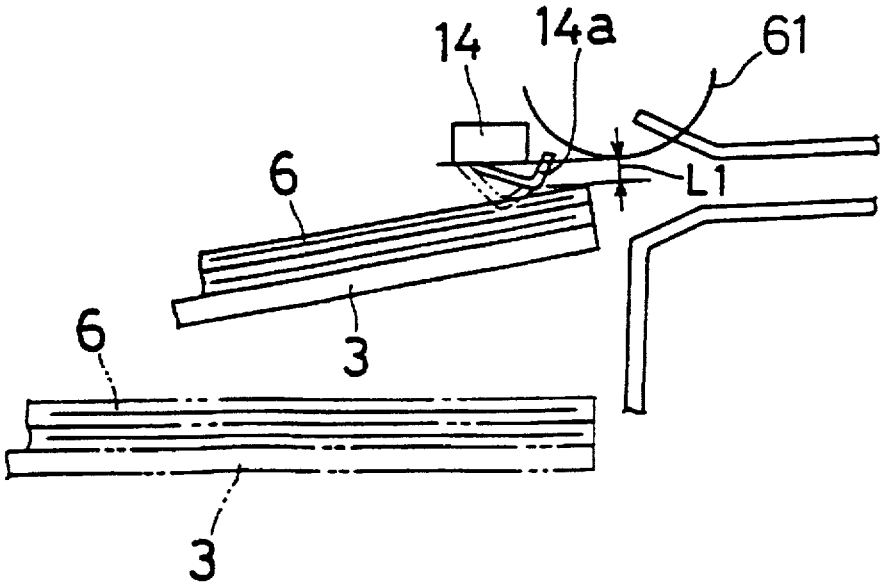
FIG. 5 is a side view enlarging an area near an entrance of a transportation path 9.

FIG. 4 is a cross-sectional view showing a state in which the original document supporting plate 3 is moved upward with the original documents 6 stacked on the original document supporting plate 3. FIG. 5 is a side view enlarging an area near the entrance of the transportation path 9. The actuator 14*a* of the level sensor 14 becomes "ON" when pressed by the original documents 6 stacked on the original document supporting plate 3 in a state moved upward. At this stage, as shown in FIG. 5, the end portions of the downstream side in the feeding direction of the uppermost face of the original documents 6 are spaced away by a distance L1 from surfaces of paper feeding belts 61 of the suction transportation device 13 having a structure as described later. The distance L1 is 5 mm, for example.

FIG. 6 is a circuit showing a simplified structure of a stepping motor which realizes the lift motor 54. The stepping motor includes a plurality of (four in this embodiment) coils 77 to 80 and receives a clock signal from a CPU described later, so that the speed of the stepping motor is easily adjusted by the clock signal. For instance, assuming that the maximum traveling speed of the original document supporting plate 3 is S, the traveling speed is selected as S/2 during normal movement upward and downward. As described later, the maximum traveling speed S is selected as 715 mm/sec, and the normal traveling speed S/2 is selected as, for example, 357.5 mm/sec.

FIGS. 7A to 7H are waveform diagrams respectively showing signals which are supplied to the coils 77 to 80. FIGS. 7A to 7D show a condition for upward movement, and FIGS. 7E to 7H show a condition for downward movement. A rectangular wave signal whose phase is shifted by ½ cycle is respectively supplied to the coils 77 and 79 (A-, C-phases) or the coils 78 and 80 (B-, D-phases) which are connected in series. During the upward movement, a signal whose phase is delayed by ¼ cycle from the phase of a signal supplied to the coil 78 (B-phase) is supplied to the coil 77 (A-phase), while a signal whose phase is delayed by ¼ cycle from the phase of a signal supplied to the coil 80 (D-phase) is supplied to the coil 79 (C-phase). During the downward movement, a signal whose phase is advanced by ¼ cycle from the phase of a signal supplied to the coil 78 (B-phase) is supplied to the coil 77 (A-phase), while a signal whose phase is advanced by ¼ cycle from the phase of a signal supplied to the coil 80 (D-phase) is supplied to the coil 79 (C-phase). In this manner, by utilizing force which is created by supplying pulse signals to the coils 77 to 80 and successively exciting the coils 77 to 80, rotors disposed at the center of the coils 77 to 80 are rotated.

Figure 8:
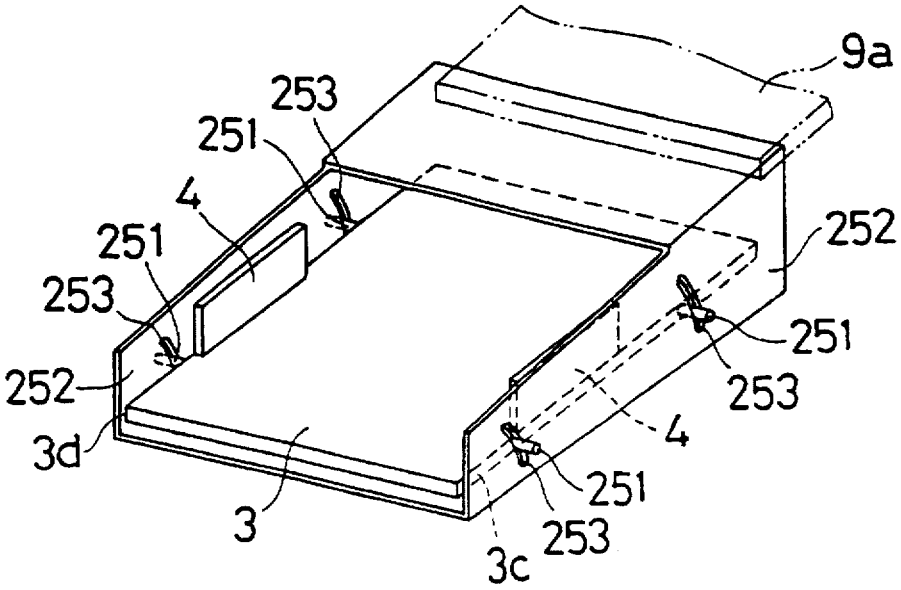
FIG. 8 is a perspective view showing the original document supporting plate 3 in detail.

FIG. 8 is a perspective view showing the original document supporting plate 3 in detail. Pins 251 are provided at side surfaces 3*c* and 3*d* of the original document supporting plate 3, the side surface 3*c* and 3*d* being provided with the guide plates 4. A plurality of guide grooves 253 are formed in sidewalls 252 of a frame for housing the original document supporting plate 3, the sidewalls 252 being faced with the guide plates 4. The pins 251 are respectively inserted into the plurality of guide grooves 253. The pins 251 are respectively provided at the side surfaces 3*c* and 3*d*, to be more precise, at the entrance side and the exit side of the transportation path 9, for example. When the original document supporting plate 3 is moved upward and downward by the vertical movement mechanism 7, the pins 251 are moved along the guide grooves 253. Hence, the original document supporting plate 3 does not rattle when moved upward.

When the original document supporting plate 3 is in the HP condition described above, the original document supporting plate 3 is positioned horizontally, for instance. At this stage, the original document supporting plate 3 does not necessarily have to be positioned horizontally, and the original document supporting plate 3 may be positioned so that the travelling distance is longer at the entrance side of the transportation path than at the exit side of the transportation path at least when the original document supporting plate 3 is moved upward and downward.

Figure 9:
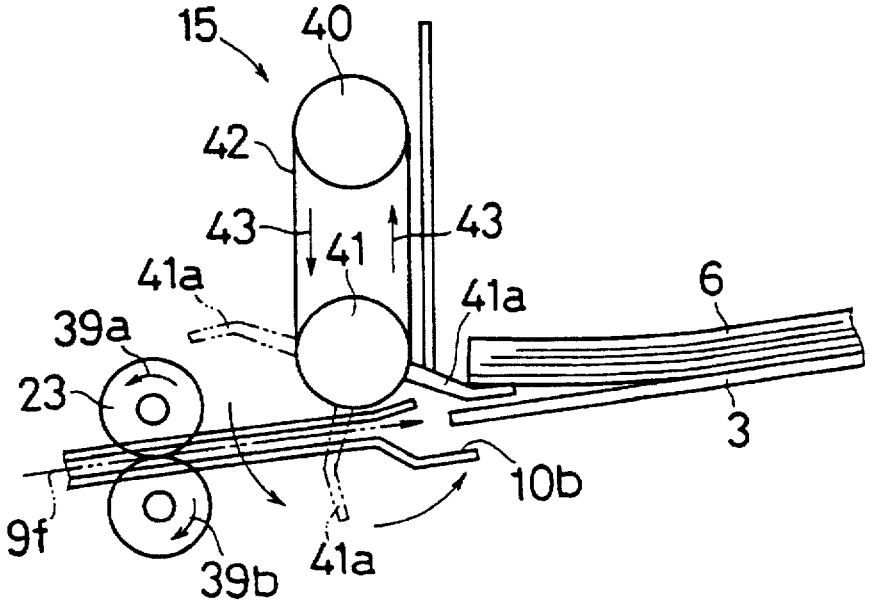
FIG. 9 is a side view enlarging a circulation sensor 15.
Figure 10:
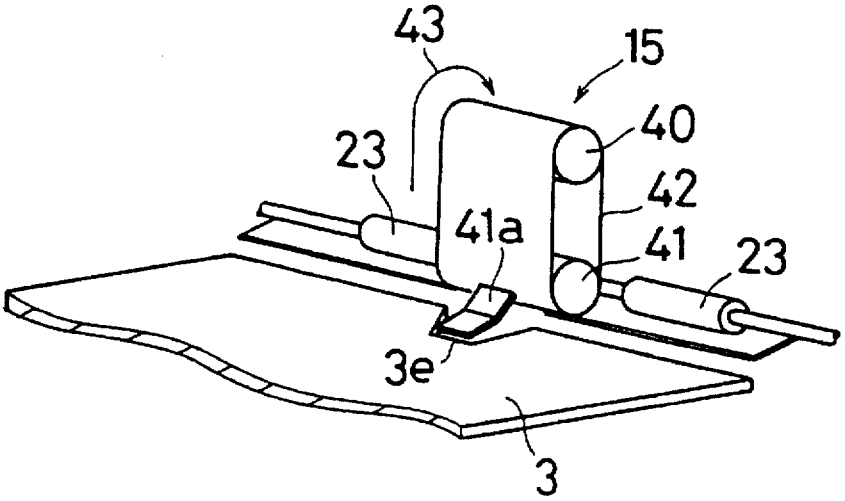
FIG. 10 is a perspective view enlarging the circulation sensor 15.

FIG. 9 is a side view enlarging the circulation sensor 15. FIG. 10 is a perspective view of the circulation sensor 15. By feeding the belt 42 wound around the driving wheel 40 and the driven wheel 41 in the direction of the arrow 43, the protrusion 41*a* attached to the belt 42 moves in an upward direction from the original document stacking surface over the original document supporting plate 3. A notch 3*e* is formed in the original document supporting plate 3 for the protrusion 41*a* to pass through. When the original documents 6 are stacked initially, the protrusion 41*a* is positioned between the original document supporting plate 3 and the stacked original documents 6, so that an original document 6 discharged from the transportation path 9 is stored between the original document supporting plate 3 and the protrusion 41*a*. Hence, as the discharged original documents 6 are stored, the protrusion 41*a* moves in an upward direction from the original document stacking surface of the original document supporting plate 3.

In this embodiment, the lengths of the original documents 6 in a direction parallel to the transportation direction are equal to each other, but the lengths of the original documents 6 in a direction perpendicular to the transportation direction may be optional. Such original documents 6 include letter papers (8.5 inches×11 inches) and legal paper (8.5 inches×14 inches), for instance. The length of the original document supporting plate 3 in a direction parallel to the transportation direction is approximately the same as the lengths of the original documents 6 in the same direction. Hence, as far as original documents having such a size described above are used, it is possible to detect whether the stacked original documents 6 have completed circulating. Thus, in contrast to a fixed-type in which the size of original documents to be used is specified, a movable-type in which original documents of any size can be used and stacked original documents always contact the circulation sensor 15 may be employed.

Figure 11:
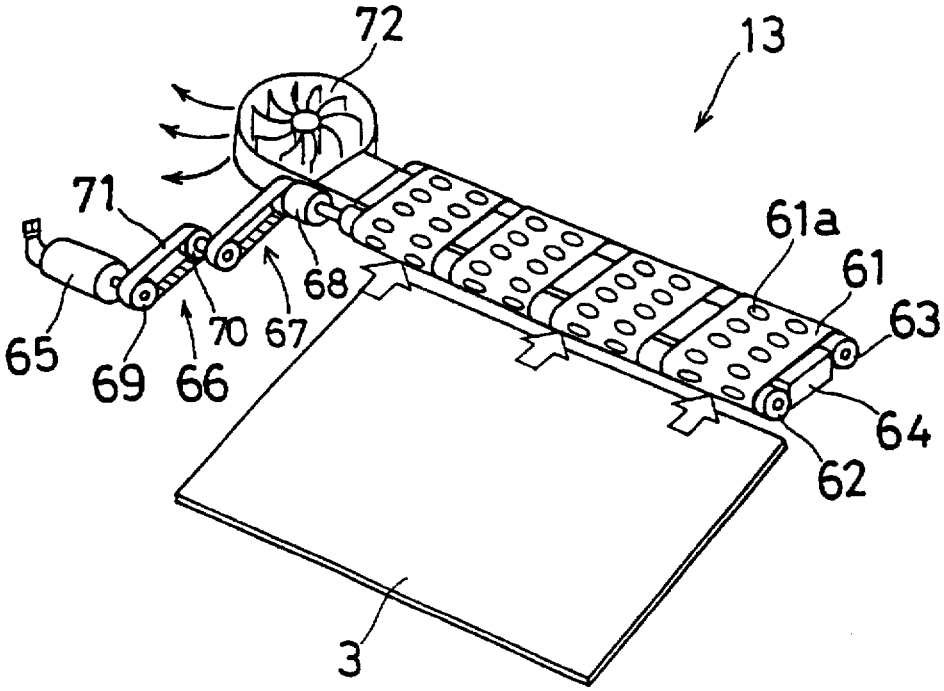
FIG. 11 is a perspective view showing a suction transportation device 13 which forms a paper feeding mechanism 11.

FIG. 11 is a perspective view showing the suction transportation device 13 which forms the paper feeding mechanism 11. To suck and transport the original documents 6 stacked on the original document supporting plate 3 one at a time onto the transportation path 9, the suction transportation device 13 includes a suction mechanism and a transportation mechanism therefore. The plurality of (four in this embodiment) paper feeding belts 61 having a plurality of through holes 61*a* are wound around rollers 62 and 63, and air suction mechanism 64 is disposed between the rollers 62 and 63. A plurality of through holes are formed in the air suction mechanism 64. Air is sucked in from the through holes 61*a* of the paper feeding belts 61 by driving a suction fan motor 72, and the sucked air is passed through the through holes of the air suction mechanism 64 and exhausted from the suction fan motor 72. As a result, the original documents 6 on the original document supporting plate 3 are sucked onto the paper feeding belts 61.

the paper feeding belts 61 are driven by a transportation motor 65. Power from the transportation motor 65 is supplied to a paper feeding belt clutch 68 through power transmitting mechanism 66 and 67 and then further supplied to the roller 62 to move the paper feeding belts 61. Power transmitting mechanism 66 is composed of rollers 69 and 70 and a belt 71 wound around the rollers 69 and 70. Power from the transportation motor 65 is transmitted to the roller 69 to rotate the roller 69, and the rotation of the roller 69 is transmitted to the other roller 70 through the belt 71. Power transmitting mechanism 67 is constituted similarly to power transmitting mechanism 66, so that power transmitted to power transmitting mechanism 66 is supplied to the paper feeding belt clutch 68. The paper feeding belts 61 are driven in this manner, and the sucked original document 6 is transported.

Figure 12:
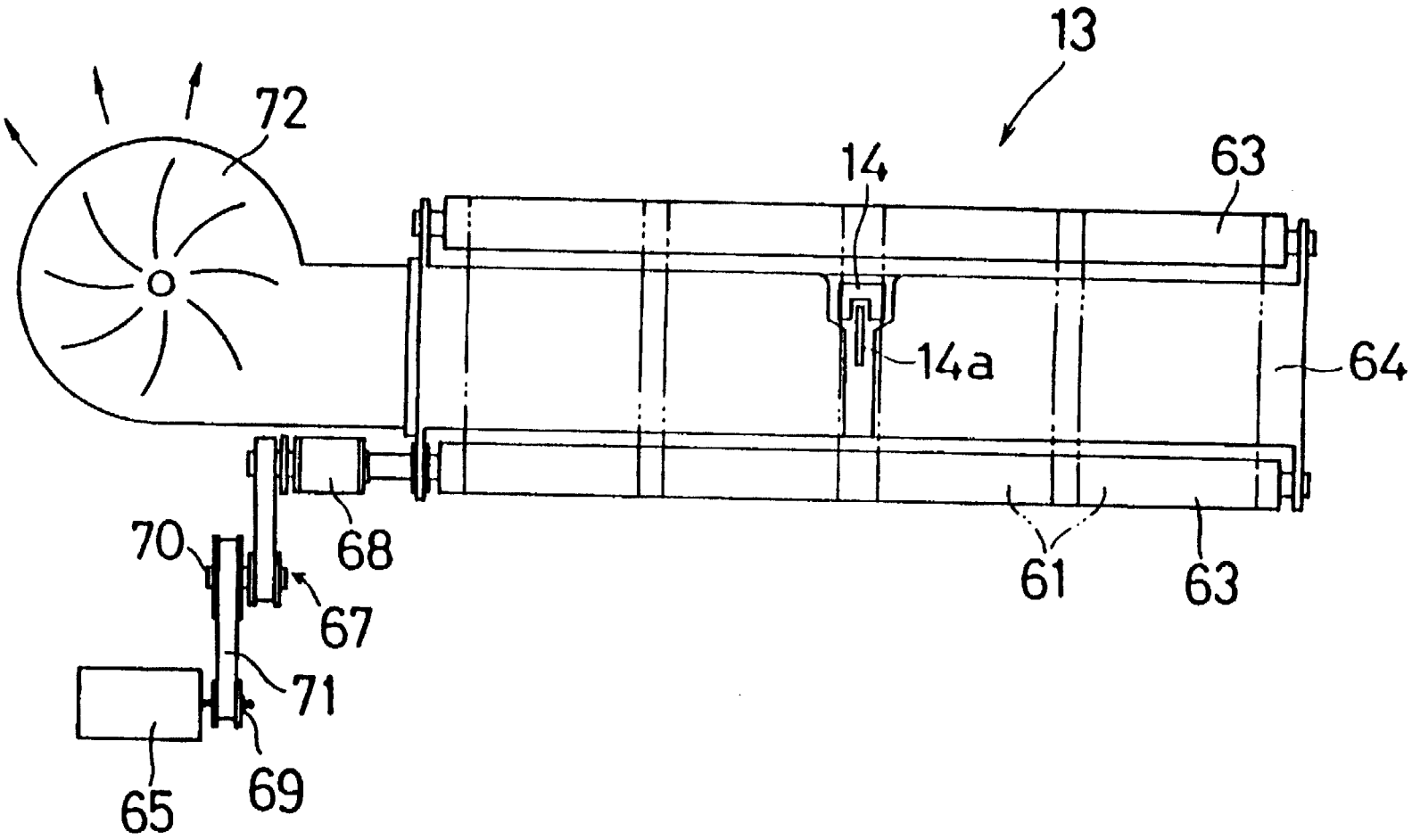
FIG. 12 is a bottom view showing a side of the suction transportation device 13 where the original document 6 is sucked onto.
Figure 13:
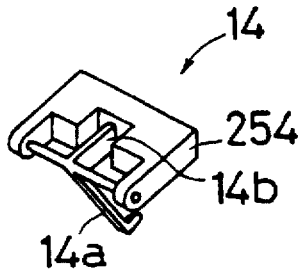
FIG. 13 is a perspective view enlarging a level sensor 14.
Figure 14:
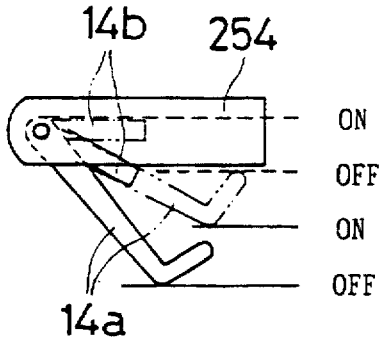
FIG. 14 is a view for describing an operation of the level sensor 14.

FIG. 12 is a bottom view showing a side of the suction transportation apparatus 13 where the original document 6 is sucked onto. FIG. 13 is a perspective view enlarging the level sensor 14. Further, FIG. 14 is a view for describing an operation of the level sensor 14. The level sensor 14 described above is disposed near the center of a suction side of the air suction mechanism 64, the original document 6 being sucked onto the suction side. A sensor main body 254 of the level sensor 14 is realized by, for example, a photo-interrupter which includes a light emitting element and a light receiving element spaced apart from each other. A detection member 14*b* displaced in accordance with the actuator 14*a* is disposed between the light emitting element and the light receiving element.

In a condition where the actuator 14*a* is not pressed by the original documents 6 stacked on the original document supporting plate 3, e.g., in a condition where the original document supporting plate 3 is positioned at HP, the detection member 14*b* is not located between the light emitting element and the light receiving element of the sensor main body 254 which is realized by the photointerrupter. The level sensor 14 is off at this stage. When the original document supporting plate 3 is moved upward and the actuator 14*a* is pressed by the original documents 6 on the original document supporting plate 3, the detection member 14*b* accordingly displaced is positioned between the light emitting element and the light receiving element of the sensor main body 254. This turns on the level sensor 14, whereby arrival of the stacked original documents 6 at the paper feeding position is detected.

Figure 15:
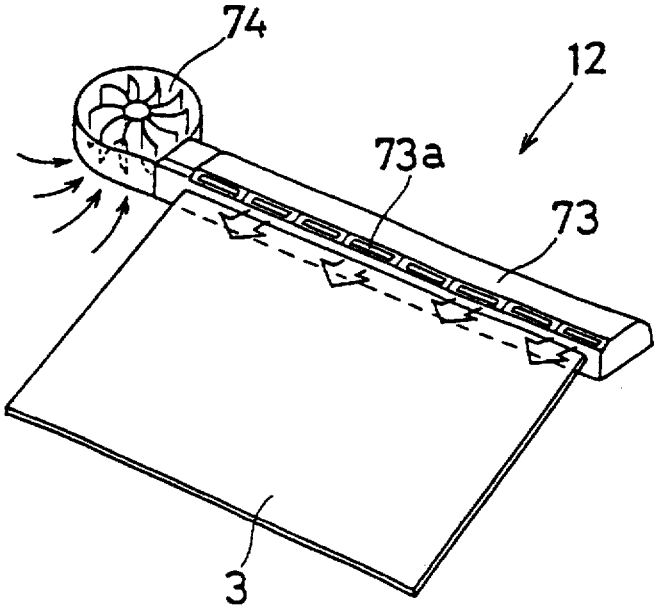
FIG. 15 is a perspective view showing an air injection device 12 which forms a paper feeding mechanism 11.

FIG. 15 is a perspective view showing the air injection device 12 which forms the paper feeding mechanism 11. To blow air onto original documents stacked on the original document supporting plate 3, the air injection device 12 includes exhaust mechanism 73 for exhausting air sucked in by a separation fan motor 74. A plurality of through holes 73*a* are formed in the exhaust mechanism 73, and air is injected from the through holes 73*a*.

Figure 16:
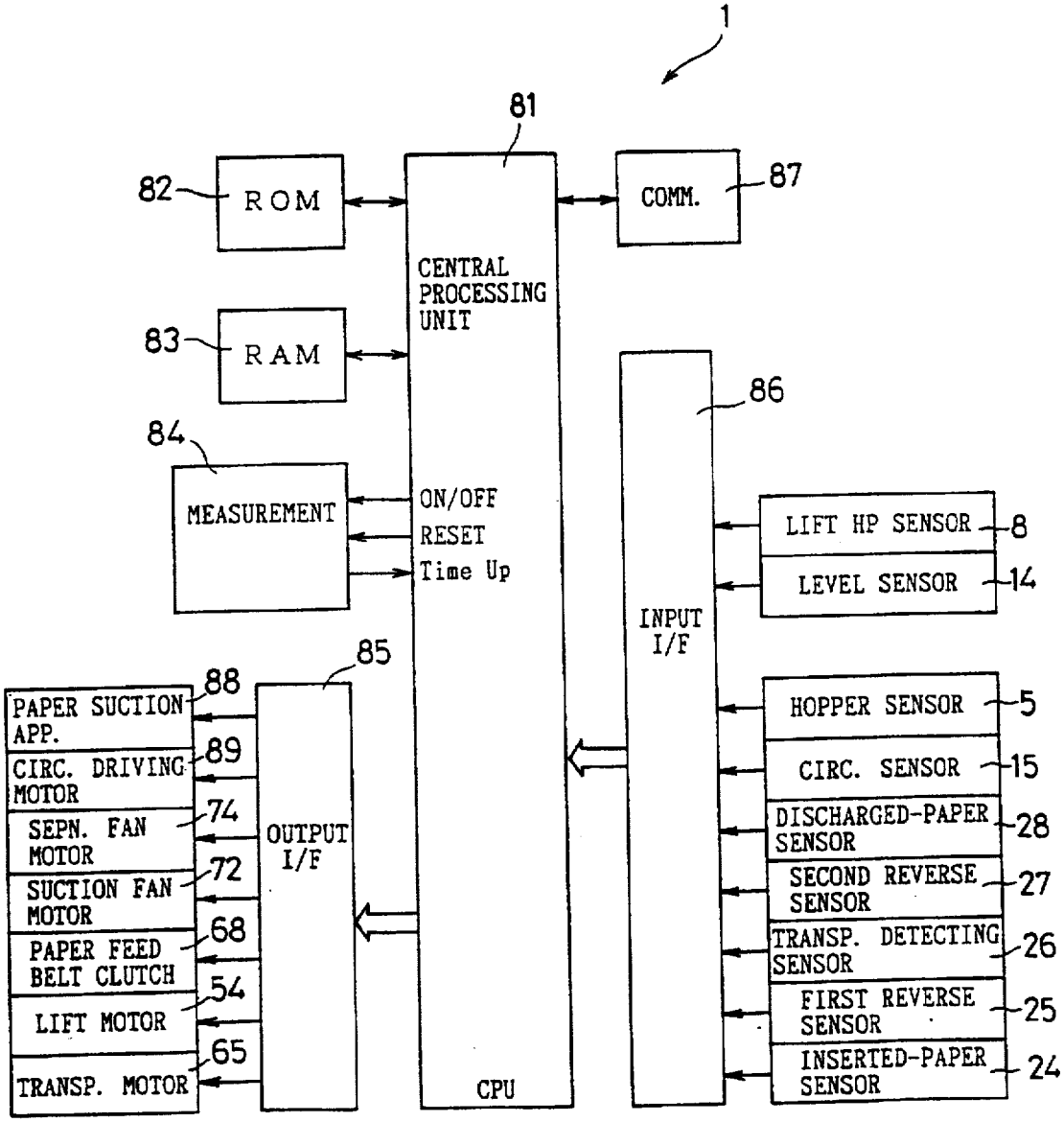
FIG. 16 is a block diagram showing an electric structure of the RDH 1.

FIG. 16 is a block diagram showing an electric structure of the RDH 1. The RDH 1 includes a CPU (Central Processing Unit) 81, a ROM (Read Only Memory) 82, a RAM (Random Access Memory) 83, a timing circuit 84, an output interface circuit 85, an input interface circuit 86 and a communication circuit 87. The CPU 81 performs an arithmetic operation for performing an operation of the RDH 1. The ROM 82 stores an operation program to be performed by the RDH 1 in advance. The RAM 83 stores the result of the arithmetic operation performed by the CPU 81, or is used as a working area for the arithmetic operation. The timing circuit 84 includes a plurality of timers, and measures, for example, an interval for transporting the original documents 6 onto the transportation path 9. The timing circuit 84 starts or stops timing in response to an ON/OFF control signal received from the CPU 81, and supplies a time-up signal to the CPU 81 when a preselected time set in the timers in advance has elapsed. Further, in response to a reset signal received from the CPU 81, the timing circuit 84 resets the timing operation.

In accordance with the result of the arithmetic operation performed by the CPU 81, the output interface circuit 85 supplies a control signal to the lift motor 54, the transportation motor 65, the paper feeding belt clutch 68, the suction fan motor 72, the separation fan motor 74, a paper suction device 88 and a circulation driving motor 89 which are connected to the output interface circuit 85. The input interface circuit 86 receives detection results from the hopper sensor 5, the lift HP sensor 8, the level sensor 14, the circulation sensor 15 and the sensors 24 to 28 for transporting original documents, and supplies the detection results to the CPU 81. The communication circuit 87 receives information, e.g., information indicating trouble and information inputted through a predetermined inputting unit, from the transfer-type electrostatic copying machine 101 which is used with the RDH 1 mounted thereon and supplies information received from the RDH 1 to the transfer-type electrostatic copying machine 101. The communication circuit 87 is connected to a PWB (Printed Wiring Board) of the transfer-type electrostatic copying machine 101, for instance.

Figure 17:
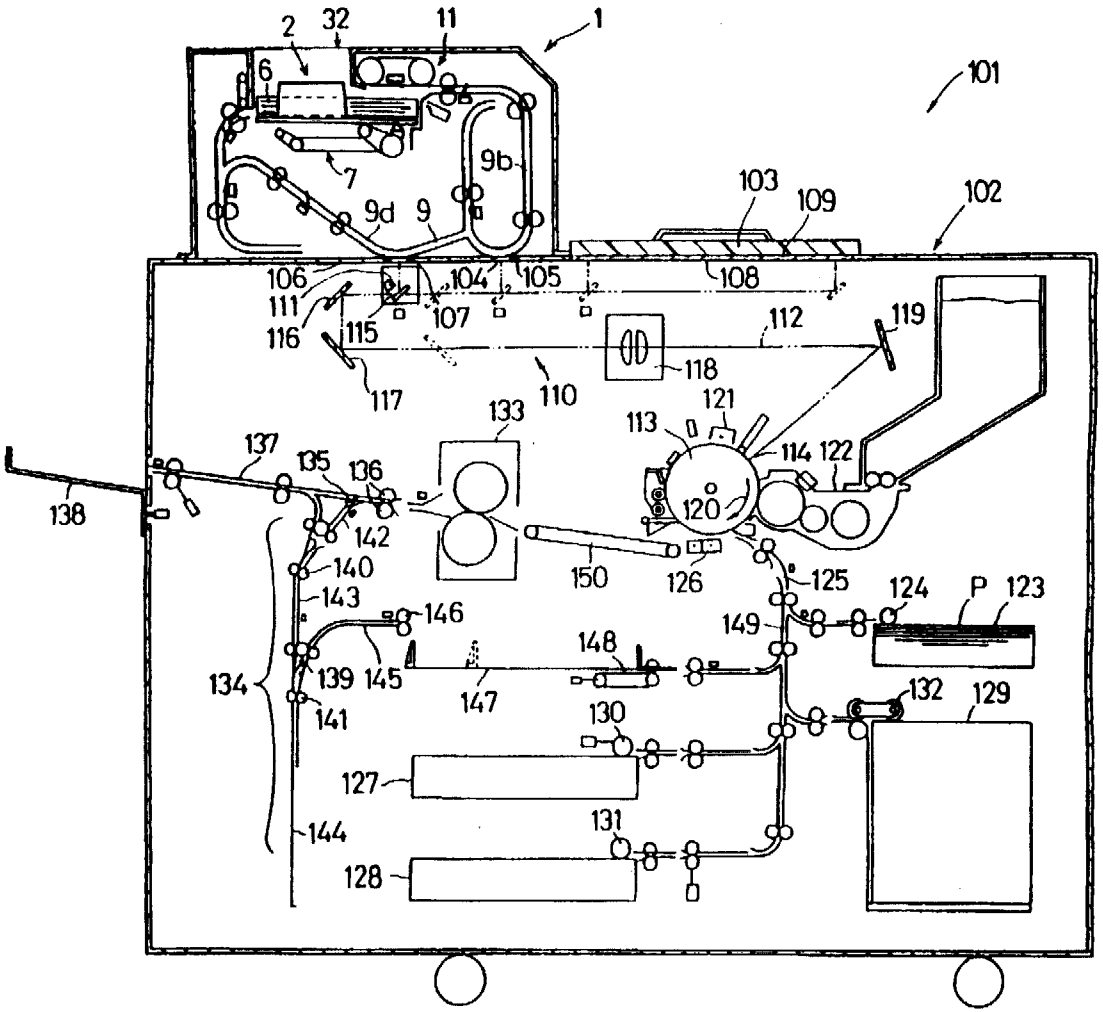
FIG. 17 is a cross-sectional view showing a simplified structure of a transfer-type electrostatic copying machine 101 to which the RDH 1 is mounted.

FIG. 17 is a cross-sectional view showing a simplified structure of the transfer-type electrostatic copying machine 101 to which the RDH 1 is mounted. The transfer-type electrostatic copying machine 101 reads images of the original documents 6 transported by the RDH 1, and reproduces the images on predetermined recording papers. The RDH 1 is disposed on a main unit 102. On the main unit 102 of the transfer-type electrostatic copying machine 101, the RDH 1 for reading the sheet-shaped original documents 6 and a thick original document pressing plate 103 for covering a thick original document such as a book are provided. An upper portion of the main unit 102 houses a first transparent plate 105 of the first reading part 104 at a position facing a part of the path **9*b* within the RDH 1 and a second transparent plate 107 of the second reading part 106 at a position facing a part of the path 9*d*. Further, for a third reading part 108 which reads a thick original document, the upper portion of the main unit 102 houses a third transparent plate 109 at a position facing the thick original document pressing plate 103**.

To copy the sheet-shaped original documents 6, the original documents 6 are stacked and stored the original document container mechanism 2 disposed within the RDH 1. When the original documents 6 are transported in the manner described above and light from an exposure lamp 111 of an optical system 110 is irradiated upon a surface of an original document to be read at the first reading part 104, and the second reading part 106 or at the third reading part 108 for thick original documents, reflected light from the surface of the original document is imaged in an exposure region 114 on a photosensitive drum 113 through an optical path 112 by the optical system 110. The optical system 110 is composed of the exposure lamp 111, reflection mirrors 115 to 117, a zoom lens 118 and a reflection mirror 119. The photosensitive drum 113 rotated in the direction of an arrow 120 is charged up by a main corona discharger 121, first. Next, as mentioned above, an image which corresponds to the surface of the original document read by the reading part 104, 106 or 108 is imaged in the exposure region 114 by the optical system 110, whereby an electrostatic latent image which corresponds to the surface of the original document is created. The created electrostatic latent image is developed into a toner image by a developing device 122. The toner image is transferred by the transferring corona discharger 121 onto copying paper P which is fed by paper feeding rollers 124 from a cassette 123 and transported onto a transportation path 125.

In addition to the cassette 123, cassettes 127 to 129 are provided as cassettes for storing copying paper P. The different cassettes store copying papers P of different sizes. The copying paper P is transported onto the transportation path 125 by paper feeding rollers 130 to 132 depending on a use, and copying is thereafter performed.

The copying paper P on which the toner image is transferred is conveyed to a fixing device 133 by transporting unit 150 and affixed. In simplex copying in which copying is performed on only one of the surfaces of the copying paper P, a first direction switching claw 135, i.e., a part of copying paper reversing mechanism 134 described later, is positioned so that a transportation path 142 may be closed and a transportation path 137 may be opened. The copying paper P with a fixed image is transported to the transportation path 137 by transporting rollers 136, and discharged into a discharging tray 138. In duplex copying in which copying is performed on the both surfaces of the copying paper P, in order to perform copying on the other surface on which an image is not yet copied, the copying paper P with copying on the one of the surfaces thereof complete is transported to the copying paper reversing mechanism 134 without being discharged into the discharging tray 138.

The copying paper reversing mechanism 134 is composed of the first direction switching claw 135, a second direction switching claw 139, a pair of transportation rollers 140 and a pair of transportation rollers 141 which are rotatable in a forward direction and a backward direction. When the first direction switching claw 135 is switched to open the transportation path 142 and close the transportation path 137, the copying paper P with copying on the one of the surfaces complete is transported to the transportation path 142. The copying paper P transported to the transportation path 142 is transported to a transportation path 143 by the transportation rollers 140, and when the second direction switching claw 139 is positioned so as to open the transportation path 143, the copying paper P is further transported to a transportation path 144. When the upstream side, in the feeding direction, of the copying paper P transported to the transportation path 144 passes through the second direction switching claw 139, the transportation rollers 141 are rotated in such a direction in which the copying paper P is fed back toward the transportation path 143. When the transportation rollers 141 are rotated in the direction described above, and the position of the second direction switching claw 139 is switched so as to close the transportation path 143 and open a transportation path 145, whereby the copying paper P is transported to the transportation path 145 from the transportation path 144.

The copying paper P transported to the transportation path 145 is discharged into an intermediate tray 147 by discharging rollers 146. The copying paper P inserted into the intermediate tray 147 is fed by a paper feeding roller 148 and transported to the photosensitive drum 113 through a transportation path 149 and 125, and copying on the other surface on which an image is not yet copied is performed. After duplex copying which is realized by the manner described above, the first direction switching claw 135 of the copying paper reversing mechanism 134 is switched so as to open the transportation path 137, and the copying paper P is transported to the transportation path 137 by the transporting roller 136 and thereafter discharged into the discharging tray 138.

Figure 18:
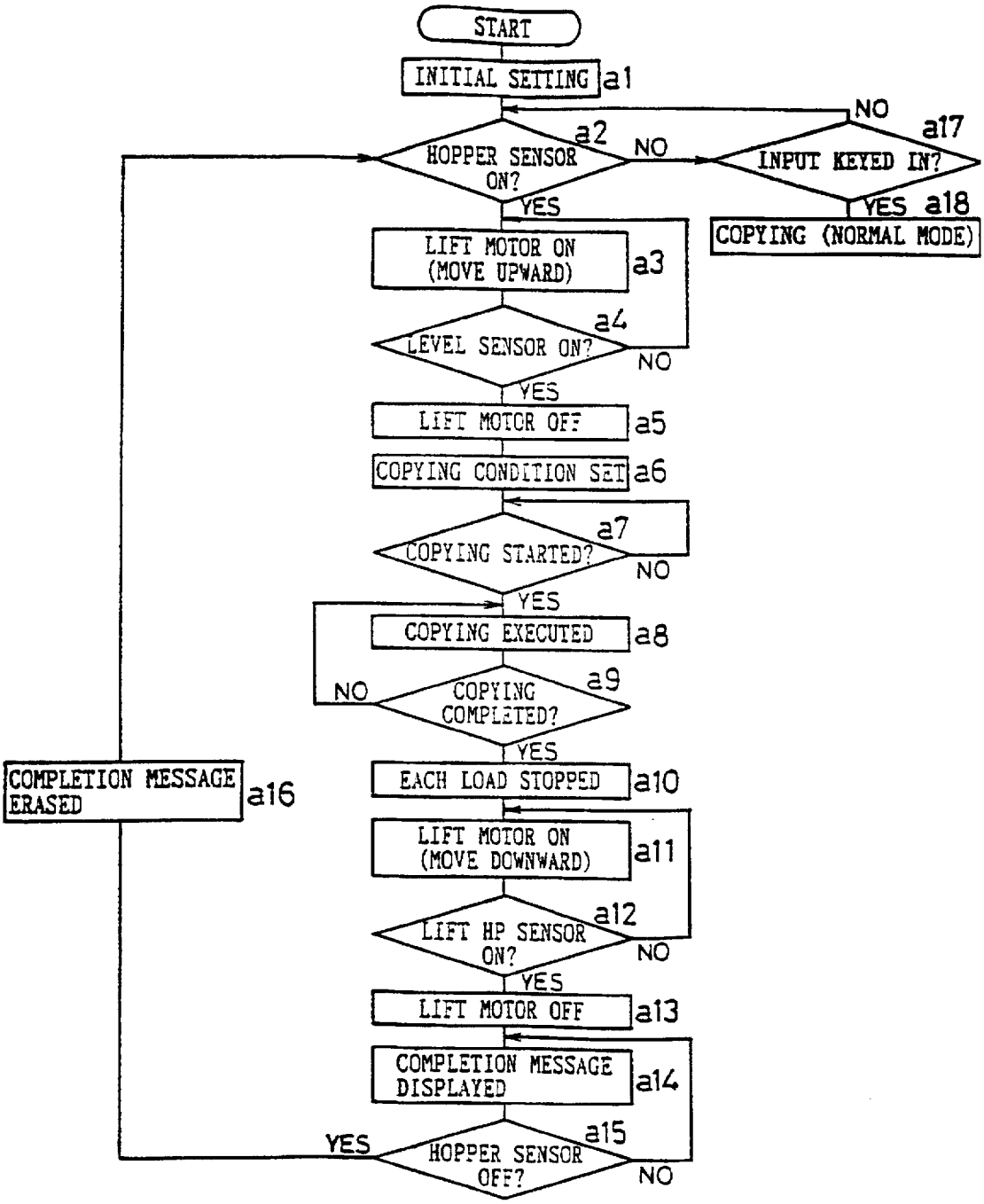
FIG. 18 is a flow chart showing an operation of the RDH 1 according to the first embodiment.

FIG. 18 is a flow chart showing an operation of the RDH 1 according to the first embodiment. At Step a1, initial setting of the plurality of sensors and the plurality of motors of the RDH 1 is performed. At Step a2, whether the hopper sensor 5 is ON is judged. When the hopper sensor 5 is ON, the sequence proceeds to Step a3. When the hopper sensor 5 is not ON, the sequence proceeds to Step a17. At Step a17, it is judged whether an input is keyed in from the transfer-type electrostatic copying machine 101, e.g., an input instructing to start copying is keyed in. When such an input is keyed in, the sequence proceeds to Step a18, so that copying in a normal mode, that is, copying at the third reading part 108 without using the RDH 1 is performed. When judged, at Step a17, that there is no such input, the sequence returns to Step a2.

At Step a3, the lift motor 54 is turned on to move the original document supporting plate 3 upward. At Step a4, whether the level sensor 14 is ON is judged. When the level sensor 14 is ON, the sequence proceeds to Step a5. When the level sensor 14 is not ON, the sequence returns to Step a3. At Step a5, the lift motor 54 is turned off. At this stage, the distance L1 of, for example, 5 mm is created between the paper feeding belts 61 and the uppermost face of the original documents 6 as described above. During copying as described later, the uppermost original document is sucked onto the paper feeding belts 61 by suction force which is supplied by the suction fan motor 72 and transported onto the transportation path 9.

At Step a6, an input is keyed in by means of an operation panel or the like of the transfer-type electrostatic copying machine 101. At this stage, copying conditions such as the number of copies are set. At Step a7, whether the start of copying is instructed from the transfer-type electrostatic copying machine 101 is judged. When judged that the start of copying is instructed, the sequence proceeds to Step a8. At Step a8, copying is performed. At Step a9, whether copying has been completed is judged. When judged that copying has been completed, the sequence proceeds to Step a10. When judged that copying has not been completed, the sequence returns to Step a8.

At Step a10, loads of the plurality of motors or the like of the RDH 1 are temporarily suspended. At Step a11, the lift motor 54 is turned on, moving the original document supporting plate 3 downward. At step a12, whether the lift HP sensor 8 is turned on is judged. When judged that the lift HP sensor 8 is ON, the sequence proceeds to Step a13. When judged that the lift HP sensor 8 is not ON, the sequence returns to Step all. At Step a13, the lift motor 54 is turned off. At Step a14, completion data are transmitted to the transfer-type electrostatic copying machine 101 through the communication circuit 87, and on receiving the completion data, the transfer-type electrostatic copying machine 101 displays a completion message on a display part thereof.

At step a15, whether the hopper sensor 5 is turned off is judged. When it is detected that the hopper sensor 5 is turned off and the original documents 6 are removed from the original document supporting plate 3, the sequence proceeds to Step a16, whereby the completion data transmitted at Step a14 are released and the completion message displayed on the transfer-type electrostatic copying machine 101 is erased. When it is judged, at Step a15, that the hopper sensor 5 is not OFF, the sequence returns to Step a14. When the operation at Step a16 is finished the sequence returns to Step a2.

As described above, according to the first embodiment, the lift motor 54 is turned on as soon as the original documents 6 are stacked on the original document supporting plate 3 and the hopper sensor 5 is turned on, so that the original document supporting plate 3 is moved upward. Hence, as compared with the case where the original document supporting plate 3 is moved upward after the instruction to start copying, a time needed until the first original document is transported onto the transportation path 9 is shorter, thereby reducing a time which is necessary for copying.

Figure 19:
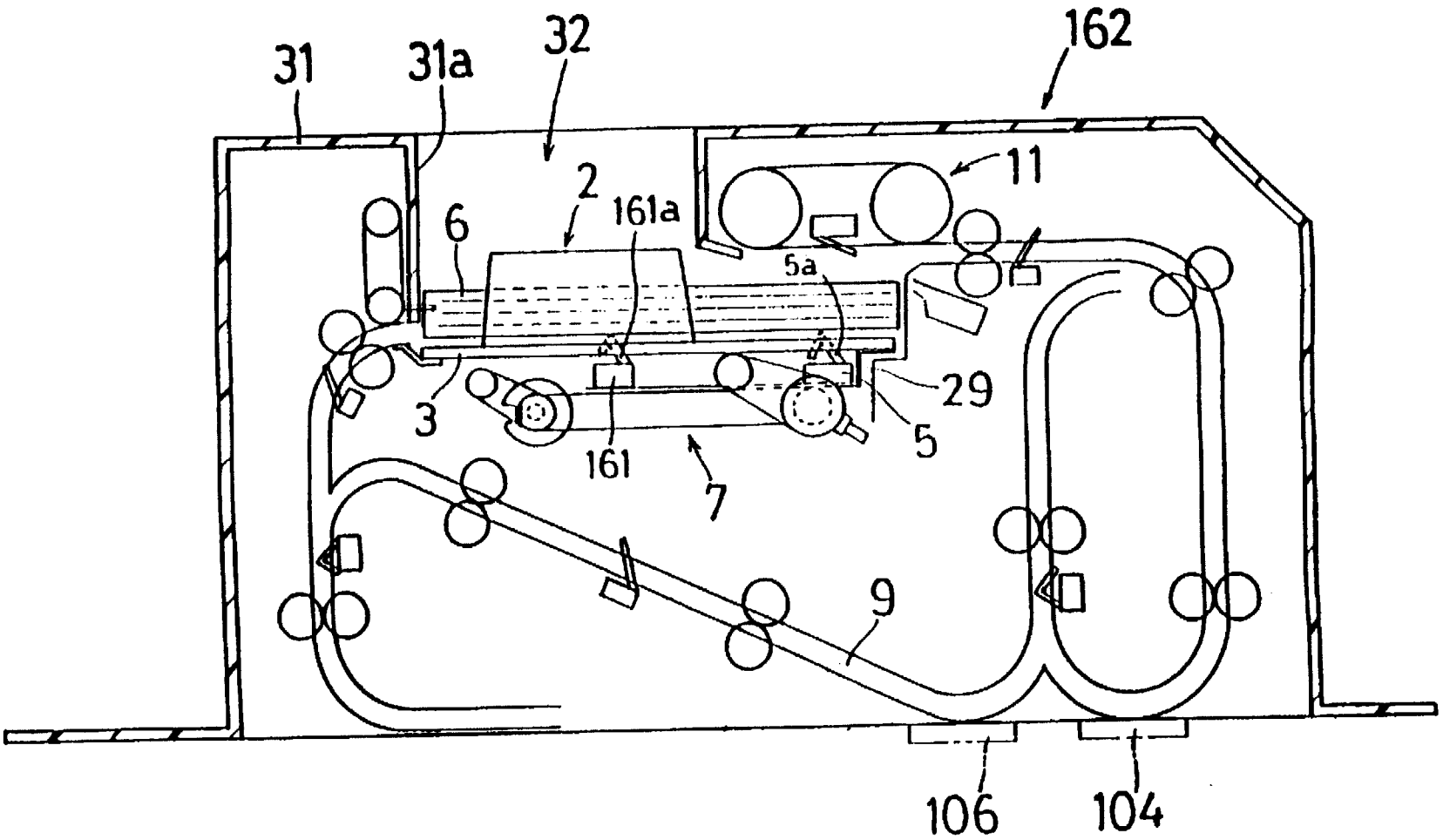
FIG. 19 is a cross-sectional view showing a structure of an RDH 162 according to a second embodiment of the invention.

FIG. 19 is a cross-sectional view showing a structure of an RDH 162 according to a second embodiment of the invention. The RDH 162 is characterized in that the hopper sensor 5 is regarded as a first hopper sensor 5 and a second hopper sensor 161 which is similar to the hopper sensor 5 is provided. Except for the second hopper sensor 161, the RDH 162 has a similar structure to the RDH 1 of the first embodiment. The hopper sensor 161 includes an actuator 161*a* which is similar to the actuator 5*a*, and the actuator 161*a* is attached on the mount piece 29 so as to project from the original document stacking surface of the original document supporting plate 3. For instance, the first hopper sensor 5 is disposed at the entrance side of the transportation path of the original document supporting plate 3 and the second hopper sensor 161 is disposed at the exit side of the transportation path from the vicinity of the center of the original document supporting plate 3. An output from the hopper sensor 161 is supplied to the input interface circuit 86 the same as an output from the hopper sensor 5.

Figure 20:
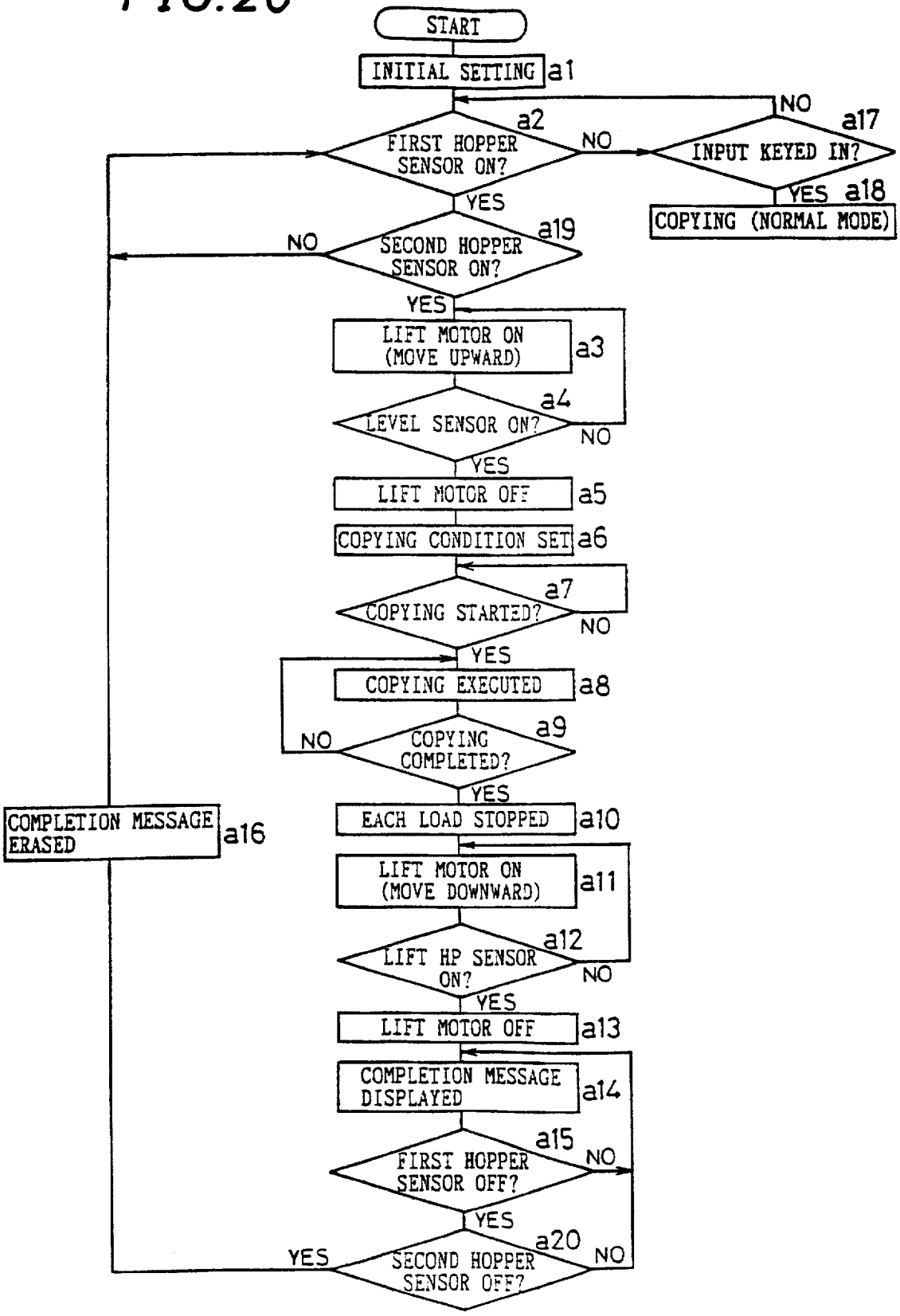
FIG. 20 is a flow chart showing an operation of the RDH 162.

FIG. 20 is a flow chart showing an operation of the RDH 162. The flow chart of FIG. 20 is similar to the flow chart of FIG. 18 described before as it is modified to additionally include Step a19 and Step a20. At Step a2 described above, when it is judged that the first hopper sensor 5 is ON, the sequence proceeds to Step a19 and whether the second hopper sensor 161 is ON is judged. The sequence proceeds to Step a3 when it is judged that the second hopper sensor 161 is ON. The sequence returns to Step a2 when it is judged that the second hopper sensor 161 is not ON. At Step a15 described above, when it is judged that the first hopper sensor 5 is OFF, the sequence proceeds to Step a20 and whether the second hopper sensor 161 is OFF is judged. When it is judged that the second hopper sensor 161 is OFF, the sequence proceeds to Step a16. When it is judged that the second hopper sensor 161 is not OFF, the sequence returns to Step a14.

As described above, according to the second embodiment, when the two hopper sensors 5 and 161 are turned ON, the lift motor 54 is turned on to move the original document supporting plate 3 upward. When there is only one hopper sensor as in the first embodiment, there is a possibility that the hopper sensor 5 will be turned on to move the original document supporting plate 3 upward, although a user is still stacking the original documents 6 on the original document supporting plate 3. However, when the two hopper sensors 5 and 161 are used as in this embodiment, the original document supporting plate 3 is moved upward after stacking of the original documents 6 is completely finished, and thus it is possible to stack the original documents 6 stably without fail.

In addition, during removing of the original documents, the lift motor 54 will not be turned on to move the original document supporting plate 3 downward unless the two hopper sensors 5 and 161 are both turned off. Hence, it is possible to remove the original documents 6 stably without fail.

Figure 21:
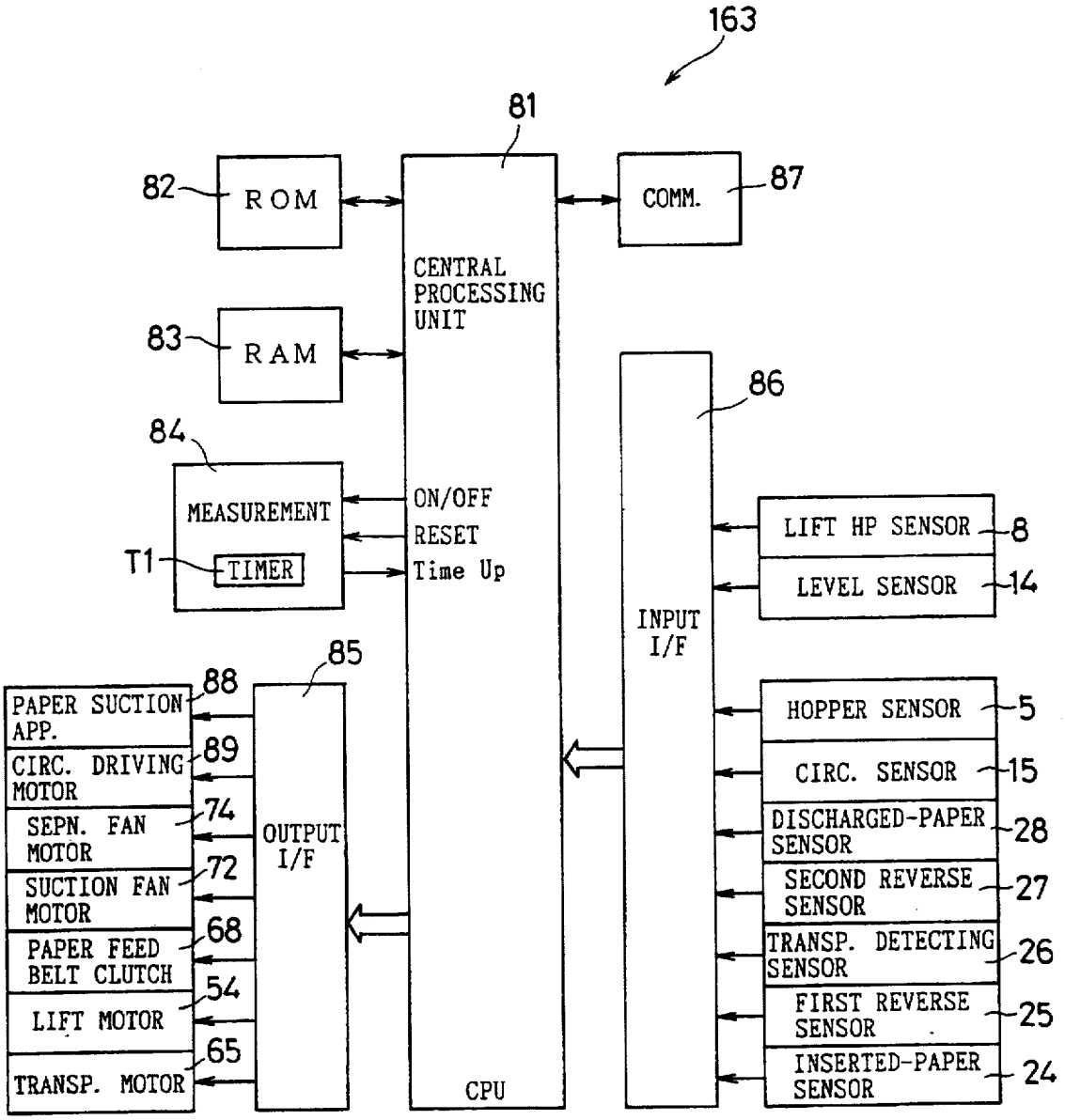
FIG. 21 is a block diagram showing an electric structure of an RDH 163 according to a third embodiment of the invention.

FIG. 21 is a block diagram showing an electric structure of an RDH 163 according to a third embodiment of the invention. Although the RDH 163 has an approximately similar structure to that of the RDH 1 of the first embodiment, the RDH 163 is characterized in that the timing circuit 84 includes a timer T1. The RDH 163 has the same structure as the RDH 1 of the first embodiment. The timer T1 starts timing after the hopper sensor 5 is turned on. Confirming that a predetermined time has elapsed in accordance with the timing operation of the timer T1, the CPU 81 turns on the lift motor 54 to move the original document supporting plate 3 upward.

Figure 22:
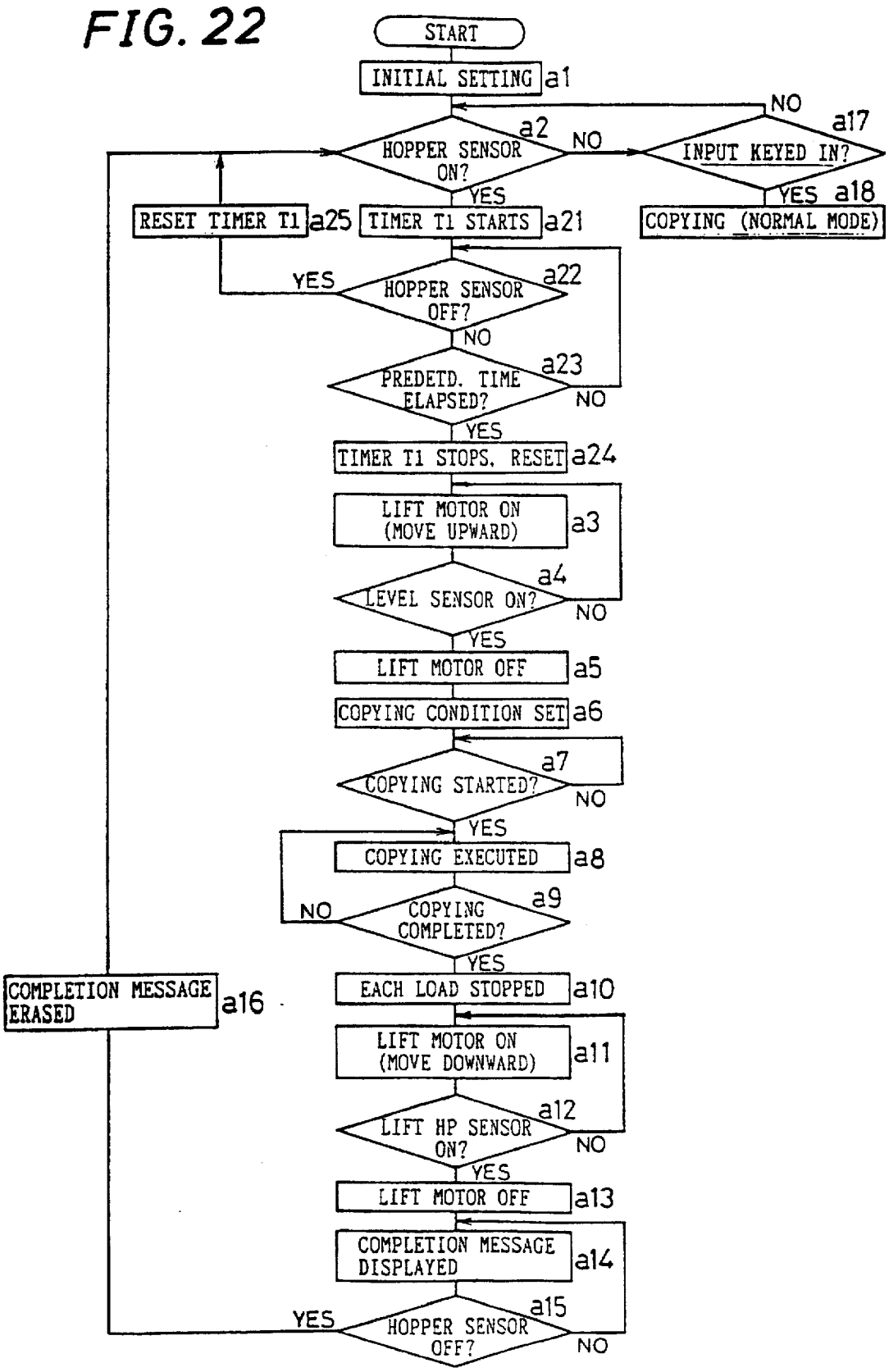
FIG. 22 is a flow chart showing an operation of the RDH 163.

FIG. 22 is a flow chart showing an operation of the RDH 163. The flow chart of FIG. 22 is similar to the flow chart of FIG. 18 described before as it is modified to additionally include Step a21 to Step a25. At Step a2 described above, when it is judged that the hopper sensor 6 is ON, the sequence proceeds to Step a21 and the timer T1 starts timing. At Step a22, whether the hopper sensor 5 is OFF is judged. When it is judged that the hopper sensor 5 is OFF, the sequence proceeds to Step a25, and the timer T1 is reset, and the sequence returns to Step a2. A case where it is judged at Step a22 that the hopper sensor 5 is OFF is, for example, the case where the stacked original documents 6 are removed. When it is judged, at Step a22, that the hopper sensor 5 is not OFF, the sequence proceeds to Step a23 and whether a predetermined time set in advance has elapsed is judged. When it is judged that the predetermined time has elapsed, the sequence proceeds to Step a24 to stop the timing operation of the timer T1 and reset the timer T1. When the operation at Step a24 is completed, the sequence proceeds to Step a3. When it is judged, at Step a23, that a time measured by the timer T1 has not reached the predetermined time, the sequence returns to Step a22.

As described above, according to the third embodiment, when the hopper sensor 5 is turned on and the predetermined time has elapsed, it is judged that stacking of the original documents 6 is completed, whereby the original document supporting plate 3 is automatically moved upward. Hence, as compared with the case where the original document supporting plate 3 is moved upward after the instruction to start copying, a time needed until the first original document is transported onto the transportation path 9 is shorter, thereby reducing a time which is necessary for copying. Further, the circuit structure is simpler than in the second embodiment since turning on of the second hopper sensor is judged in accordance with an elapsed time.

Figure 23:
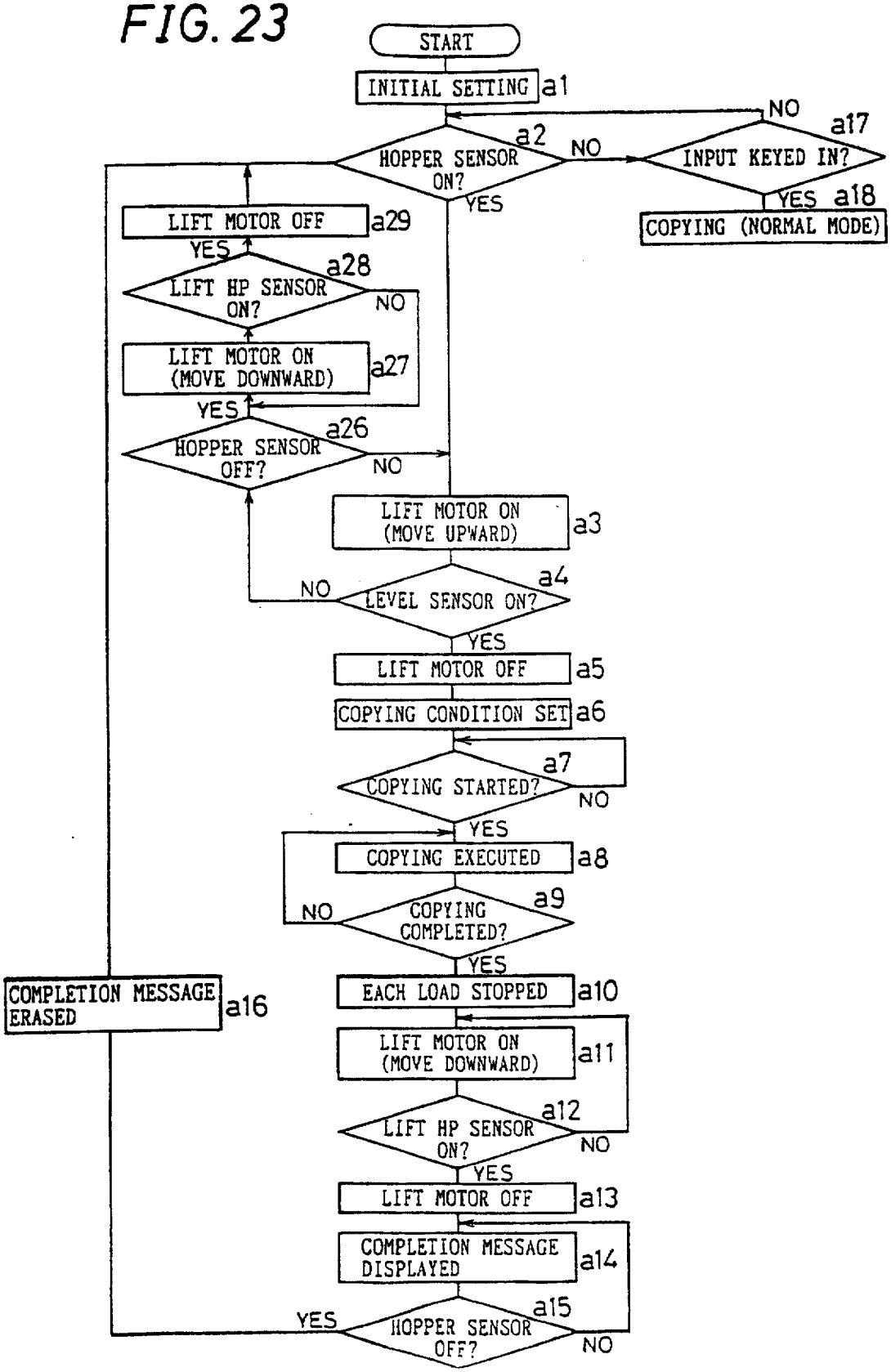
FIG. 23 is a flow chart showing an operation of an RDH according to a fourth embodiment of the invention.

FIG. 23 is a flow chart showing an operation of an RDH according to a fourth embodiment of the invention. The fourth embodiment is characterized in that the original document supporting plate 3 is moved downward, as soon as the hopper sensor 5 is turned off while the original document supporting plate 3 is still moving upward. In the fourth embodiment, the RDH is realized by adding such a function to the RDH 1 of the first embodiment. The flow chart of FIG. 23 is similar to the flow chart of FIG. 18 described before as it is modified to additionally include Step a26 to Step a29.

At Step a4 described above, when it is judged that the level sensor 14 is not ON, the sequence proceeds to Step a26. At Step a26, whether the hopper sensor 5 is OFF is judged. When it is judged that the hopper sensor 5 is OFF, the sequence proceeds to Step a27. When it is judged that the hopper sensor 5 is not OFF, the sequence returns to Step a3. At Step a27, the lift motor 54 is turned on to move the original document supporting plate 3 downward. At Step a28, whether the lift HP sensor 8 is ON is judged. When it is judged that the lift HP sensor 8 is ON, the sequence proceeds to Step a29. When it is judged that the lift HP sensor 8 is not ON, the sequence returns to Step a27. At Step a29, the lift motor 54 is turned off. When the operation at Step a29 is completed, the sequence returns to Step a2.

As described above, according to the fourth embodiment, since the original document supporting plate 3 is moved downward as soon as the stacked original documents 6 are removed during upward movement of the original document supporting plate 3 and the hopper sensor 5 is turned off, for example, when the hopper sensor 5 is turned off during upward movement of the original document supporting plate 3, a time needed to stack the original documents 6 once again is shorter than the case where the original document supporting plate 3 is moved downward after an instruction to stop copying is given through the operation panel or the like of the transfer-type electrostatic copying machine 101.

Figure 24:
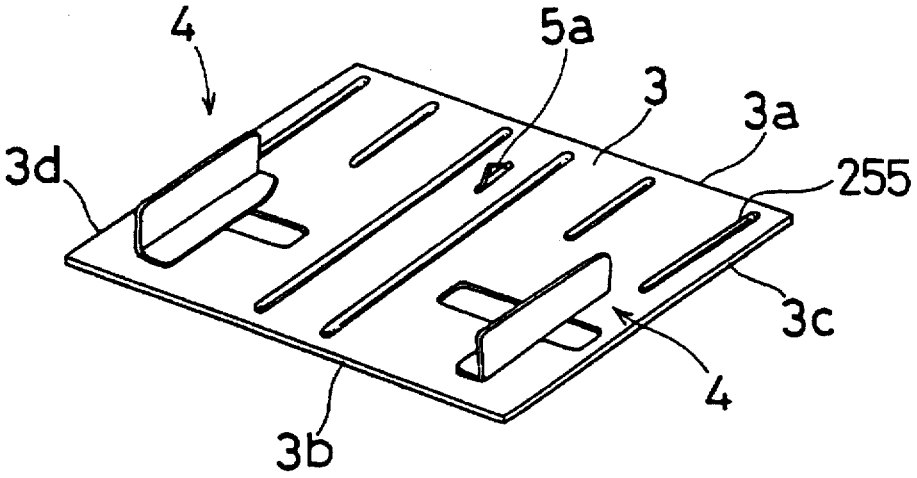
FIG. 24 is a perspective view showing an original document supporting plate 3 of an RDH according to a fifth embodiment of the invention.
Figure 25:
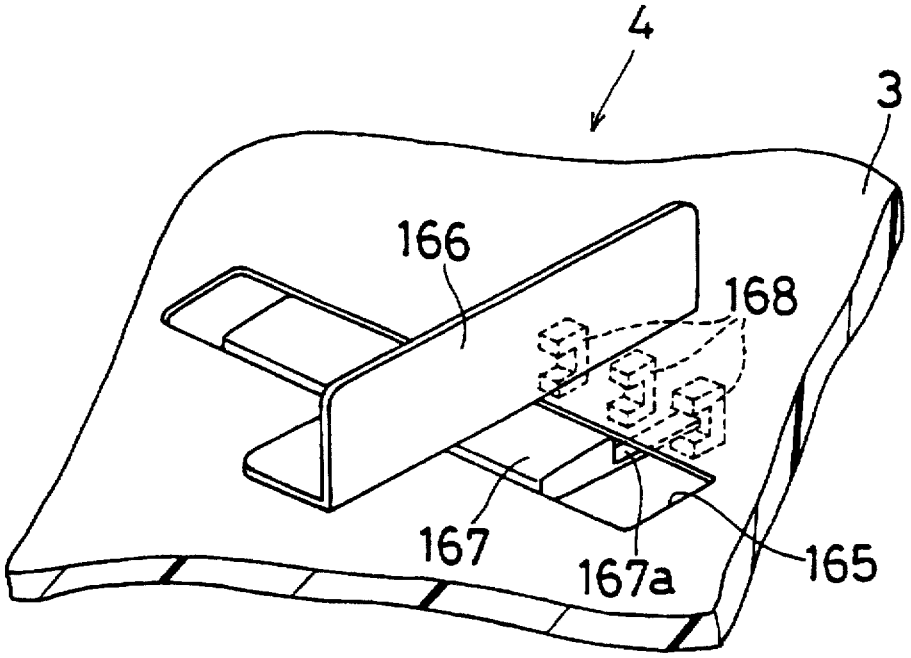
FIG. 25 is a perspective view enlarging a guide plate 4 provided on the original document supporting plate 3.

FIG. 24 is a perspective view showing the original document supporting plate 3 of an RDH according to a fifth embodiment of the invention. FIG. 25 is a perspective view enlarging the guide plates 4 provided on the original document supporting plate 3. To detect the size of the original documents 6 stacked on the original document supporting plate 3, the guide plates 4 are formed at the side of end portions 3c and 3d of the original document supporting plate 3, the end portion 3c and 3d being opposite to each other and different from an end portion 3a of the original document supporting plate 3 formed at the entrance side of the transportation path 9 and an end portion 3b of the original document supporting plate 3 formed at the exit side of the transportation path 9. The structure of the fifth embodiment is similar to the RDH 1 of the first embodiment.

Referring to FIG. 25, the guide plate 4 comprises a thin, long and L-shaped alignment plate 166, and a thin, long holding member 167. The alignment plate 166 and the holding member 167 are arranged to intersect orthogonal to each other. The alignment plate 166 is disposed on the original document stacking surface of the original document supporting plate 3, while the holding member 167 is disposed on the surface of the original document supporting plate 3, opposite to the original document stacking surface thereof. These members abut each other and are connected to each other in a guide groove 165 formed in the original document supporting plate 3. The alignment plate 166 and the holding member 167 are moved along the guide groove 165.

A projection 167a is formed in the holding member 167, and an original document size detection sensor 168 which is composed of a light emitting diode and a photo diode is disposed, the diode being arranged so as to interpose the projection 167a. One or more original document size detection sensors 168 are disposed in correspondence to the sizes of the original documents which can be copied by the transfer-type electrostatic copying machine 101. By adjusting the length between the alignment plates 166 of the guide plates 4, the guide plates being disposed respectively on the sides of the end portions 3c and 3d and moving in response to each other, in accordance with the stacked original documents 6, and by confirming outputs from the original document size detection sensors 168 at that time, it is possible to determine whether the size of the original documents 6 is a reproducible size. When the projection 167a is positioned between the light emitting diode and the photo diode and turned on, it is judged that the size is a reproducible size. In other cases, it is judged that the size is not a reproducible size. Outputs from the original document size detection sensors 168 are supplied to the input interface circuit 86.

Figure 26:
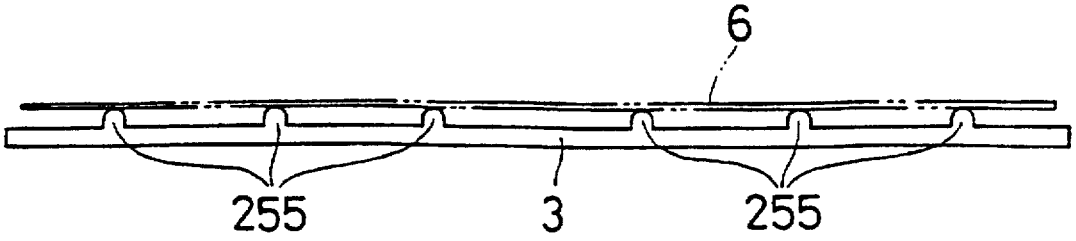
FIG. 26 is a side view of the original document supporting plate 3 as viewed from a transportation direction for transporting the original documents.

FIG. 26 is a side view of the original document supporting plate 3 as viewed from the transportation direction for transporting the original documents. A plurality of thin and long ribs 255 are provided on the original document stacking surface of the original document supporting plate 3. The plurality of ribs 255 are disposed parallel to the transportation direction at intervals. The original documents 6 are stacked with a space created between the original documents 6 and the original document supporting plate 3 by the ribs 255. By reducing the contact area between the stacked original documents 6 and the original document supporting plate 3 in this manner and thereby reducing friction between the two, transportation of the original documents 6 becomes easier.

Figure 27A:
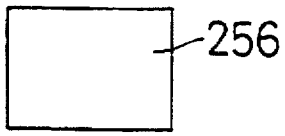
FIG. 27A to 27C are views of original documents 256 to 258, respectively.
Figure 27B:
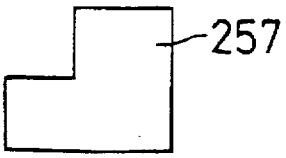
Figure 27C:
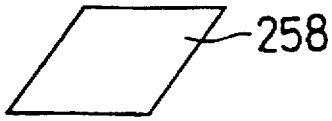

As described above, original documents of only a specific size can be copied in order to make it easy to control the timing of transporting the original documents, the exposure time during copying, etc. That is, the CPU 81 detects the size of the original documents, and controls the operation of the RDH on the basis of the timing of transporting the original documents, the exposure time and the like which are set for each original document size. The size of a rectangular original document 256 as shown in FIG. 27A can be detected easily, and the RDH is controlled after reading the transportation timing and the exposure time which are set for a detected original document size. On the other hand, detection of sizes of original documents 257 and 258 having not rectangular but irregular shapes as those shown in FIGS. 27B and 27C is very difficult. Further, when the transportation timing and the exposure time are not yet set for a detected original document size, it is impossible to control the RDH at suitable transportation timing and exposure time for the stacked original documents.

Figure 28:
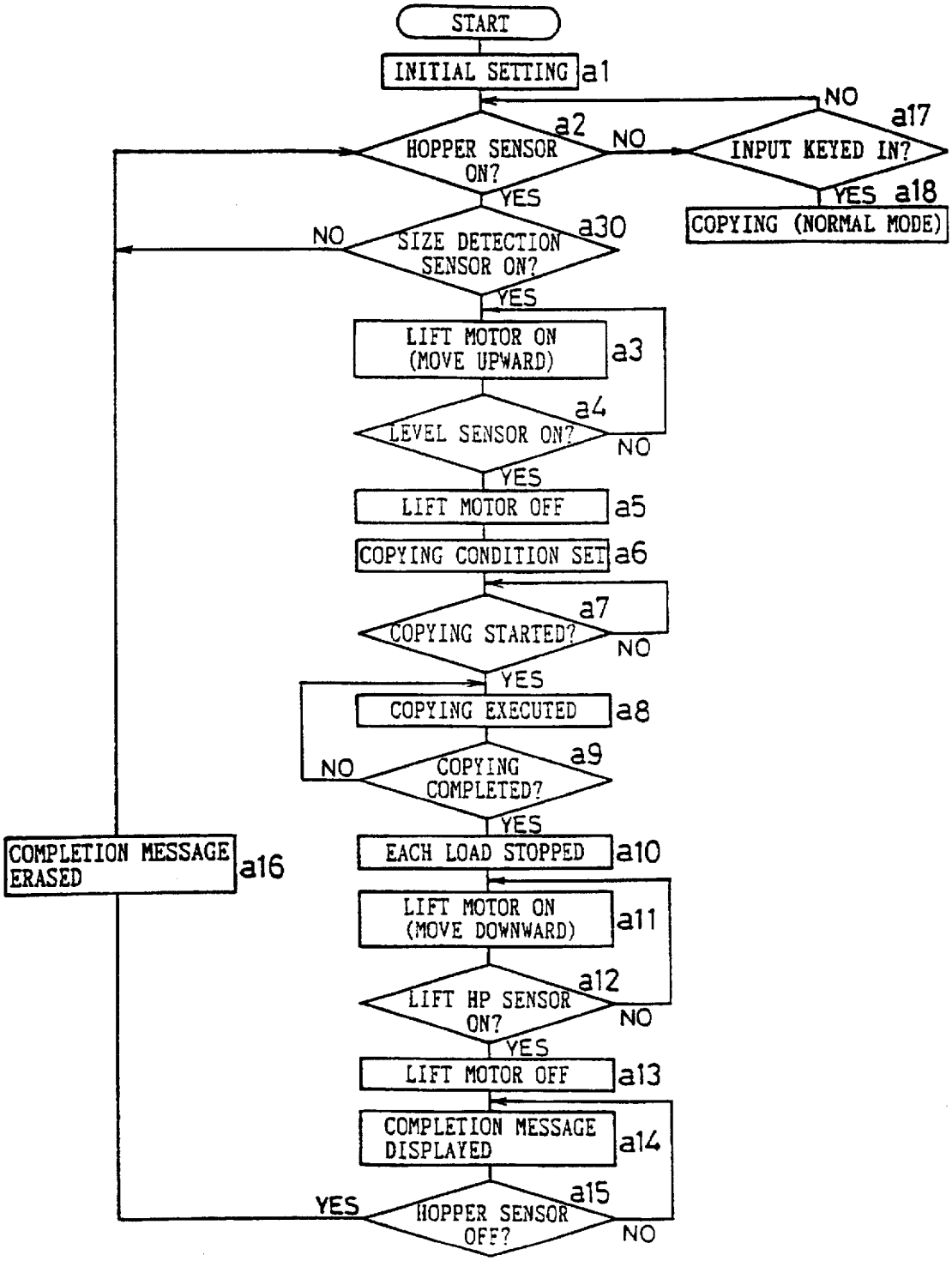
FIG. 28 is a flow chart showing an operation of the RDH according to the fifth embodiment of the invention.

FIG. 28 is a flow chart showing an operation of the RDH according to the fifth embodiment of the invention. The flow chart of FIG. 28 is similar to the flow chart of FIG. 18 described before as it is modified to additionally include Step a30. At Step a2 described above, when it is judged that the hopper sensor 5 is ON, the sequence proceeds to Step a30 and whether the original document size detection sensors 168 are ON is judged. When it is judged that the original document size detection sensors 168 are ON and the size is a reproducible size, the sequence proceeds to Step a3. When it is judged that the original document size detection sensors 168 are not ON and the size is not a reproducible size, the sequence returns to Step a2.

As described above, according to the fifth embodiment, the original document supporting plate 3 is moved upward to perform copying only when the size of the original documents 6 is detected and the detected size is a reproducible size. Hence, there is no possibility that original documents 6 of an irregular size will be transported, thereby reducing occurrence of trouble due to a paper jam or the like.

Figure 29:
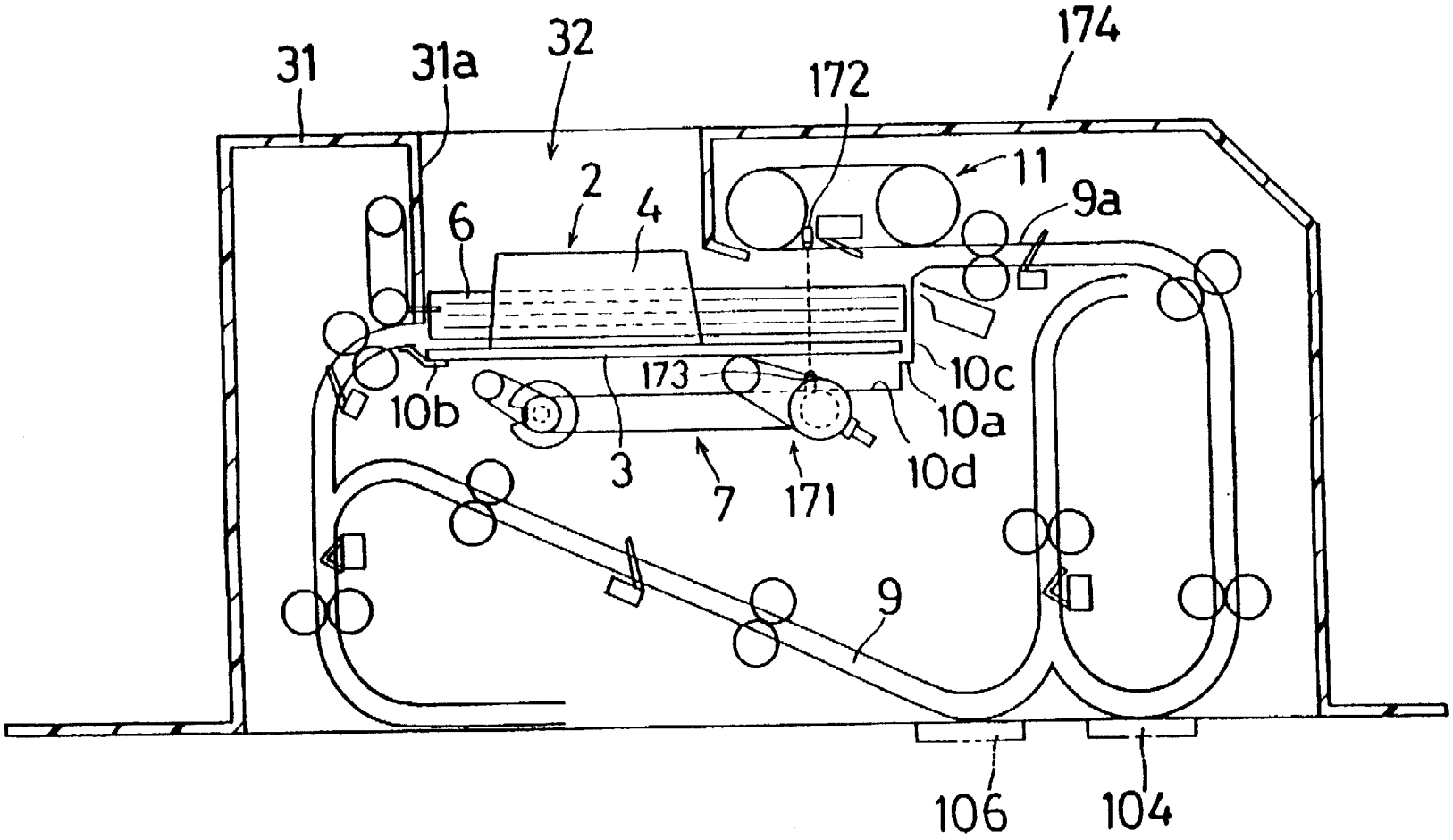
FIG. 29 is a cross-sectional view showing a structure of an RDH 174 according to a sixth embodiment of the invention.

FIG. 29 is a cross-sectional view showing a structure of an RDH 174 according to a sixth embodiment of the invention. The RDH 174 of this embodiment is characterized in comprising an original document detection sensor 171 instead of the hopper sensor 5 disposed in the RDH 1 of the first embodiment. The original document detection sensor 171 is composed of a light emitting diode 172 and a photo diode 173. The light emitting diode 172 is disposed above the original document container mechanism 2, while the photo diode 173 is disposed on a mounting part 10*d* which extends downward from the mounting part 10*a* and further extends in a horizontal direction. The light emitting diode 172 and the photo diode 173 are arranged to face each other. Further, a through hole is formed in the original document supporting plate 3 so that light from the light emitting diode 172 may impinge upon the photo diode 173.

Figure 30:
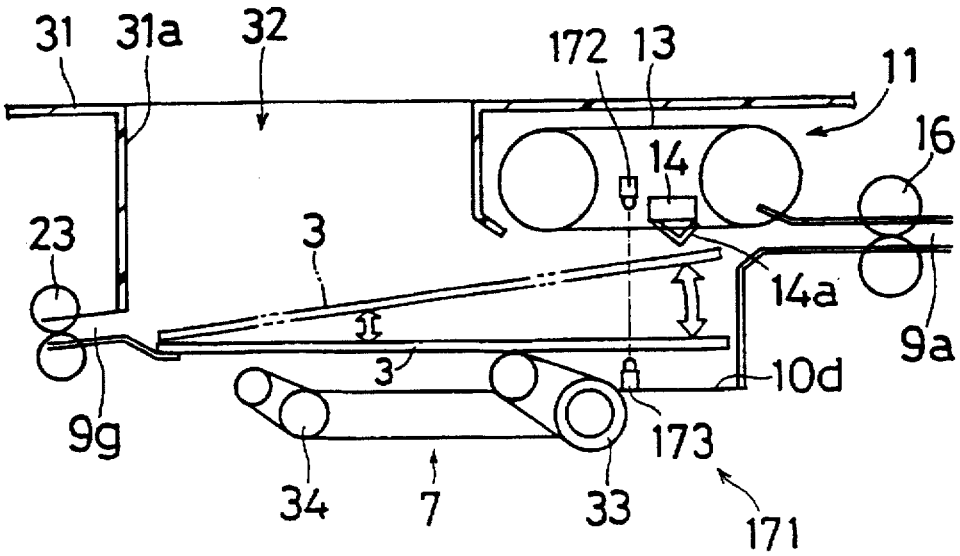
FIG. 30 is a cross-sectional view showing a state in which the original document supporting plate 3 is moved upward and downward in the RDH 174.
Figure 31:
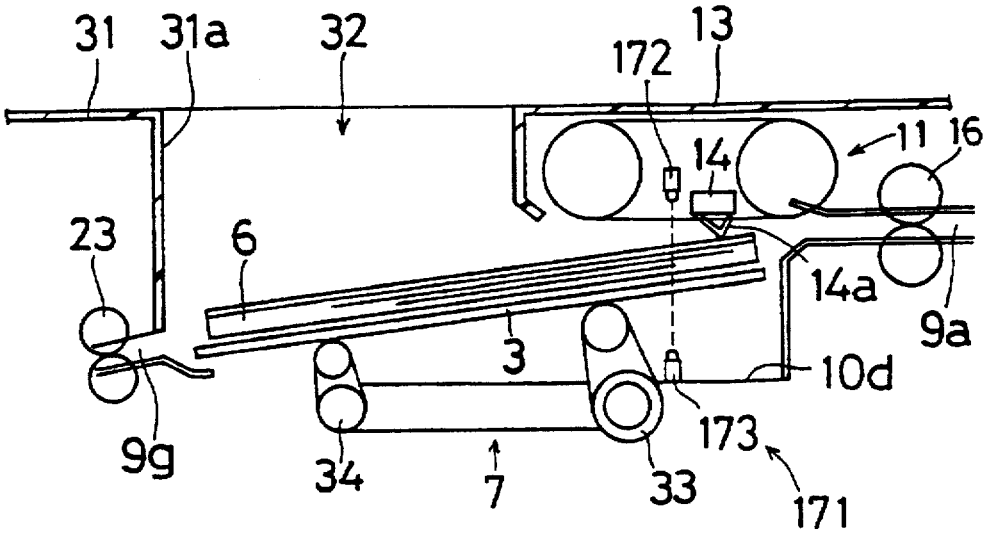
FIG. 31 is a cross-sectional view showing a state in which the original document supporting plate 3 is moved upward with the original documents 6 stacked on the original document supporting plate 3.

FIG. 30 is a cross-sectional view showing a state in which the original document supporting plate 3 is moved upward and downward in the RDH 174. FIG. 31 is a cross-sectional view showing a state in which the original document supporting plate 3 is moved upward with the original documents 6 stacked on the original document supporting plate 3. When the original documents 6 are not stacked, light from the light emitting diode 172 is received by the photo diode 173 through the through hole formed in the original document supporting plate 3. When the original documents 6 are stacked, the light is blocked, so that the light does not reach the photo diode 173.

In the RDH 1 of the first embodiment, the hopper sensor 5 is moved as the original document supporting plate 3 is moved in a vertical direction. In this case, a wire connected to the hopper sensor 5 may be broken. Otherwise, a contact failure of the wire may result. In the RDH 174 of this embodiment, since the original document detection sensor 171 for detecting whether the original documents 6 is fixed, it is possible to prevent breaking and a contact failure of the wire.

Figure 32:
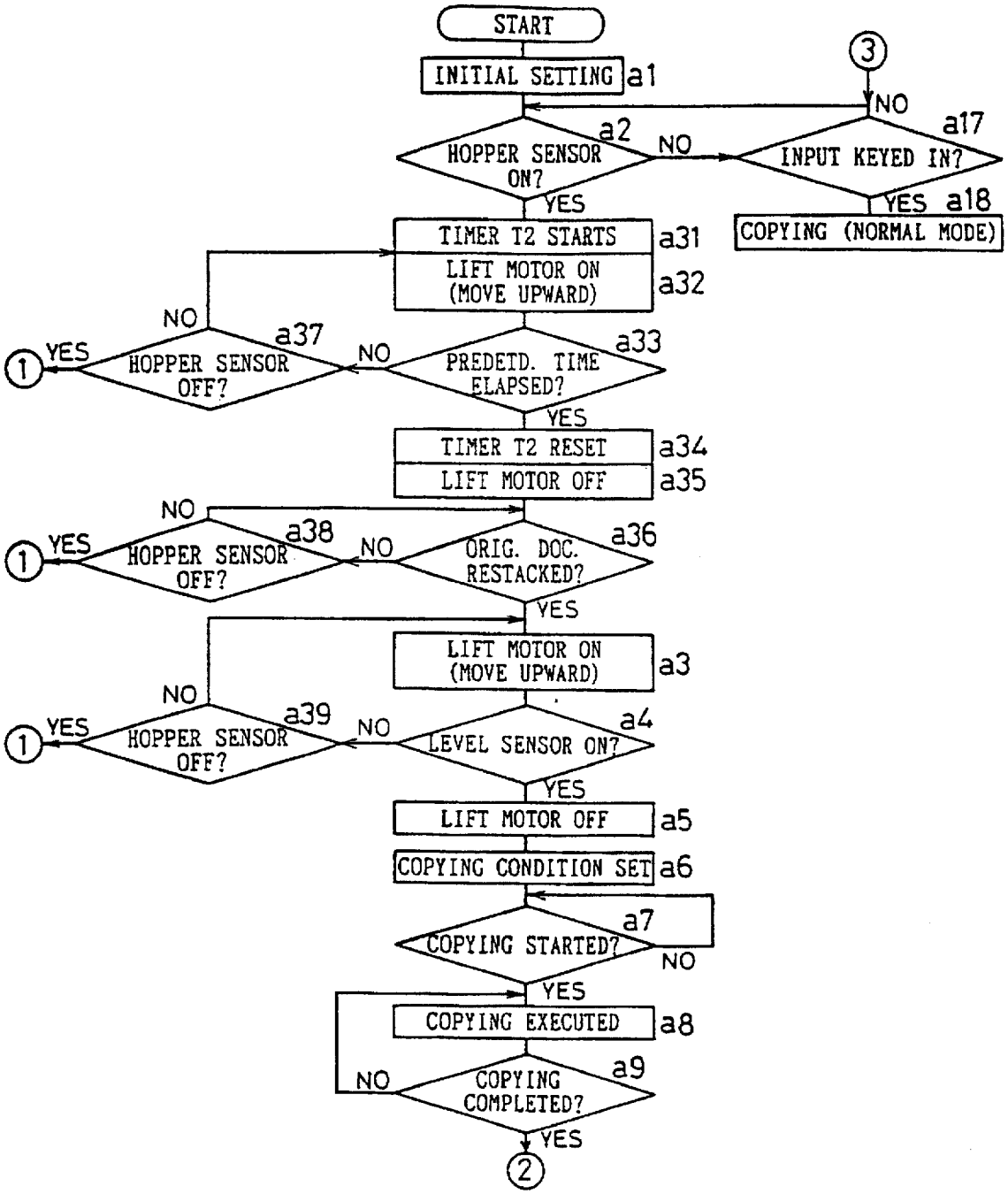
FIG. 32 is a flow chart showing an operation of an RDH according to a seventh embodiment of the invention.
Figure 33:
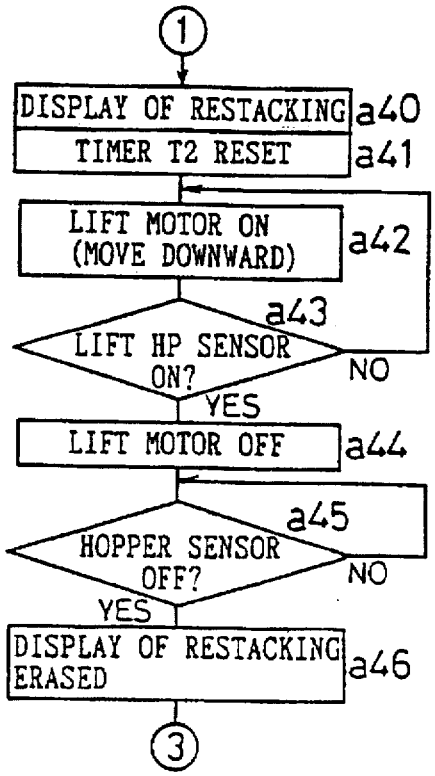
FIG. 33 is a flow chart showing the operation of the RDH according to the seventh embodiment of the invention.
Figure 34:
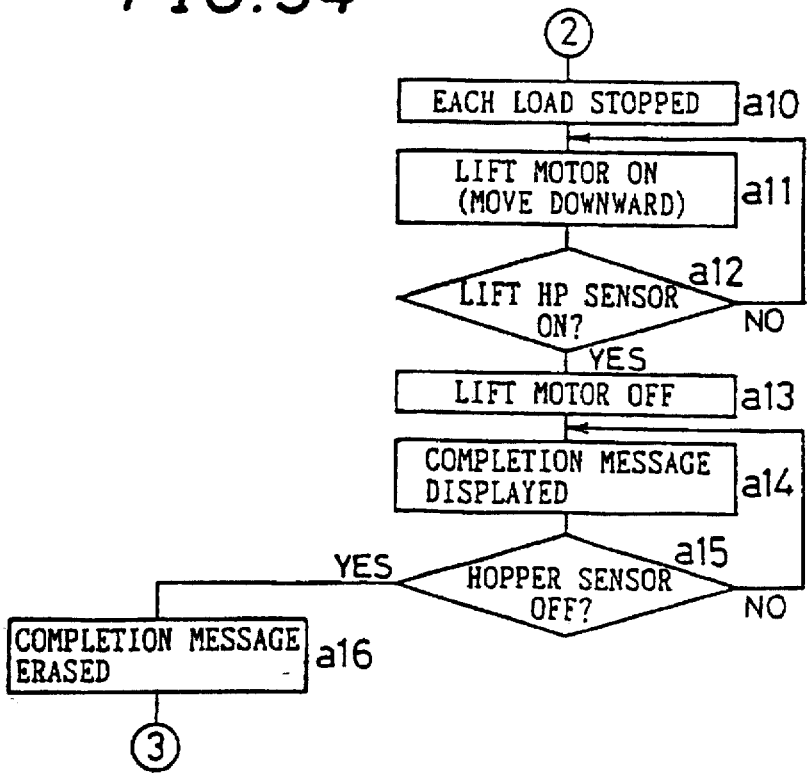
FIG. 34 is a flow chart showing the operation of the RDH according to the seventh embodiment of the invention.

FIGS. 32 to 34 are flow charts showing an operation of an RDH according to a seventh embodiment of the invention. In the RDH according to this embodiment, while the original document supporting plate 3 is moved upward from the lowest position (HP condition) to the highest position, i.e., the condition that the uppermost face of the original documents 6 stacked on the original document supporting plate 3 contacts the level sensor 14, the original document supporting plate 3 is stopped temporarily between the lowest position and the highest position, and for this purpose, a timer T2 is provided. The RDH according to the seventh embodiment has a similar structure to the RDH 1 of the first embodiment except for comprising the timer T2. A time shorter than the time which is needed for the original document supporting plate 3 to move from the lowest position to the highest position when the lift motor 54 is driven at a predetermined speed, e.g., at the travelling speed S/2 described above with reference to FIG. 6 is set in the timer T2 in advance. The flow charts of FIGS. 32 to 34 are similar to the flow chart of FIG. 18 described before as it is modified to additionally include Step a31 to Step a46.

At Step a2 described above, when it is judged that the hopper sensor 5 is ON, the sequence proceeds to Step a31 and the timer T2 starts timing. At Step a32, the lift motor 54 is driven to move the original document supporting plate 3 upward. At Step a33, whether a time measured by the timer T2 has reached a predetermined time is judged. When it is judged that the predetermined time has been reached, the sequence proceeds to Step a34. When it is judged that the time has not reached the predetermined time, the sequence proceeds to Step a37. At Step a34, the timer T2 is reset. At Step a35, the lift motor 54 is turned off to temporarily stop the original document supporting plate 3. The stop position at which the original document supporting plate 3 is temporarily stopped is a preliminary waiting position. At this stage, it is possible to perform such restacking of the original documents as a change in the number of the original documents 6 already stacked and rearrangement thereof.

At Step a36, whether stacking completion data indicating that stacking of the original documents 6 is completed have been entered is judged. These data are inputted through the operation panel or the like of the transfer-type electrostatic copying machine 101. When the stacking completion data have been entered, the sequence proceeds to Step a3, whereby the lift motor 54 is turned on to move the original document supporting plate 3 upward. When the stacking completion data have not been entered, the sequence proceeds to Step a38. Upon completion of the operation at Step a3, the sequence proceeds to Step a4 to determine whether the level sensor 14 is turned on. When it is judged that the level sensor 14 is ON, the sequence proceeds to Step a5. When it is judged that the level sensor 14 is not ON, the sequence proceeds to Step a39.

At Step a37 to Step a39, whether the hopper sensor 5 is OFF is judged. When it is judged, at each step, that the hopper sensor 5 is OFF, the sequence proceeds to Step a40. When it is judged, at Step a37, that the hopper sensor 5 is not OFF, the sequence returns to Step a32. When it is judged, at Step a38, that the hopper sensor 5 is not OFF, the sequence returns to Step a36. When it is judged, at Step a39, that the hopper sensor 5 is not OFF, the sequence returns to Step a3. A case where it is judged, at Step a37 to Step a39, that the hopper sensor 5 is OFF is a case where the stacked original documents 6 on the original document supporting plate 3 are removed before the original document supporting plate 3 is positioned at the highest position.

At Step a40, indication which indicates restacking of the original documents 6 is displayed. At Step a41, the timer T2 is reset. At Step a42, the lift motor 54 is turned on to move the original document supporting plate 3 downward. At Step a43, whether the lift HP sensor 8 is ON is judged. When it is judged the lift HP sensor 8 is ON, the sequence proceeds to Step a44. When it is judged that the lift HP sensor 8 is not ON, the sequence returns to Step a42. At Step a44, the lift motor 54 is turned off. At Step a45, whether the hopper sensor 5 is OFF is judged. When it is judged that the hopper sensor 5 is OFF, the sequence proceeds to Step a46 to erase the indication which indicates restacking of the original documents 6 displayed at Step a40, and then the sequence returns to Step a2.

As described above, according to the seventh embodiment, since the original document supporting plate 3 is stopped temporarily between the lowest position and the highest position, even if it becomes necessary to change the number of the original documents or to rearrange the original documents after the original documents 6 are stacked, it is possible to swiftly stack or remove the original documents 6, and hence to shorten a time needed for copying.

Figure 35:
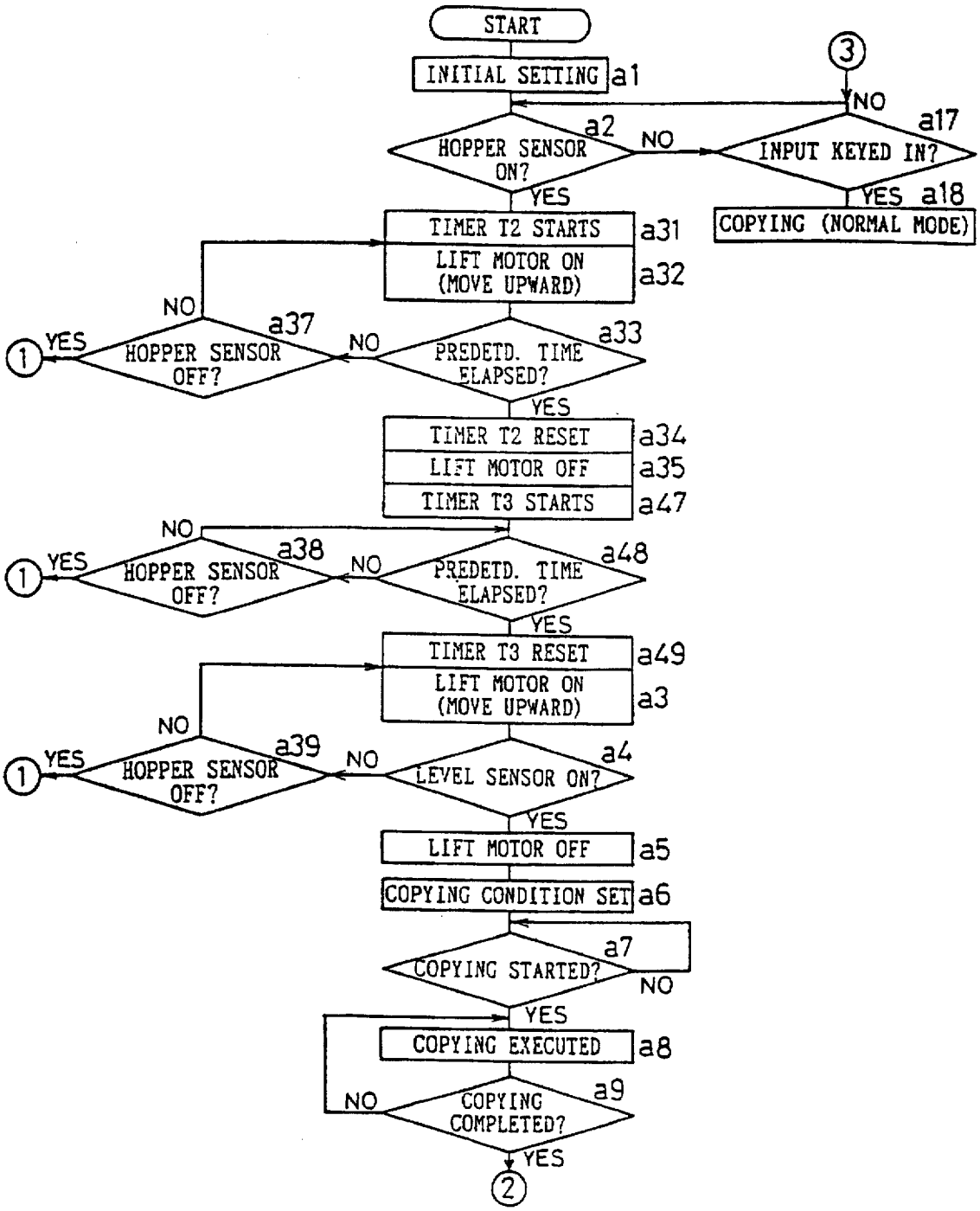
FIG. 35 is a flow chart showing an operation of an RDH according to an eighth embodiment of the invention.

FIG. 35 is a flow chart showing an operation of an RDH according to an eighth embodiment of the invention. In the RDH according to this embodiment, after the original document supporting plate 3 is stored once between the lowest position and the highest position as in the seventh embodiment described above, it is judged that restacking of the original documents 6 is completed when a predetermined time has elapsed, and the original document supporting plate 3 is then moved upward again up to the highest position. To this end, a timer T3 is provided in addition to the timer T2. Except for the timer T3, the RDH according to the eighth embodiment has a similar structure to the RDH of the seventh embodiment. The flow chart of FIG. 35 is the one modified by adding Step a47 to Step a49 to the flow chart shown in FIG. 32 instead of Step a36, in the seventh embodiment.

After the lift motor 54 is turned off at Step a35, the sequence proceeds to Step a47 and the timer T3 starts timing. At Step a48, whether a predetermined time has elapsed is judged in accordance with a time measured by the timer T3. When it is judged that the predetermined time has elapsed, the sequence proceeds to Step a49 to reset the timer T3. When it is judged that the predetermined time has not elapsed yet, the sequence proceeds to Step a38. At Step a38, similarly to as described above, whether the hopper sensor 5 is OFF is judged. When it is judged that the hopper sensor 5 is OFF, the sequence proceeds to Step a40. When it is judged that the hopper sensor 5 is not OFF, the sequence returns to Step a48. After the timer T3 is reset at Step a49, the sequence proceeds to Step a3.

As described above, according to the eighth embodiment, since the original document supporting plate 3 is moved upward automatically when the predetermined time has elapsed after the original document supporting plate 3 is stopped temporarily between the lowest position and the highest position, a user does not have to notify completion of restacking through the operation panel or the like, thereby improving convenience.

Figure 36:
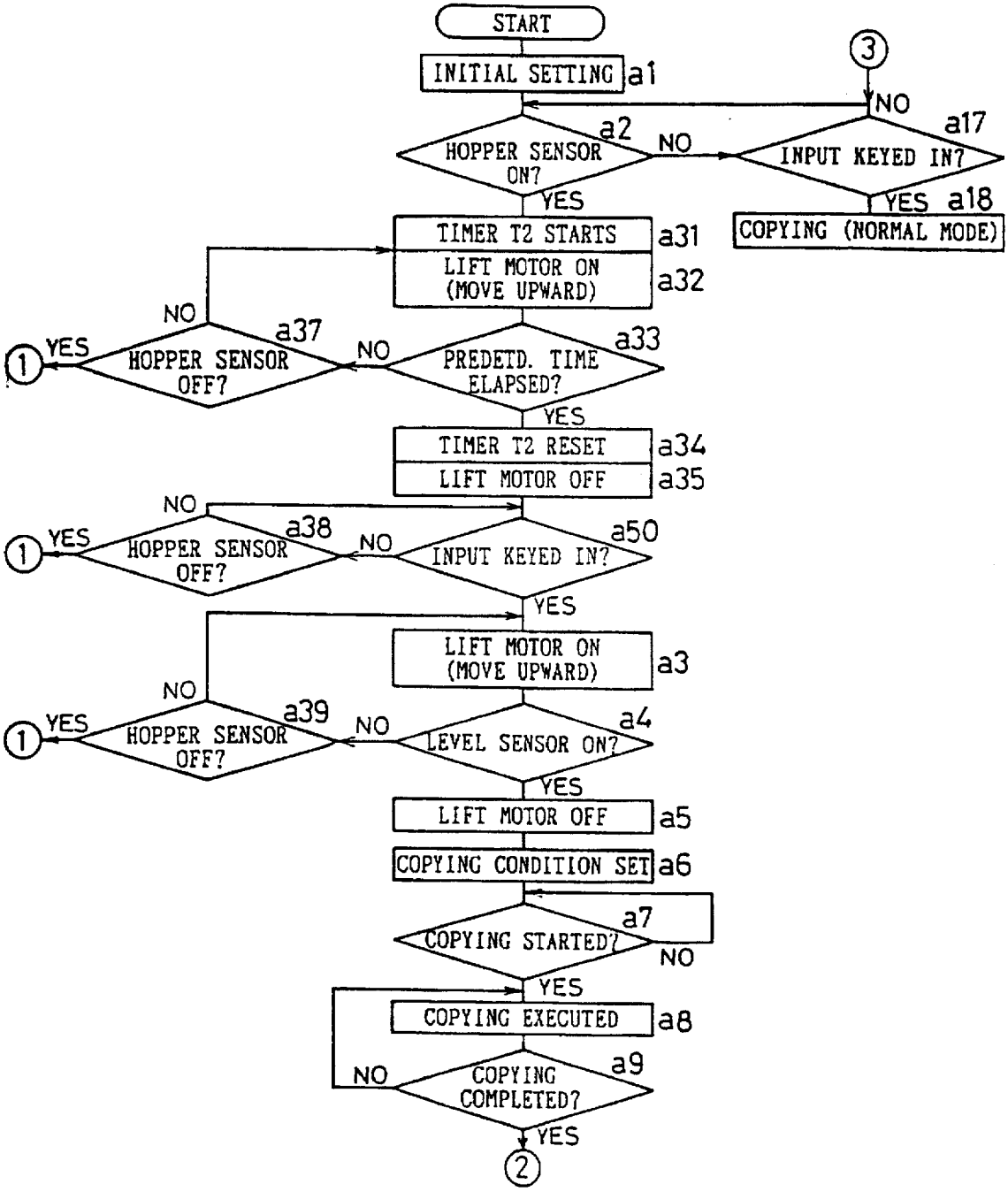
FIG. 36 is a flow chart showing an operation of an RDH according to a ninth embodiment of the invention.

FIG. 36 is a flow chart showing an operation of an RDH according to a ninth embodiment of the invention. In the RDH according to this embodiment, after the original document supporting plate 3 is stopped temporarily between the lowest position and the highest position as in the seventh embodiment described above, it is judged that restacking of the original documents 6 is completed when an input was keyed in through the operation panel or the like and the original document supporting plate 3 is then moved upward again up to the highest position. The RDH according to the ninth embodiment has a similar structure to the RDH of the seventh embodiment. The flow chart of FIG. 36 is similar to the flow charts shown in FIGS. 32 to 34 regarding the seventh embodiment as they are modified to include Step a50 instead of Step a36.

After the lift motor 54 is turned off at Step a35, the sequence proceeds to Step a50 to determine whether an input is keyed in through the operation panel or the like. For example, this is judged on the basis of an input which indicates the start of copying, from the transfer-type electrostatic copying machine 101. When it is judged that such an input is keyed in, the sequence proceeds to Step a3. When it is judged that there is no such input, the sequence proceeds to Step a38.

As described above, according to the ninth embodiment, the original document supporting plate 3 is moved upward in response to an input entered through the operation panel or the like after the original document supporting plate 3 is stopped temporarily between the lowest position and the highest position. For example, as described above, since the original document supporting plate 3 is moved upward in response to an input which indicates the start of copying, a user does not have to input a special input which indicates the end of restacking, thereby improving convenience.

Figure 37:
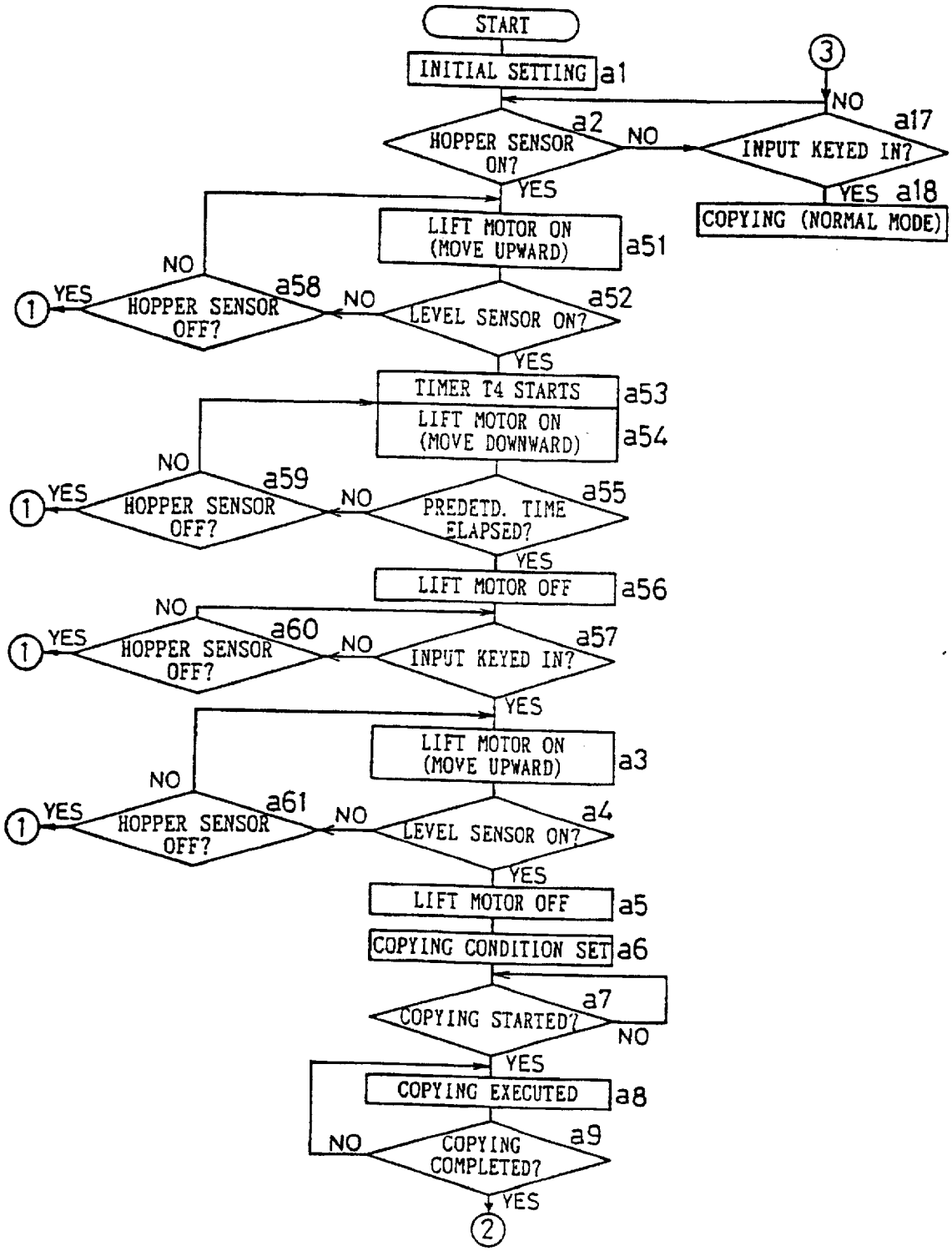
FIG. 37 is a flow chart showing an operation of an RDH according to a tenth embodiment of the invention.

FIG. 37 is a flow chart showing an operation of an RDH according to a tenth embodiment of the invention. In the RDH according to this embodiment, after the level sensor 14 is turned on in response to upward movement of the original document supporting plate 3, the original document supporting plate 3 is moved downward for a predetermined distance, and the original document supporting plate 3 is then moved upward once again in response to an input entered through the operation panel or the like. To this end, a timer T4 for moving the original document supporting plate 3 downward for the predetermined distance is provided. Except for the timer T4, the RDH according to the tenth embodiment has a similar structure to the RDH of the first embodiment. Like the timer T2, a time shorter than the time which is needed for the original document supporting plate 3 to move from the lowest position to the highest position when the lift motor 54 is driven at a predetermined speed, e.g., at the travelling speed S/2 described above with reference to FIG. 17 is set in the timer T4 in advance. The flow chart of FIG. 37 is similar to the flow chart of FIG. 18 regarding the first embodiment as it is modified to additionally include Step a40 to Step a46 shown in FIG. 33 and Step a51 to Step a61.

When it is judged, at Step a2, that the hopper sensor 5 is ON, the sequence proceeds to Step a51, whereby the lift motor 54 is turned on to move the original document supporting plate 3 upward. At Step a52, whether the level sensor 14 is ON is judged. When it is judged that the level sensor 14 is ON, the sequence proceeds to Step a53. When it is judged that the level sensor 14 is not ON, the sequence proceeds to Step a58. At Step S53, the timer T4 starts timing. At Step a54, the lift motor 54 is turned on to move the original document supporting plate 3 downward. At Step a55, whether a time measured by the timer T4 has reached a predetermined time is judged. When it is judged that the predetermined time has been reached, the sequence proceeds to Step a56. When it is judged that the predetermined time has not been reached, the sequence proceeds to Step a59. At Step a56, the lift motor 54 is turned off. At Step a57, for example, whether there is an input which indicates the start of copying is judged. When there is such an input, the sequence proceeds to Step a3. When there is no such an input, the sequence proceeds to Step a60. At Step a3, the lift motor 54 is turned on to move the original document supporting plate 3 upward. At Step a4, whether the level sensor 14 is turned on is judged. When it is judged that the level sensor 14 is ON, the sequence proceeds to Step a5. When it is judged that the level sensor 14 is not ON, the sequence proceeds to Step a61.

At Step a58 to Step a61, whether the hopper sensor 5 is OFF is judged. When it is judged, at each step, that the hopper sensor 5 is OFF, the sequence proceeds to Step a40 shown in FIG. 33. When it is judged at Step a58 that the hopper sensor 5 is not OFF, the sequence returns to Step a51. When it is judged at Step a59 that the hopper sensor 5 is not OFF, the sequence returns to Step a54. When it is judged at Step 60 that the hopper sensor 5 is not OFF, the sequence returns to Steps a57. When it is judged at Step a61 that the hopper sensor 5 is not OFF, the sequence returns to Step a3.

As described above, according to the tenth embodiment, the original document supporting plate 3 is moved upward, and then moved downward for a predetermined distance after the level sensor 14 turned on, and moved upward once again in response to an input entered through the operation panel or the like. Hence, regardless of the number of the original documents 6 stacked on the original document supporting plate 3, a distance that the original document supporting plate 3 is moved upward after restacking of the original documents is constant. Therefore, a time needed for the original documents 6 to arrive at the paper feeding position is constant, which in turn improves the reliability of the operation of feeding the original documents.

Figure 38:
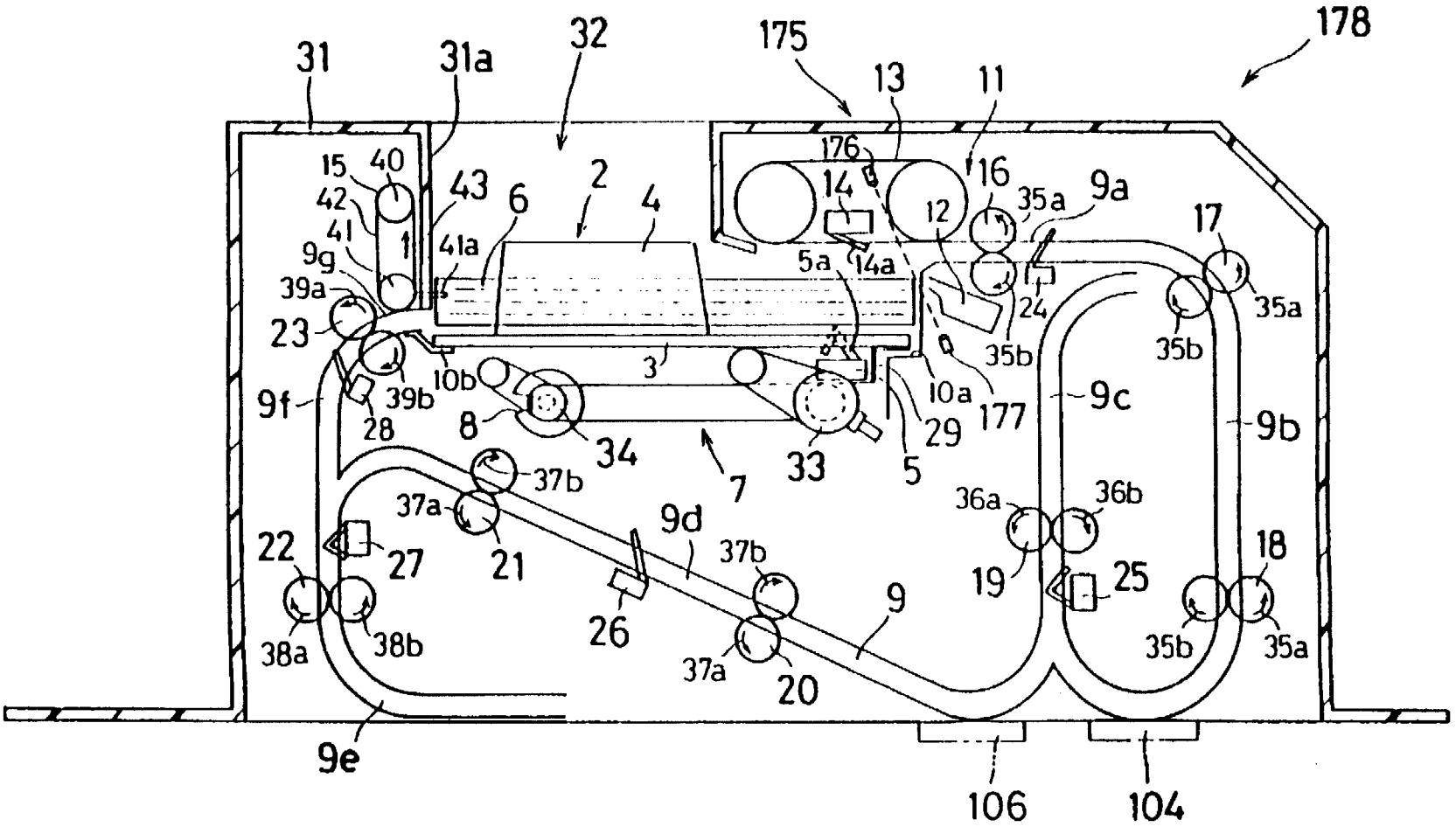
FIG. 38 is a cross-sectional view showing a structure of an RDH 178 according to an eleventh embodiment of the invention.

FIG. 38 is a cross-sectional view showing a structure of an RHD 178 according to an eleventh embodiment of the invention. The RDH 178 according to this embodiment is similar to the RDH 1 of the first embodiment as it is modified to include an original document height sensor 175. The original document height sensor 175 is composed of a light emitting diode 176 and a photo diode 177. The light emitting diode 176 is disposed above the original document container mechanism 2, while the photo diode 177 is disposed below the entrance side end 9*a* of the transportation path 9. The light emitting diode 176 and the photo diode 177 are arranged to face each other, and light from the light emitting diode 176 is received by the photo diode 177. A stop position where the original document supporting plate 3 is temporarily stopped by turning on of the level sensor 14 in response to upward movement of the original document supporting plate 3 is set in the RDH 178. The light emitting diode 176 and the photo diode 177 are disposed in such a manner that the original document height sensor 175 is turned on at the stop position, that is, light from the light emitting diode 176 is blocked by the original documents 6 which have been moved upward.

Figure 39:
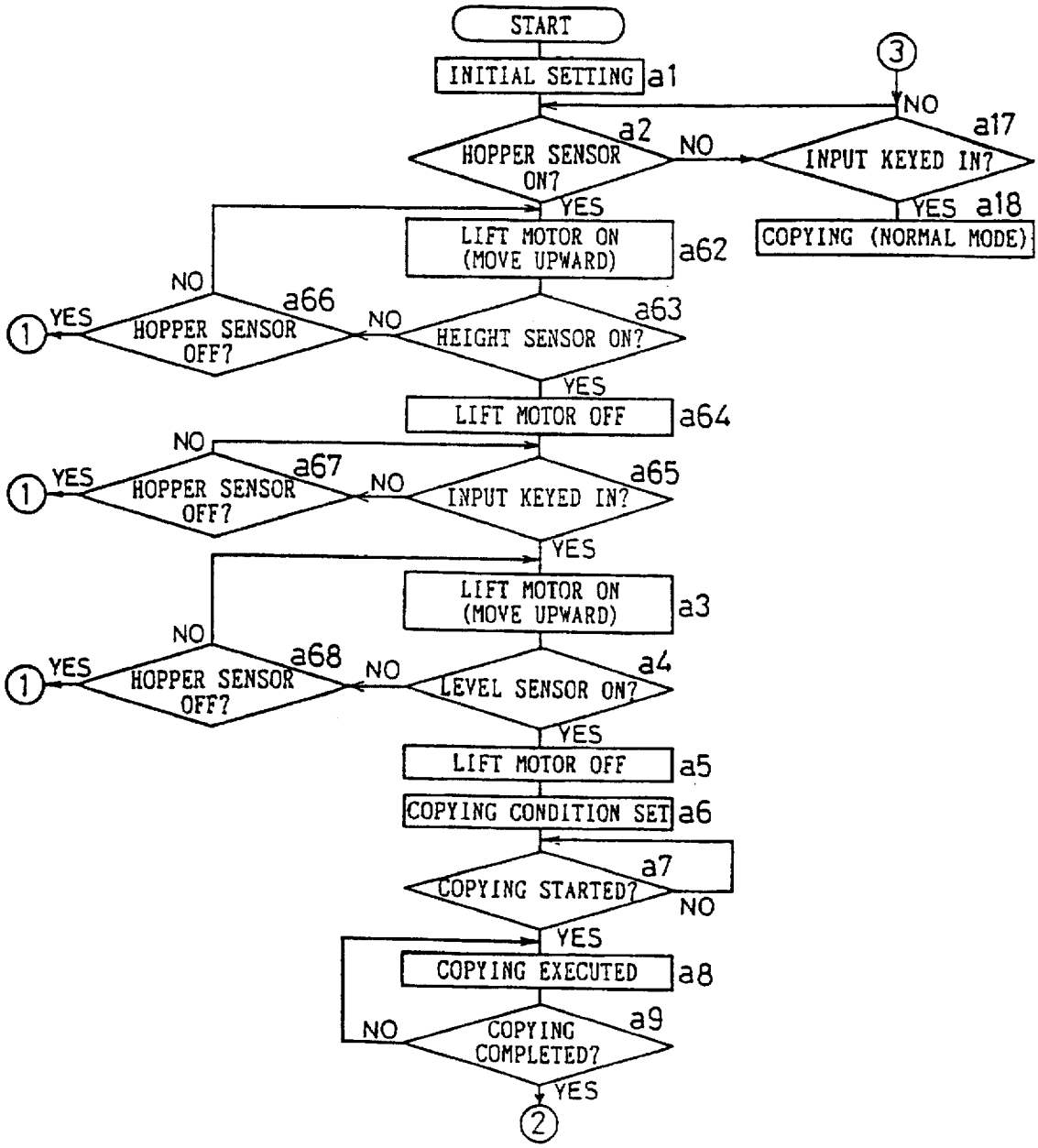
FIG. 39 is a flow chart showing an operation of the RDH 178.

FIG. 39 is a flow chart showing an operation of the RDH 178. The flow chart of FIG. 39 is similar to the flow chart of FIG. 18 regarding the first embodiment as it is modified to additionally include Step a40 to a46 shown in FIG. 33 and Step a62 to Step a68. When it is judged, at Step a2, that the hopper sensor 5 is ON, the sequence proceeds to Step a62, whereby the lift motor 54 is turned on to move the original document supporting plate 3 upward. At Step a63, whether the original document height sensor 175 is turned on is judged. When the original document height sensor 175 is ON, the sequence proceeds to Step a64. When the original document height sensor 175 is not ON, the sequence proceeds to Step a66. At Step a64, the lift motor 54 is turned off. At Step a65, whether an input which indicates the start of copying is keyed in through the operation panel or the like of the transfer-type electrostatic copying machine 101 is judged. When there is such an input, the sequence proceeds to Step a3. When there is no such input, the sequence proceeds to Step a67. After the lift motor 54 is turned on and the original document supporting plate 3 is moved upward at Step a3, the sequence proceeds to Step a4 to determine whether the level sensor 14 is ON. When the level sensor 14 is ON, the sequence proceeds to Step a5. When the level sensor 14 is not ON, the sequence proceeds to Step a68.

At Step a66 to Step a68, whether the hopper sensor 5 is OFF is judged. When it is judged that the hopper sensor 5 is OFF at each step, the sequence proceeds to Step a40 shown in FIG. 33. When it is judged, at Step a66, that the hopper sensor 5 is not OFF, the sequence returns to Step a62. When it is judged at Step a67 that the hopper sensor 5 is not OFF, the sequence returns to Step a65. When it is judged, at Step a58, that the hopper sensor 5 is not OFF, the sequence returns to Step a3.

As described above, according to the eleventh embodiment, upward movement of the original document supporting plate 3 is temporarily stopped when the original document height sensor 175 is turned on, and the original document supporting plate 3 is moved upward again in response to an input entered through the operation panel or the like. Hence, regardless of the number of the original documents 6, the uppermost face of the original documents 6 stacked on the original document supporting plate 3 is always moved up to a constant position. Therefore, as in the tenth embodiment described above, a distance that the original document supporting plate 3 is moved upward after restacking of the original documents is constant regardless of the number of the original documents 6 stacked on the original document supporting plate 3, so that a time needed for the original documents 6 to arrive at the paper feeding position is constant, which in turn improves the reliability of the operation of feeding the original documents. Unlike in the tenth embodiment, complex operation of turning on the level sensor 14 and then moving the original document supporting plate 3 downward for the constant distance is not necessary, thereby making the control easy. In addition, the lifetime of the lift motor 54 is extended.

Figure 40:
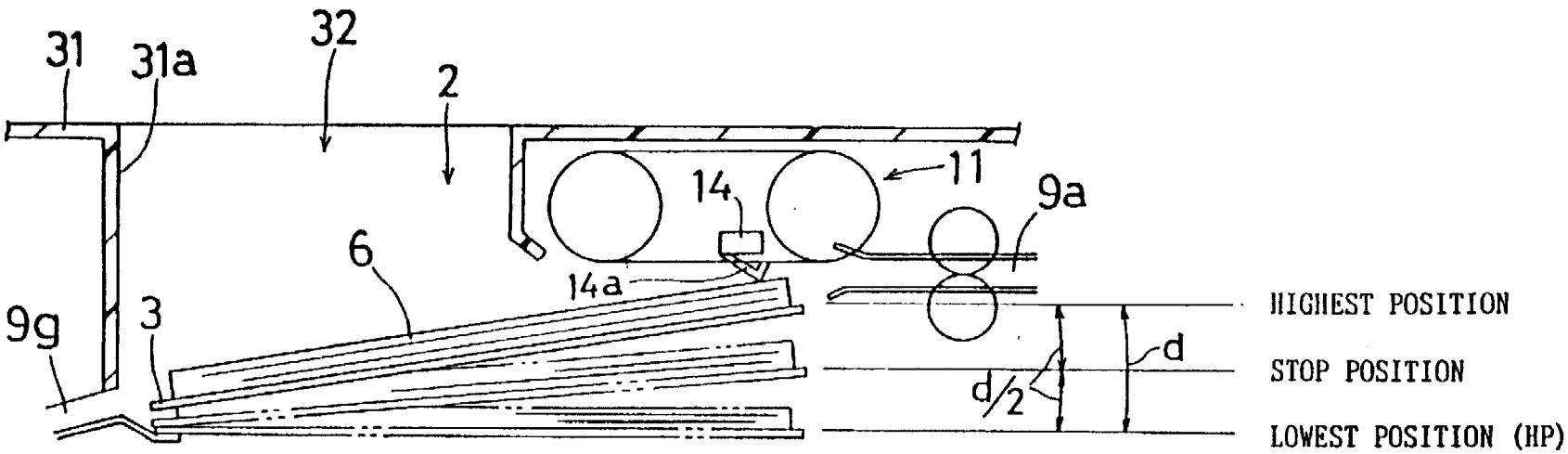
FIG. 40 is a cross-sectional view for describing an operation of an RDH according to a twelfth embodiment of the invention.

FIG. 40 is a cross-sectional view for describing an operation of an RDH according to a twelfth embodiment of the invention. In the RDH according to this embodiment, the stop position where the original document supporting plate 3 is temporarily stopped during upward movement of the original document supporting plate 3 is set at an intermediate position between the lowest position and the highest position. Assuming that a distance between the lowest position and the highest position is d as shown in FIG. 40, the stop position is set approximately at d/2. To this end, a timer T5 is provided. The timer T5 measures a time which is needed for the original document supporting plate 3 to move the distance d/2. Except for the timer T5, the RHD according to the twelfth embodiment has a similar structure to the RDH of the first embodiment.

Figure 41:
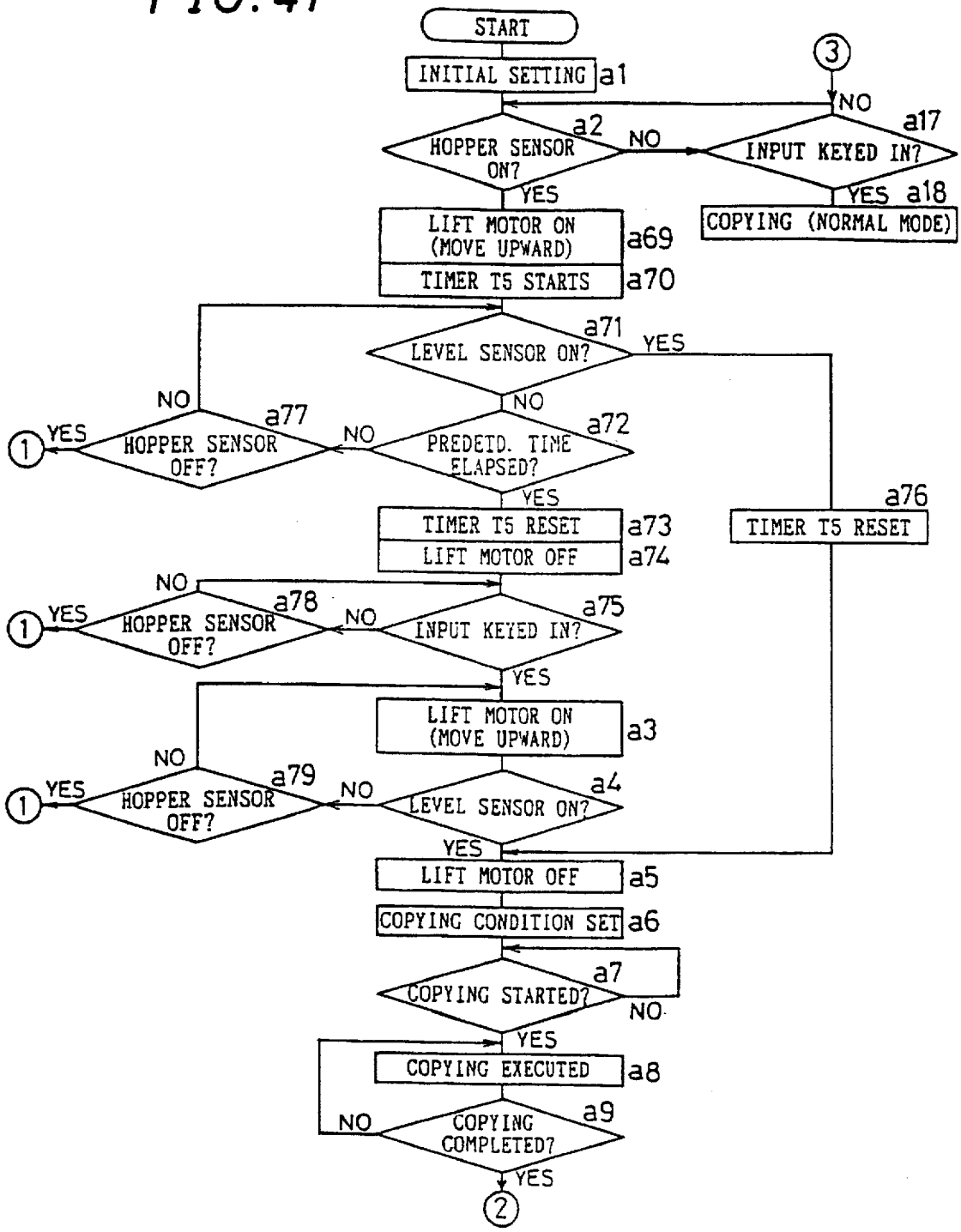
FIG. 41 is a flow chart showing the operation of the RDH according to the twelfth embodiment.

FIG. 41 is a flow chart showing the operation of the RDH according to the twelfth embodiment. The flow chart of FIG. 41 is similar to the flow chart of FIG. 18 regarding the first embodiment as it is modified to additionally include Step a40 to a46 shown in FIG. 33 and Step a69 to a79. When it is judged, at Step a2, that the hopper sensor 5 is ON, the sequence proceeds to Step a69, whereby the lift motor 54 is turned on to move the original document supporting plate 3 upward. At Step a70, the timer T5 starts timing. At Step a71, whether the level sensor 14 is turned on is judged. When the level sensor 14 is ON, the sequence proceeds to Step a76. The timer T5 is reset at Step a76, and the sequence proceeds to Step a5.

When it is judged, at Step a71, that the level sensor 14 is not ON, the sequence proceeds to Step a72 to determine whether a time measured by the timer T5 has reached a predetermined time. When the predetermined time has elapsed, the sequence proceeds to Step a73. When the predetermined time has not elapsed yet, the sequence proceeds to Step a77. The timer T5 is reset at Step a73, and the lift motor 54 is turned off at Step a74. At Step a75, whether an input which indicates the start of copying is keyed in through the operation panel or the like of the transfer-type electrostatic copying machine 101 is judged. When there is such an input, the sequence proceeds to Step a3. When there is no such an input, the sequence proceeds to Step a78. After the lift motor 54 is turned on and the original document supporting plate 3 is moved upward at Step a3, the sequence proceeds to Step a4 to determine whether the level sensor 14 is ON. When the level sensor 14 is ON, the sequence proceeds to Step a5. When the level sensor 14 is not ON, the sequence proceeds to Step a79.

At Step a77 to Step A79, whether the hopper sensor 5 is OFF is judged. When it is judged that the hopper sensor 5 is OFF at each step, the sequence proceeds to Step a40 shown in FIG. 33. When it is judged, at Step a77, that the hopper sensor 5 is not OFF, the sequence returns to Step a71. When it is judged, at Step a78, that the hopper sensor 5 is not OFF, the sequence returns to Step a75. When it is judged, at Step a79, that the hopper sensor 5 is not OFF, the sequence returns to Step a3.

As described above, according to the twelfth embodiment, the upward movement of the original document supporting plate 3 is simpler than in the seventh to the eleventh preferred embodiments. Further, when the number of the original documents stacked on the original document supporting plate 3 is large, there is a possibility that the level sensor 14 will be turned on before the original document supporting plate 3 is temporarily stopped. Such a case is detectable at Step a71. When such a case is detected, the timer T5 is reset at Step a75, to thereby turn off the lift motor 54.

Figure 42A:
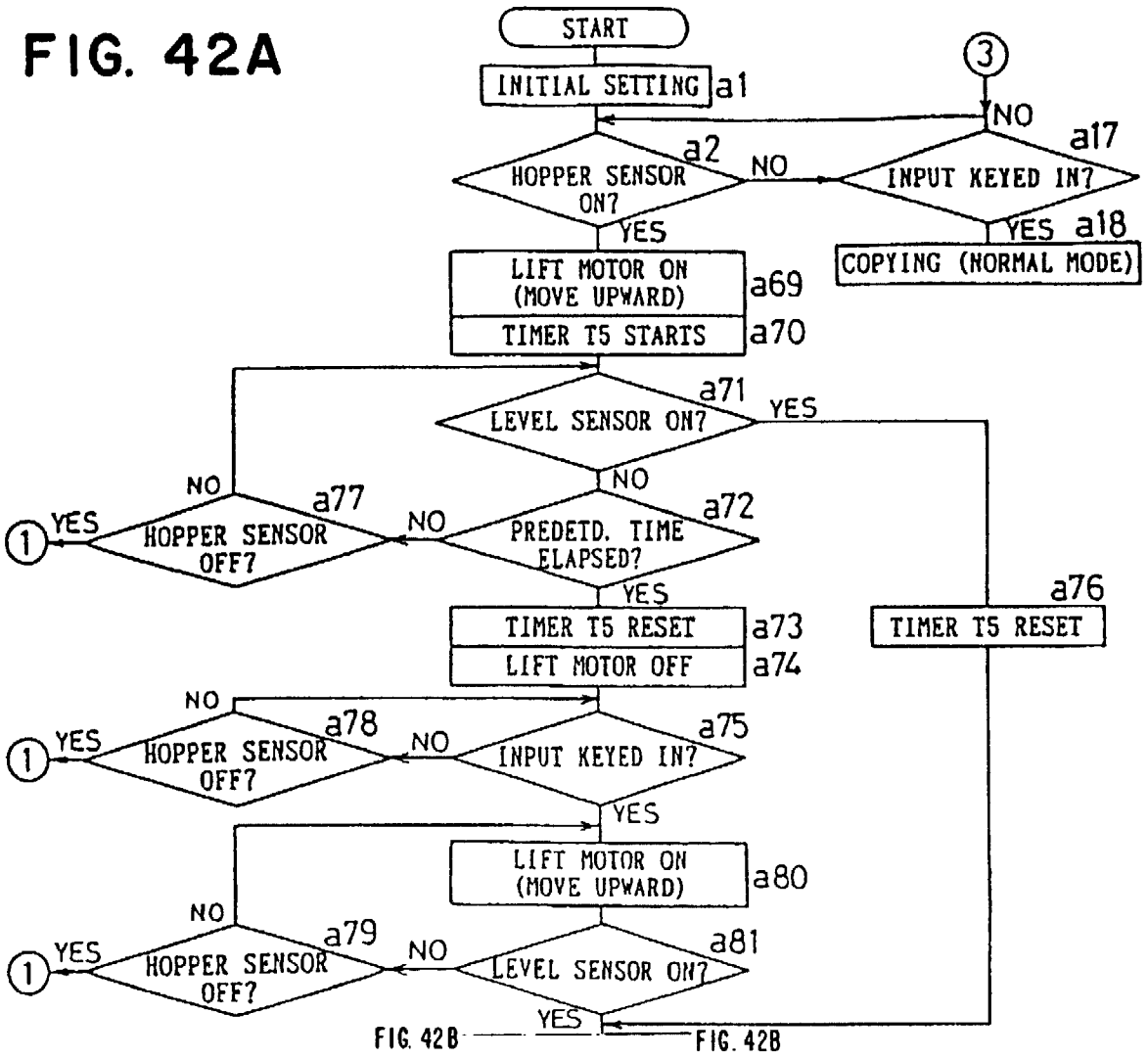
FIGS. 42A and 42B are a flow chart showing an operation of an RDH according to a thirteenth embodiment of the invention.
Figure 42B:
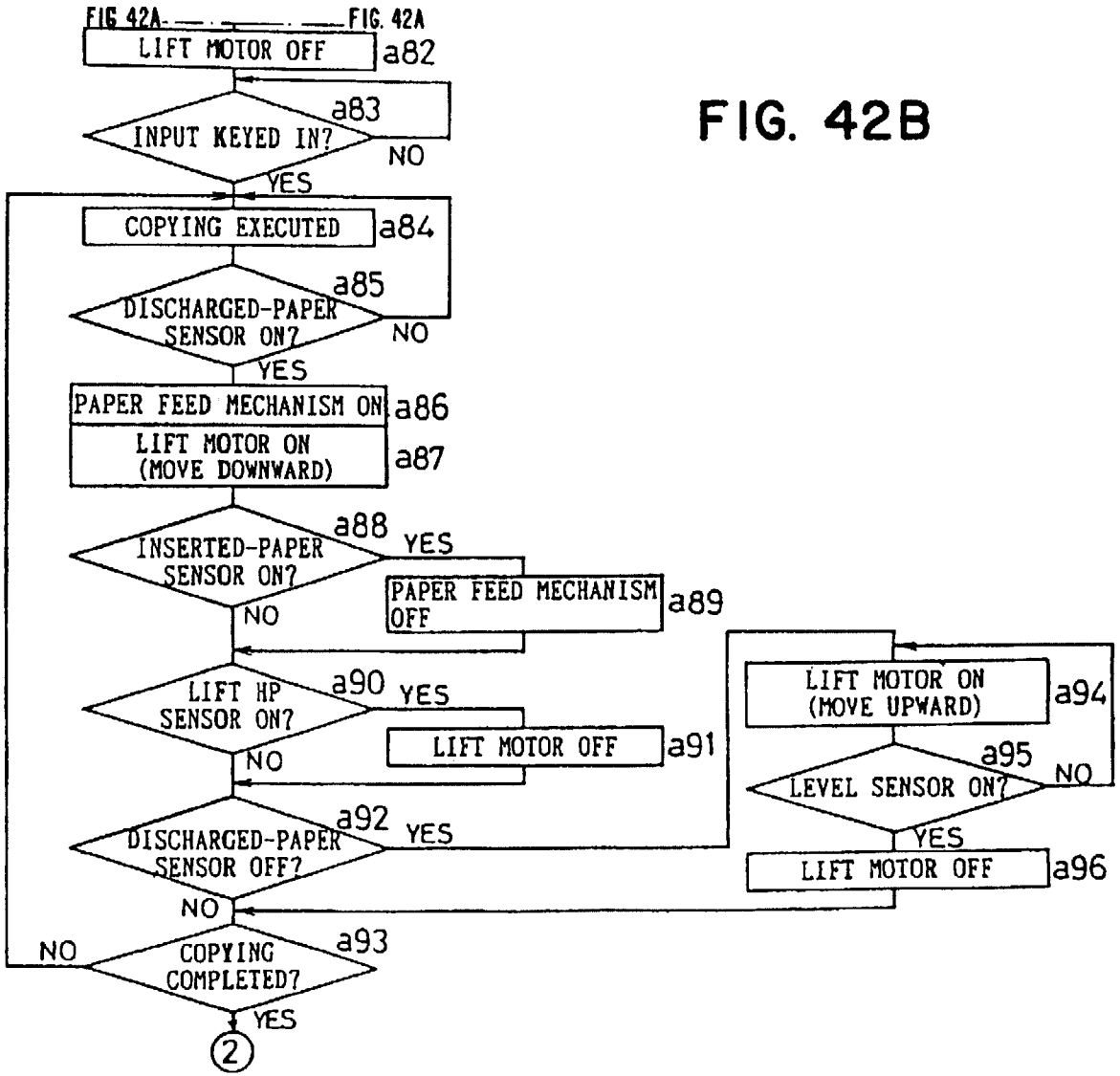

FIGS. 42A and 42B are a flow chart showing an operation of an RDH according to a thirteenth embodiment of the invention. This embodiment is characterized in that the original document supporting plate 3 is moved downward at a high speed, when the returned original document to be stored into the original document container mechanism 2 after passing through the transportation path 9 and going through a predetermined copying operation is stacked onto the original document supporting plate 3. The travelling speed at which the original document supporting plate 3 is moved downward at a high speed is set at the travelling speed S described with reference to FIG. 7, for instance. The RDH of the thirteenth embodiment has a similar structure to the RDH of the twelfth embodiment. The flow chart of FIGS. 42A and 42B is similar to the flow chart of FIG. 41 regarding the twelfth embodiment as it is modified to additionally include Step a80 to Step a96.

At Step a75, whether there is an input which indicates copying conditions such as the number of copies is judged. When there is such an input, the sequence proceeds to Step a80. When there is no such input, the sequence proceeds to Step a78. At Step a80, the lift motor 54 is turned on to move the original document supporting plate 3 upward. At Step a81, whether the level sensor 14 is turned on is judged. When the level sensor 14 is ON, the sequence proceeds to Step a82. When the level sensor 14 is not ON, the sequence proceeds to Step a79. Even after the timer T5 is reset at Step a76, the sequence proceeds to Step a82, and the lift motor 54 is turned off at Step a82. At Step a83, whether an input which designates copying conditions such as the number of copies is completed and an input which indicates the start of copying is inputted is judged. When there is such an input, the sequence proceeds to Step a84 to perform copying.

Whether the document discharge sensor 28 is turned on is judged at Step a85. When the document discharge sensor 28 is ON, the sequence proceeds to Step a86. When the document discharge sensor 28 is not ON, the sequence returns to Step a84. At Step a86, the paper feeding mechanism 11 is turned on in order to supply the next original document. At Step a87, the lift motor 54 is turned on so that the original document supporting plate 3 is moved downward at a high speed. A returned original document which turned on the document discharge sensor 28 is inserted into a space which is created between the original document supporting plate 3 and the original documents 6 stacked on the original document supporting plate 3 when the original document supporting plate 3 is moved downward at a high speed.

Whether the inserted paper sensor 24 is turned on is judged at Step a88. When the inserted paper sensor 24 is ON, the sequence proceeds to Step a89 to thereby turn off the operation of the paper feeding mechanism 11, and the sequence proceeds to Step a90. When it is judged, at Step a88, that the inserted paper sensor 24 is not ON, the sequence proceeds to Step a90 to determine whether the lift HP sensor 8 is ON. When the lift HP sensor 8 is ON, the sequence proceeds to Step a91 to turn off the lift motor 54, and the sequence then proceeds to Step a92.

When it is judged, at Step a90, that the lift HP sensor 8 is not ON, the sequence proceeds to Step a92 to determine whether the document discharge sensor 28 is OFF. When it is judged that the document discharge sensor 28 is OFF, i.e., when it is judged that the returned original document is stored onto the original document supporting plate 3, the sequence proceeds to Step a94 to turn on the lift motor 54 and move the original document supporting plate 3 upward. When it is judged that the document discharge sensor 28 is not OFF, the sequence proceeds to Step a93. At Step a95, whether the level sensor 14 is ON is judged. When the level sensor 14 is ON, the sequence proceeds to Step a96. When the level sensor 14 is not ON, the sequence returns to Step a94. At Step a96, the lift motor 54 is turned off. Upon completion of the operation at Step a96, the sequence proceeds to Step a93 to determine whether copying is completed. When copying is completed, the sequence proceeds to aforementioned Step a10 of FIG. 34. When copying is not completed, the sequence returns to Step a84.

As described above, according to the thirteenth embodiment, it is not necessary to use means for lifting up stacked original documents 6, for the purpose of storing the returned original document between the original document stacking surface of the original document supporting plate 3 and the lowermost one of original documents 6 stacked on the original document supporting plate 3. By moving the original document supporting plate 3 downward at a high speed, the returned original document is stored while the resistance of the stacked original documents 6 against the original document supporting plate 3 is reduced so that it is easy to store the returned original documents.

An effect of reducing the resistance will be described regarding a case where original documents 6 of the A4 size (297 mm×210 mm) are stored so that the shorter sides orthogonal to the longer sides of the original documents 6 may be parallel to the transportation direction and transported at a speed of, for example, 1,500 mm/sec.

Suppose the distance from the end of the original document supporting plate 3 at the entrance side of the transportation path to the end of the original document supporting plate 3 at the exit side of the transportation path to be 210 mm. A time t1 which is needed for one of the stacked original documents 6 to be completely removed from the original document supporting plate 3 is t1=210/1,500=0.14 sec. In general, a dropping distance Y for an object to freely drop is expressed by the formula (1) below:

$$Y=V1\cdot t+(g\cdot t^2)/2 \quad (1)$$

The symbol V1 expresses an initial speed, the symbol g expresses an acceleration (9.8 m/sec$^2$), and the symbol t expresses a time which is needed for drop over the distance Y. Hence, a distance Y1 that the original document supporting plate 3 must be moved in order to set the resistance at zero during the time t1=0.14 sec is, since $$V1=0,\ Y1=\{g\cdot(T1)^2\}/2=(9{,}800\times0.14^2)/2\approx96\text{ mm}$$

From the above, it is understood that the original document supporting plate 3 must be dropped (moved downward) 96 mm or more in order to create a space between stored original documents 6 and the original document supporting plate 3 while ignoring factors such as air resistance and theoretically reducing the resistance to zero and in order to insert the original documents of the A4 size into the space during a period of 0.14 sec. In reality, since the dropping speed is reduced due to factors such as the air resistance, even through the distance that the original document supporting plate 3 is moved downward is 96 mm or less, it is thought that the resistance becomes zero (critical point) and the space is created. Under the condition above, it is understood that the travelling distance of the original document supporting plate 3 is preferably set at 100 mm.

Thus, when the time t1 is set at 0.14 sec and the travelling distance of the original document supporting plate 3 is set at 100 mm, the maximum travelling speed S of the original document supporting plate 3 becomes S=100/0.14≈715 mm/sec. The travelling speed S/2 during normal upward/downward movement is S/2=715/2=357.5 mm/sec.

On the other hand, when the travelling distance of the original document supporting plate 3 is set at 50 mm, t≈0.1 sec since 50=(9,800×t$^2$)/2. Hence, a transportation speed V is V=2,100 mm/sec since 0.1=210/V. For example, for transportation using a transportation roller having a diameter of 30 mm, the circumference of the transportation roller is 30π=94.25 mm. The number of revolutions of the transportation roller necessary to transport at a speed of V=2,100 mm/sec is 2,100/30π=22.28≈23 revolutions/sec. The number of revolutions per minute is 23×60=1,380 rpm. From the above, under the condition above, it is necessary to drive using a motor whose speed is 1,380 rpm.

In the present embodiment, the cam members 33 and 34 are used, and the original document supporting plate 3 is moved upward and downward by rotating the cam members 33 and 34 for ¼ of a revolution. That is, since ¼ of a revolution per 0.1 sec, 0.4 sec is necessary for one revolution. Hence, the number of revolutions of the lift motor 54 is R=60/0.4=150 rpm.

Although the travelling distance of the original document supporting plate 3 may be 50 mm at the exit side, in reality, considering the air resistance, an air flow and a condition of transported original documents 6, it is preferable that the travelling distance is longer than 50 mm at the entrance side. This makes it possible to stably store the returned original document. For instance, the travelling distance at the entrance side is preferably 5 mm longer than at the exit side.

Figure 43:
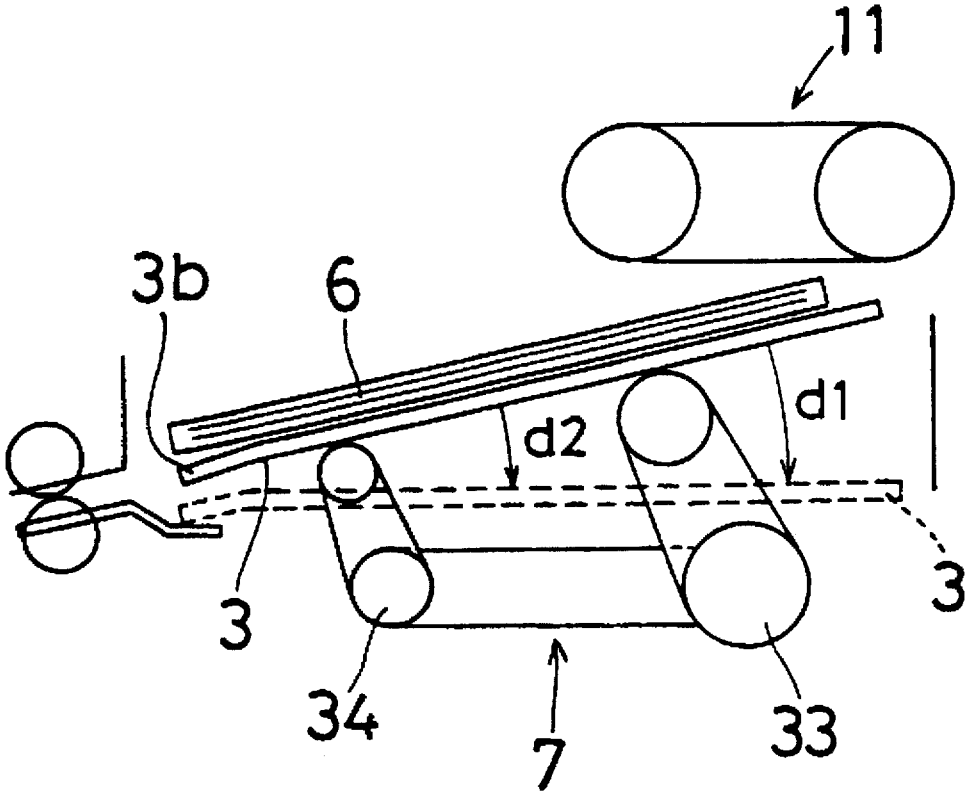
FIG. 43 is a side view showing a movement distance when the original document supporting plate 3 is moved downward.
Figures 44A, 44B:
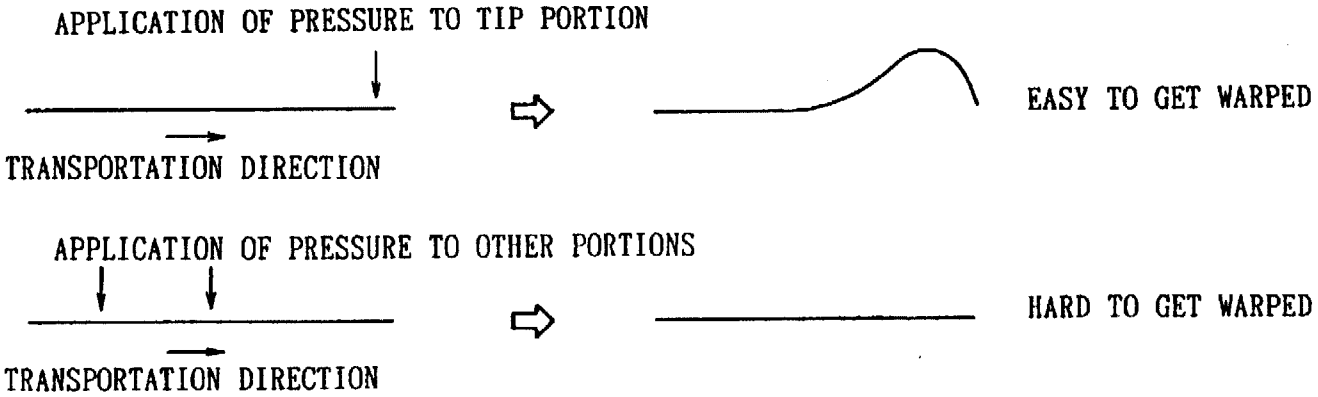
FIGS. 44A and 44B are schematic diagrams each for describing influence of reduced effect of generated resistance upon a returned original document.

FIG. 43 is a side view showing the traveling distance when the original document supporting plate 3 is moved downward. FIGS. 44A and 44B are schematic diagrams each for describing an influence of an effect of a reduced resistance upon a returned original document. As described above, the cam members 33 and 34 differ in size. Since the cam member 33 disposed at the entrance side is larger than the cam member 34 disposed at the exit side, the traveling distance of the original document supporting plate 3 becomes longer in a direction from the cam member 34 toward the cam member 33 when the original document supporting plate 3 is moved downward. For instance, assuming that the traveling distance on the cam member 33 side is d1 and the traveling distance on the cam member 34 side is d2, a time of reducing the resistance of the stacked original documents 6 against the original document supporting plate 3 is a longer on the distance d1 side. In short, the space which is created between the original document supporting plate 3 and the original documents 6 stacked on the original document supporting plate 3 has been present for a longer time at the distance d1 side. Since the returned original document is moved from the distance d2 side toward the distance d2 side, the tip portion of the original document is under the influence of the reduced resistance for a longer time than the other portions of the returned original document.

As shown in FIG. 43, by slanting an end portion **3*b* of the original document supporting plate 3 downward, the end portion 3*b* being positioned at the exit side of the transportation path, it is possible to create a space between the original document supporting plate 3 and the original documents 6 stacked on the original document supporting plate 3 at a portion which is opposite to the exit of the transportation path. By creating such a space, it is possible to steadily insert the original document discharged from the transportation path 9 between the original document supporting plate 3 and the lowermost one of the original documents 6 stacked on the original document supporting plate 3**.

The original documents 6 are easily warped when pressure is applied to the tip portion of the original document which is not yet completely stored, as shown in FIG. 44A. In the present embodiment, as shown in FIG. 44B, since pressure is applied to the original document 6 successively from the upstream side of the transportation direction of the original documents 6 the original documents are not wiped easily. Hence, it is possible to steadily and easily store the original documents.

Figure 45:
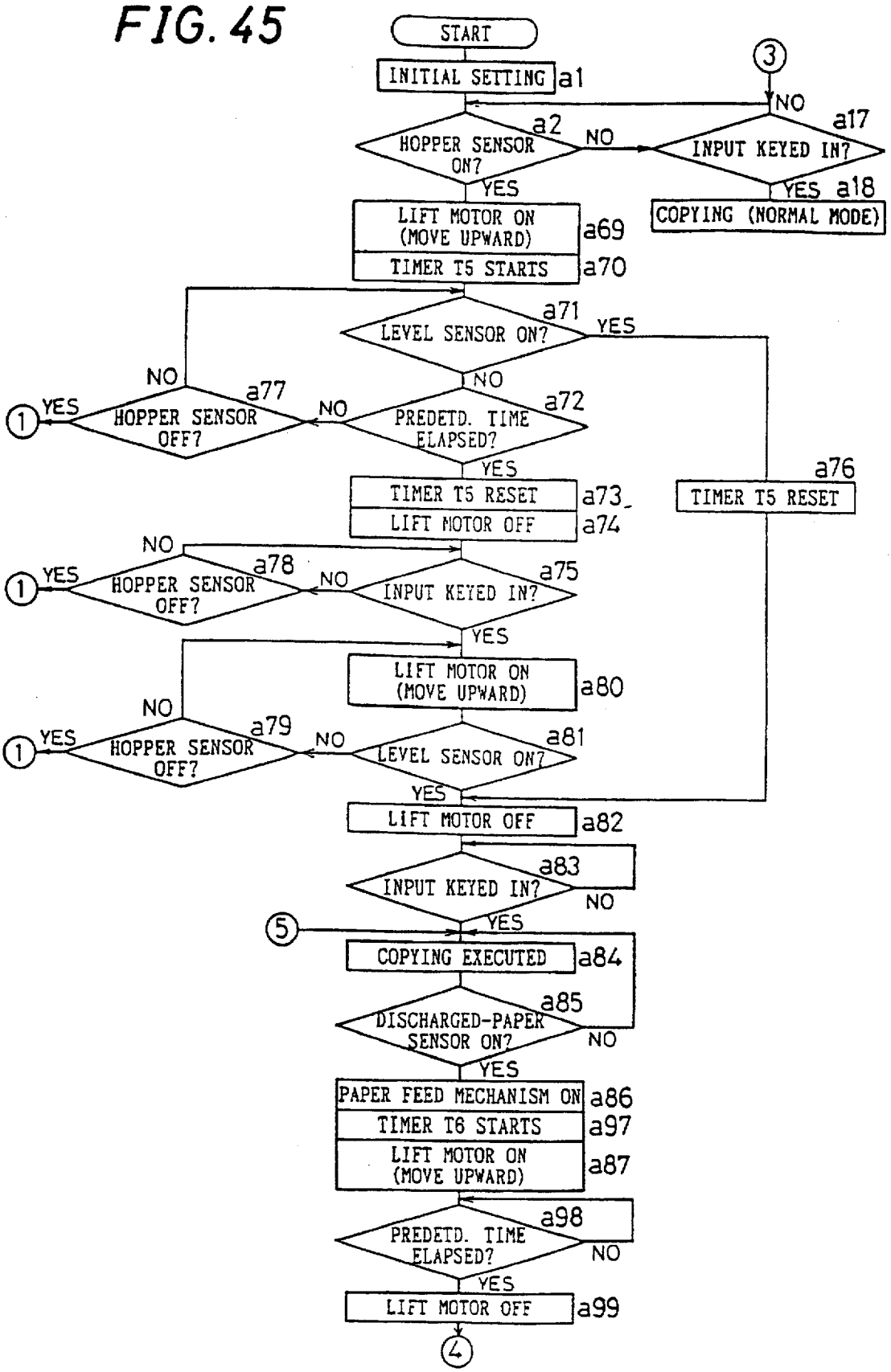
FIG. 45 is a flow chart showing an operation of an RDH according to a fourteenth embodiment of the invention.
Figure 46:
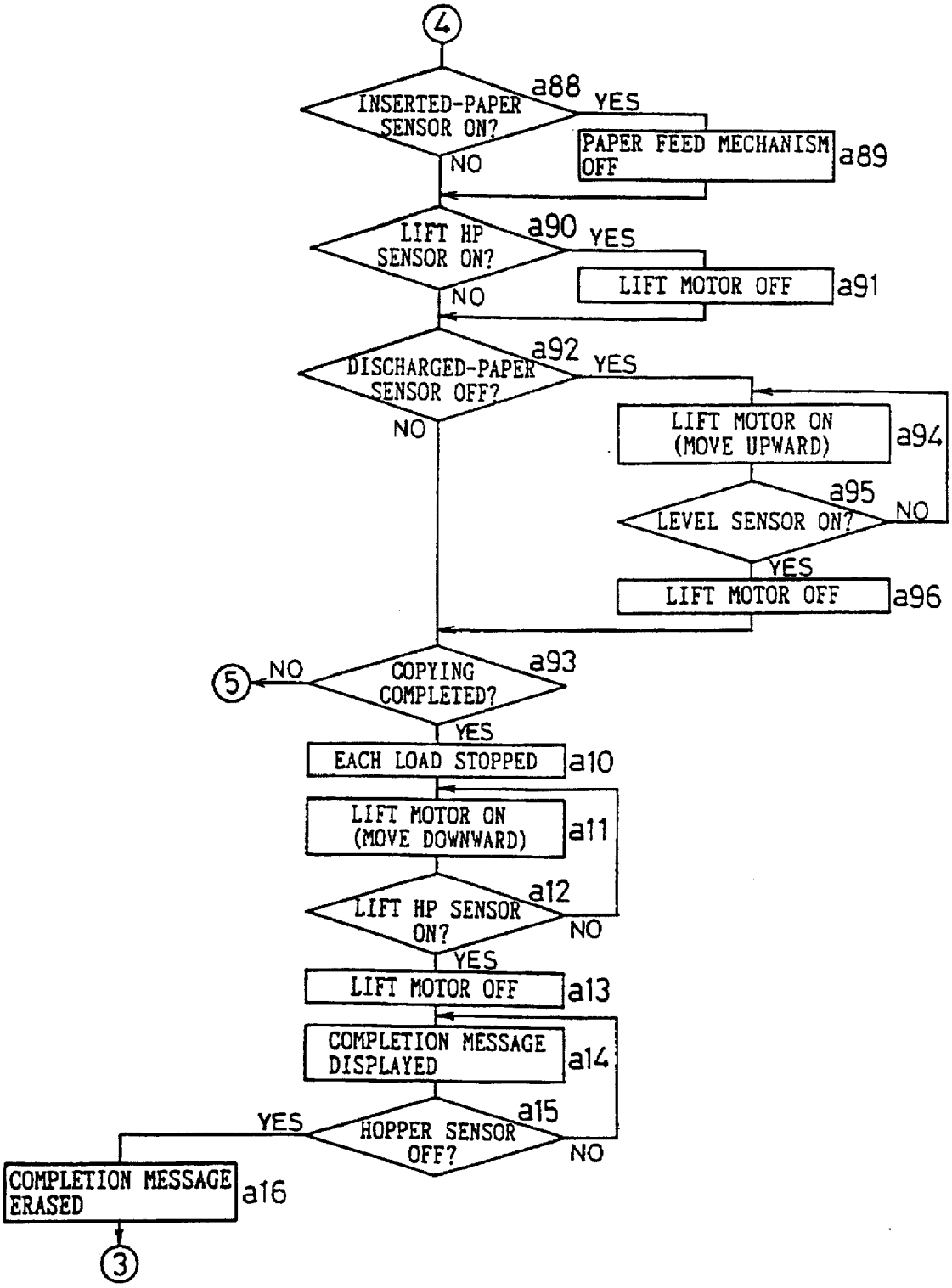
FIG. 46 is a flow chart showing the operation of the RDH according to the fourteenth embodiment of the invention.

FIGS. 45 and 46 are flow charts showing an operation of an RDH according to a fourteenth embodiment of the invention. The RDH of this embodiment serves to strengthen the effect of reducing the resistance in the thirteenth embodiment, and characterized in that the original document supporting plate 3 is moved upward once at a high speed during storing of the returned original document. To this end, a timer T6 for controlling the distance that the original document supporting plate 3 is moved upward is provided.

A time which is needed for the original document supporting plate 3 to be moved upward by the distance L1 shown in FIG. 5 or a smaller distance than the distance L1 is set in the timer T6 in advance. The traveling speed S described above with reference to FIG. 7, for instance, is selected as a speed for moving the original document supporting plate 3 upward. Except for the timer T6, the RDH according to the fourteen th embodiment has a similar structure to the RDH of the thirteenth embodiment.

The flow charts shown in FIGS. 45 and 46 are similar to the flow charts of FIGS. 42A and 42B, 33 and 34 regarding the thirteenth embodiment as they are modified to additionally include Step a97 to a99. When it is judged, at Step a85, that the document discharge sensor 28 is ON, the sequence proceeds to Step a86 to turn on the paper feeding mechanism 11. The sequence proceeds to Step a97, so that the timer T6 starts timing. Further, the sequence proceeds to Step a87, thereby the lift motor 54 is turned on to move the original document supporting plate 3 upward at a high speed. Upon completion of the operation at Step a87, the sequence proceeds to Step a98 to determine whether a time measured by the timer T6 has reached a predetermined time. When the predetermined time has elapsed, the sequence proceeds to Step a99, whereby the lift motor 54 is turned off to move the original document supporting plate 3 downward, and the sequence proceeds to Step a88.

As described above, according to the fourteenth embodiment, since the original document supporting plate 3 is moved downward at a high speed after being moved upward at a high speed, the distance that the original document supporting plate 3 is moved downward becomes longer, thereby strengthening the effect of reducing the resistance of the stacked original documents 6 against the original document supporting plate 3 as that described in the thirteenth embodiment. Hence, it is possible to further stably store the returned original document.

Figure 47A:
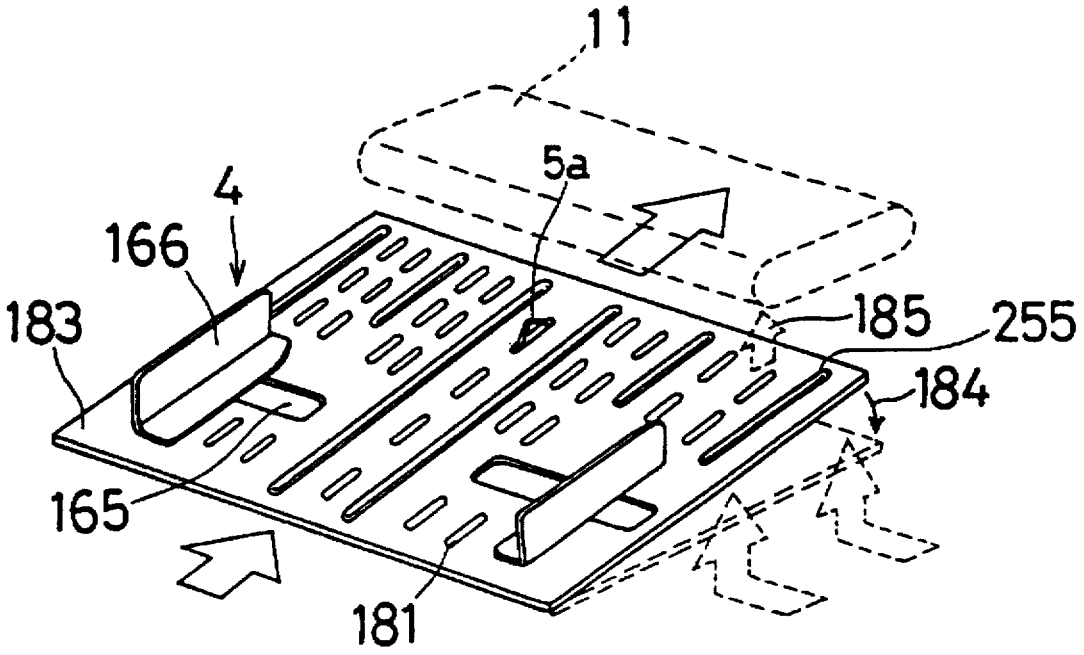
FIG. 47A and 47B are perspective views each showing an original document supporting plate 183 of an RDH according to a fifteenth embodiment of the invention.
Figure 47B:
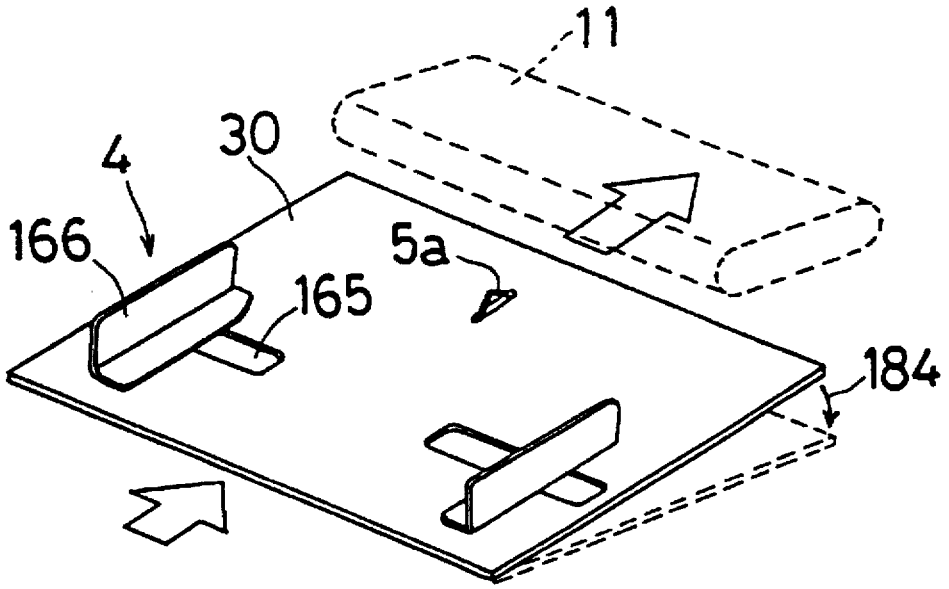
Figure 48A:
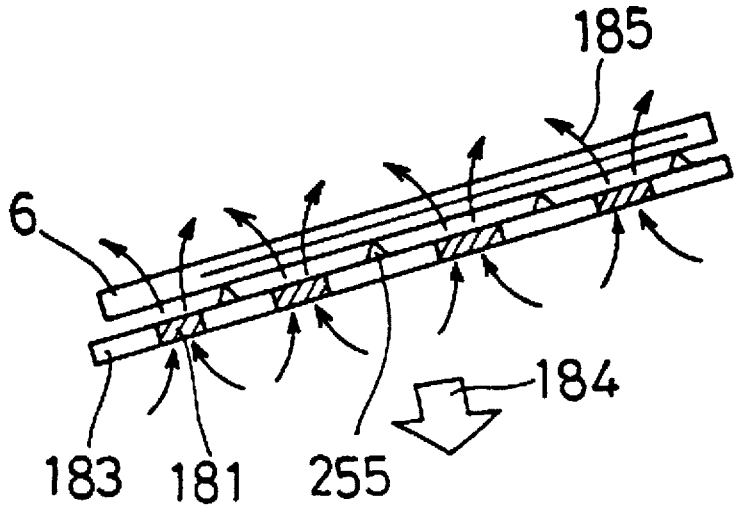
FIGS. 48A and 48B are views each for describing a reduced effect of resistance when the original document supporting plate 183 is moved downward at a high speed.
Figure 48B:
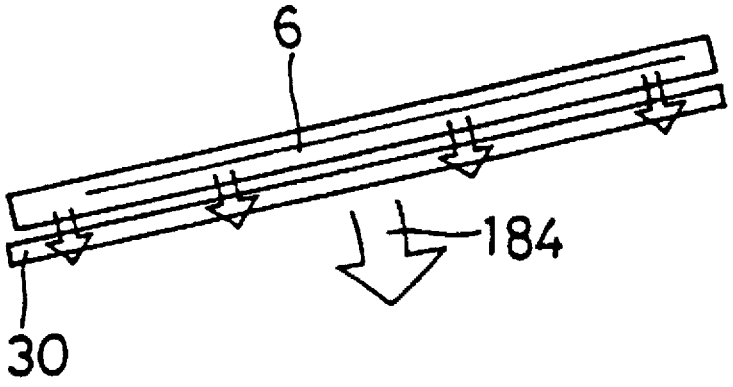

FIG. 47A is a perspective view showing an original document supporting plate 183 of an RDH according to a fifteenth embodiment of the invention, and FIG. 47B is a perspective view showing an original document supporting plate 30. FIGS. 48A and 48B are views for describing the influence of the effect of the reduced resistance when the original document supporting plates 183 and 30 are moved downward at a high speed, respectively. The fifteenth embodiment aims to strengthen the effect of reducing the resistance in the thirteenth embodiment. A plurality of through holes 181 and the plurality of ribs 255 projecting from the original document stacking surface are formed in the original document supporting plate 183.

When the original document supporting plate 183 is moved downward in a direction of an arrow 184 as shown in FIGS. 47A and 48A, air surrounding the original document supporting plate 183 is sucked in through the through holes 181 and discharged in a direction 185 for lifting up the original documents 6. The sucked air impinges against approximately the entire surface of the lowermost one 6 of the original documents 6 to lift up the original documents 6, because of the spaces created between the original documents 6 and the original document supporting plate 183 by the ribs 255. On the other hand, as shown in FIGS. 47B and 48B, when the original document supporting plate 30 which does not include the through holes 181 and the ribs 255 is abruptly moved downward in the direction 184, the lowermost one of the original documents 6 is sucked onto the original document supporting plate 30 because of suction force created by a air pressure drop. This weakens the effect of reducing the resistance.

As described above, according to the fifteenth embodiment, it is possible to prevent a sucking phenomenon due to the air pressure drop created between the original documents 6 and the original document supporting plate 183 when the original document supporting plate 183 is moved downward at a high speed. Hence, it is possible to stably store the returned original document.

Figure 49:
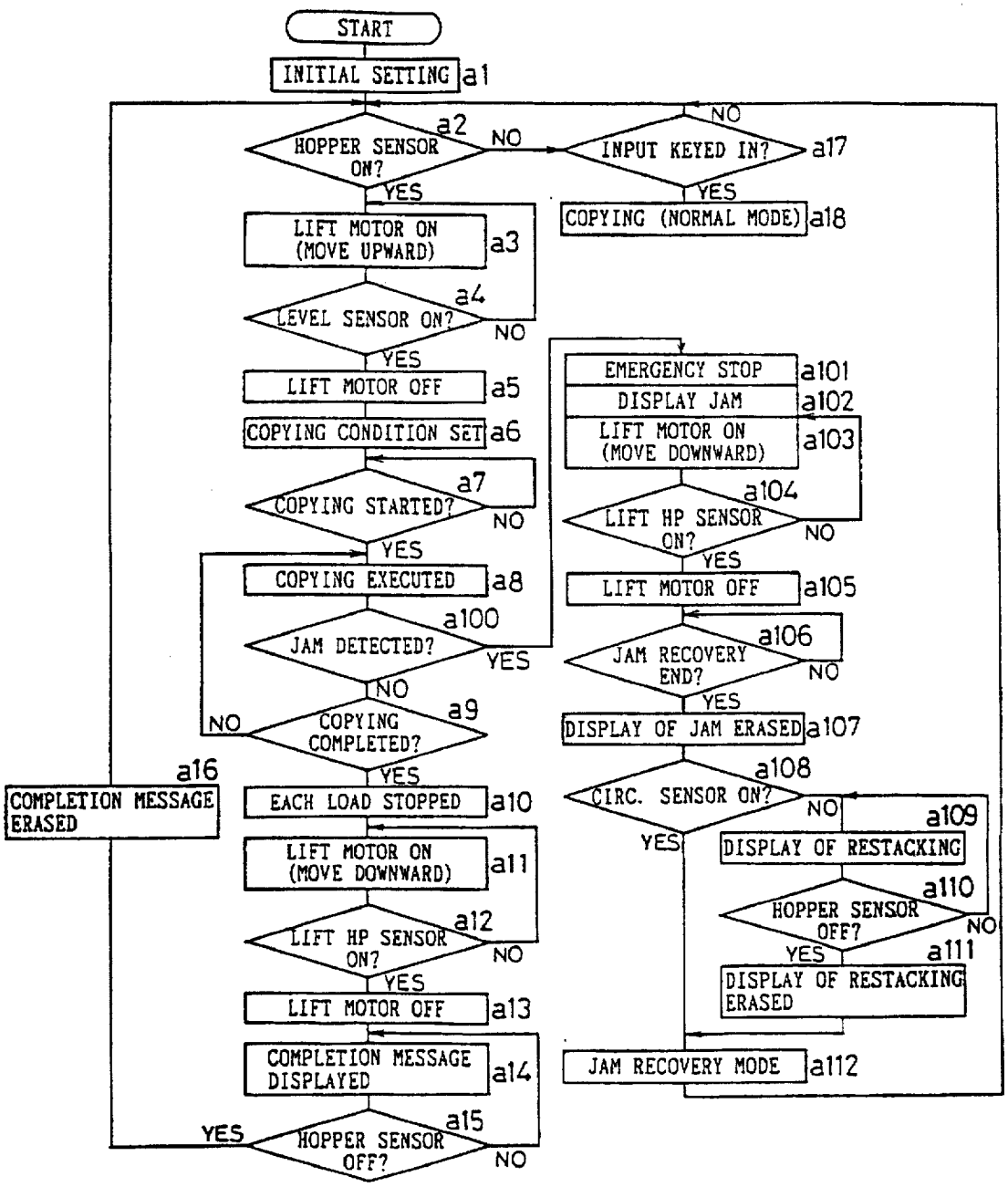
FIG. 49 is a flow chart showing an operation of an RDH according to a sixteenth embodiment of the invention.

FIG. 49 is a flow chart showing an operation of an RDH according to a sixteenth embodiment of the invention. The present embodiment aims to make it easy to perform recovery from a JAM condition such as a jam of an original document during copying. The RDH according to the sixteenth embodiment has a similar structure to the RDH 1 of the first embodiment. The flow chart of FIG. 49 is similar to the flow chart of FIG. 18 regarding the first embodiment as it is modified to additionally include Step a100 to a112.

When the JAM condition such as a jam of an original document is detected, an operator performs recovery such as removal of a jammed original document. At this point, the RDH confirms the position of the circulation sensor 15 and judges whether copying of the original documents is completed with the original documents circulated. An operation after recovery is controlled on the basis of a result of the judgment. When copying of the original documents is suspended with the original documents circulated, normal copying is performed. When copying of the original documents is suspended with the original documents not completed circulated, copying as described later is performed. Under a JAM condition which is detected in this manner, a mode in which an operation after recovery is controlled in accordance with the position of the circulation sensor 15 is referred to as "a recovery mode."

When the predetermined copying is performed at Step a8, the sequence proceeds to Step a100 to determine whether the JAM condition is detected. For example, whether there is a jam of the original documents 6 is judged. When the JAM condition is detected, the sequence proceeds to Step a101. When such is not detected, the sequence proceeds to Step a9. When the JAM condition is detected, the position of the circulation sensor 15 is confirmed. Copying is stopped urgently at Step a101. At Step a102, indication indicating the existence of the JAM condition is displayed. The lift motor 54 is turned on at Step a103, whereby the original document supporting plate 3 is moved downward. Whether the lift HP sensor 8 is ON is judged at Step a104. When the lift HP sensor 8 is ON, the sequence proceeds to Step a105. When the lift HP sensor 8 is not ON, the sequence returns to Step a103. The lift motor 54 is turned off at Step a105. Whether recovery is completed is judged at Step a106. When recovery is completed, the sequence proceeds to Step a107 and the indication indicating the existence of the JAM condition displayed at Step a102 is deleted.

At Step a108, whether the circulation sensor 15 is ON is judged. The ON state of the circulation sensor 15 means that transportation of the original documents 6 is stopped after a complete circulation and all the original documents 6 are on the original document supporting plate 3. Hence, the sequence proceeds to Step a112, whereby normal copying is performed. On the other hand, the circulation sensor 15 not being in an ON state means that transportation of the original documents 6 is suspended halfway, so that it is necessary to restack the original documents 6. Hence, the sequence proceeds to Step a109. At Step a109, an indication which indicates that it is necessary to restack the original documents 6 is displayed. AT Step a110, whether the hopper sensor 5 is OFF is judged. When the hopper sensor 5 is OFF, the sequence proceeds to Step a111. When the hopper sensor 5 is not OFF, the sequence returns to Step a109. At Step a111, the indication which indicates that it is necessary to restack the original documents 6 displayed at Step a109 is deleted. After the indication is deleted at Step a111, the sequence proceeds to Step a112. After the original document 6 is transported to the position of the circulation sensor 15 which was confirmed when the JAM condition was detected, subsequent original documents 6 are copied.

As described above, according to the sixteenth embodiment, the original document supporting plate 3 is moved downward when the JAM condition is detected, and subsequent copying is selected and performed on the basis of the condition of the circulation sensor 15 after recover. Hence, it is possible to easily remove or restack the original documents 6 under the JAM condition.

Figure 50:
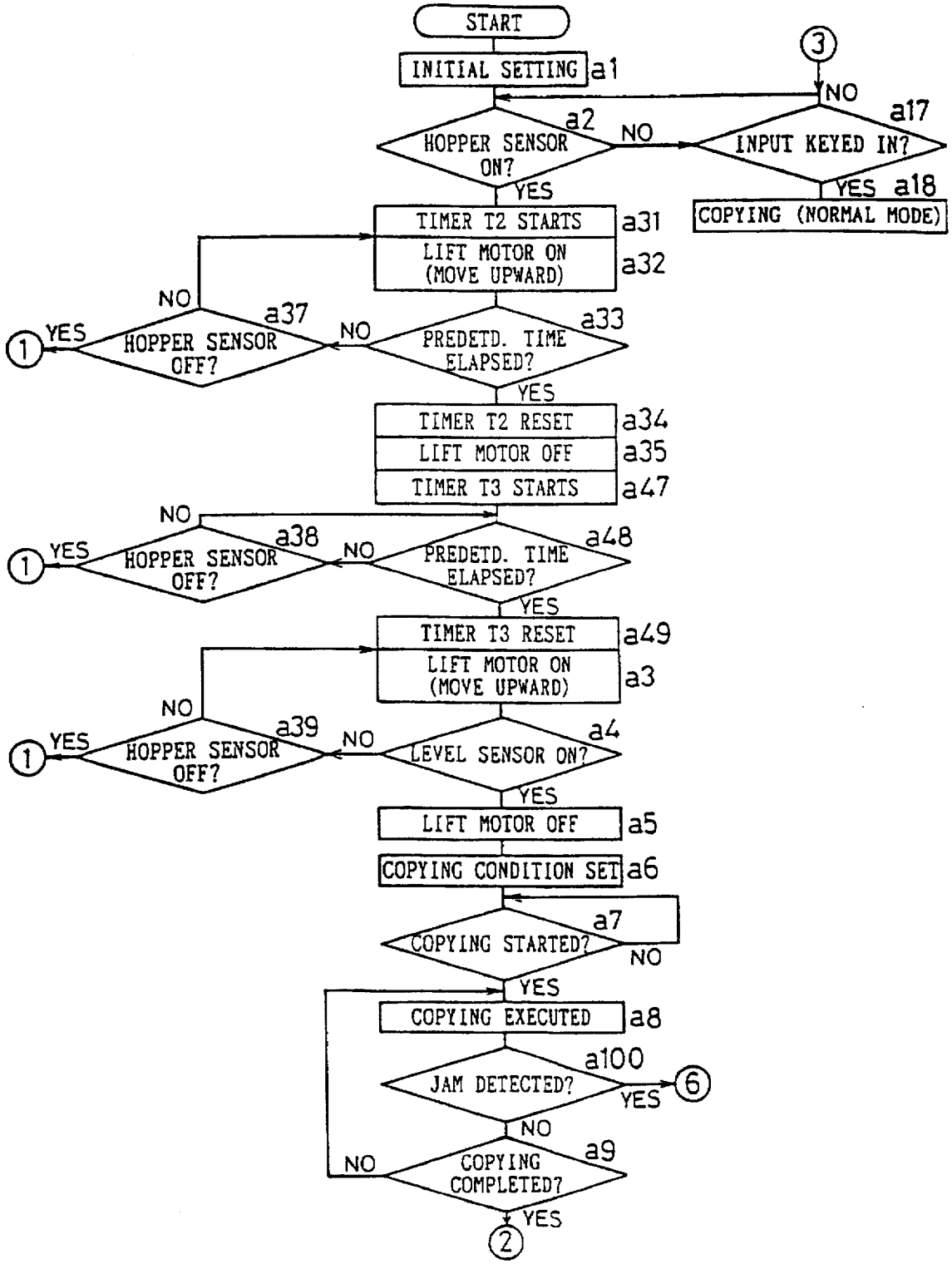
FIG. 50 is a flow chart showing an operation of an RDH according to a seventeenth embodiment of the invention.
Figure 51:
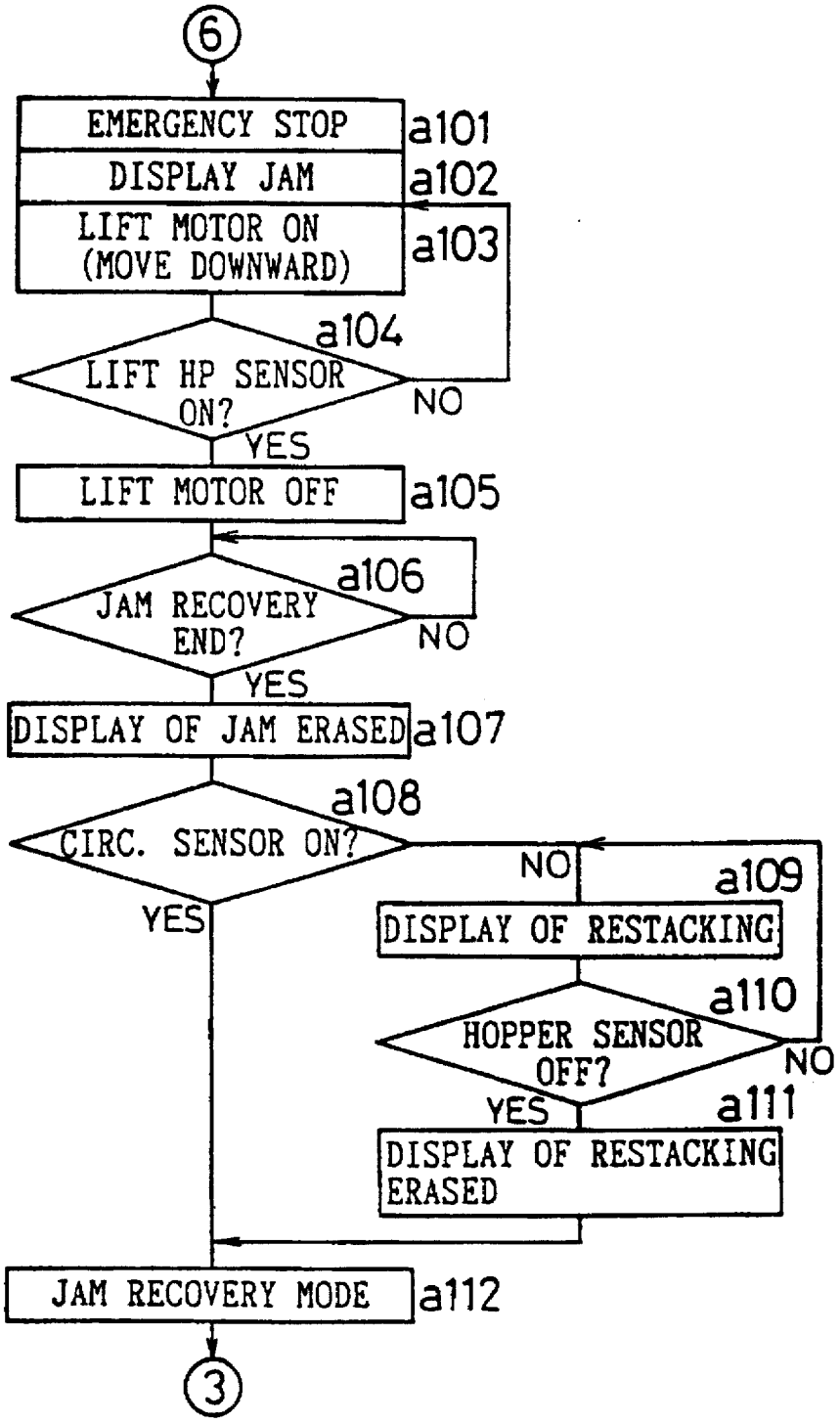
FIG. 51 is a flow chart showing the operation of the RDH according to the seventeenth embodiment of the invention.

FIGS. 50 and 51 are flow charts showing the operation of an RDH according to a seventeenth embodiment of the invention. The RDH according to the seventeenth embodiment realizes the functions of the RDHs of the eighth and the sixteenth embodiments. Except for the timers T2 and T3 described in relation to the eighth embodiment, the RDH according to the seventeenth embodiment has a similar structure to the RDH 1 of the first embodiment. The flow charts shown in FIGS. 50 and 51 are similar to the flow charts of FIGS. 35, 33 and 34 regarding the eighth embodiment as they are modified to additionally include Step a100 to a112 shown in the flow chart regarding the sixteenth embodiment. Upon completion of the operation at Step a8, the sequence proceeds to Step a100 to determine whether the JAM condition is detected. When the JAM condition is detected, the operations at Step a101 to Step a112 are performed and the sequence returns to Step a2. When the JAM condition is not detected, the sequence proceeds to Step a9.

In the eighth embodiment, the original document supporting plate 3 is temporarily stopped between the lowest position and the highest position while moved from the lowest position to the highest position. Hence, according to the seventeenth embodiment, it is possible to easily confirm the restacked original documents 6 under the JAM condition and further to perform restacking. This improves the reliability of the operation of feeding the original documents.

Figure 52:
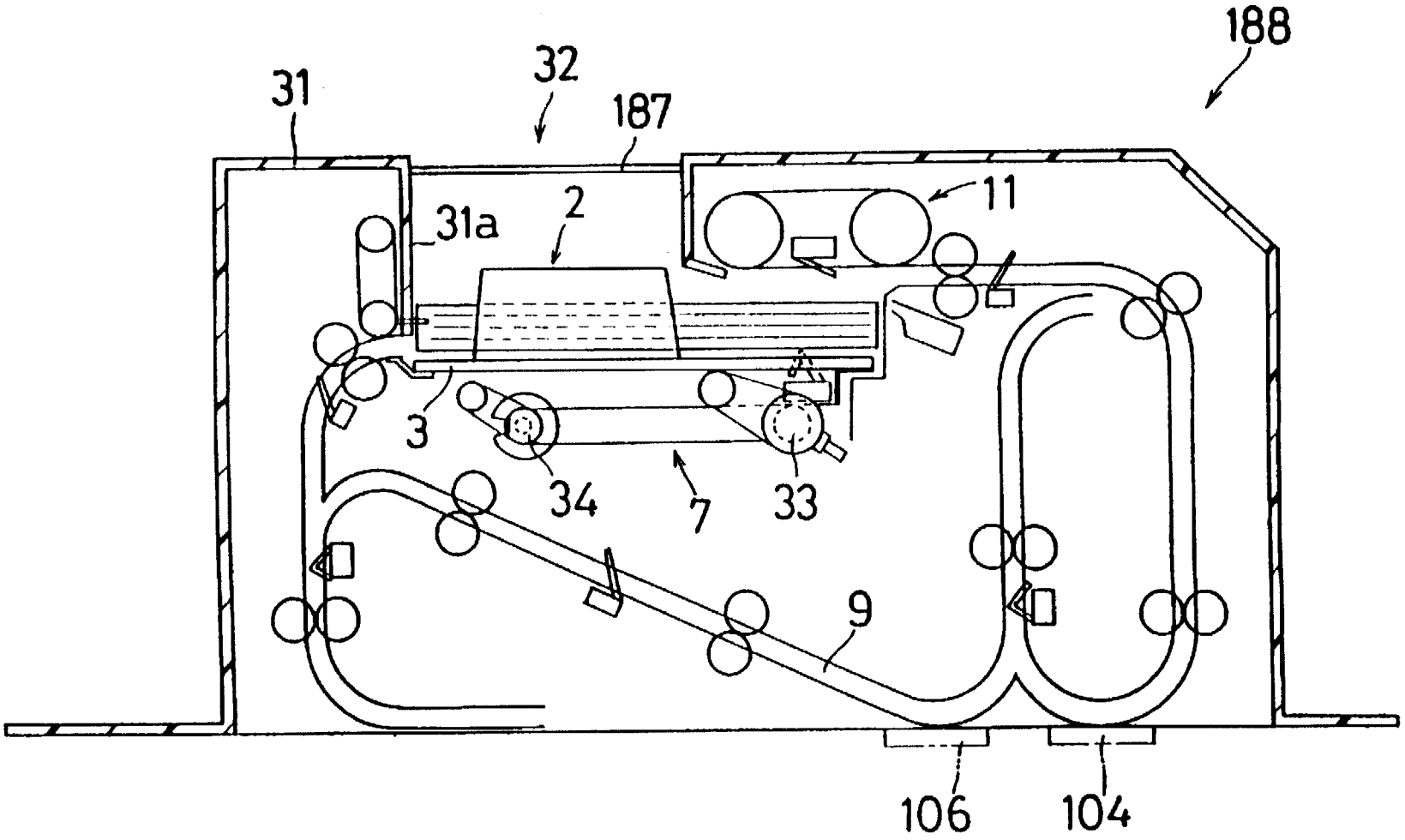
FIG. 52 is a cross-sectional view of an RDH 188 according to an eighteenth embodiment of the invention.

FIG. 52 is a cross sectional view of an RDH 188 according to an eighteenth embodiment of the invention. The present embodiment is characterized in that a cover 187 which covers the insertion inlet 32 for storing the original documents 6 in the original document container mechanism 2 or taking out the original documents 6 from the original document container mechanism 2 is disposed. This makes it possible to block the sound of operating motors, noise during transportation of the original documents, etc. The eighteenth embodiment can be realized in all of the first to the seventeenth preferred embodiments.

Figure 53:
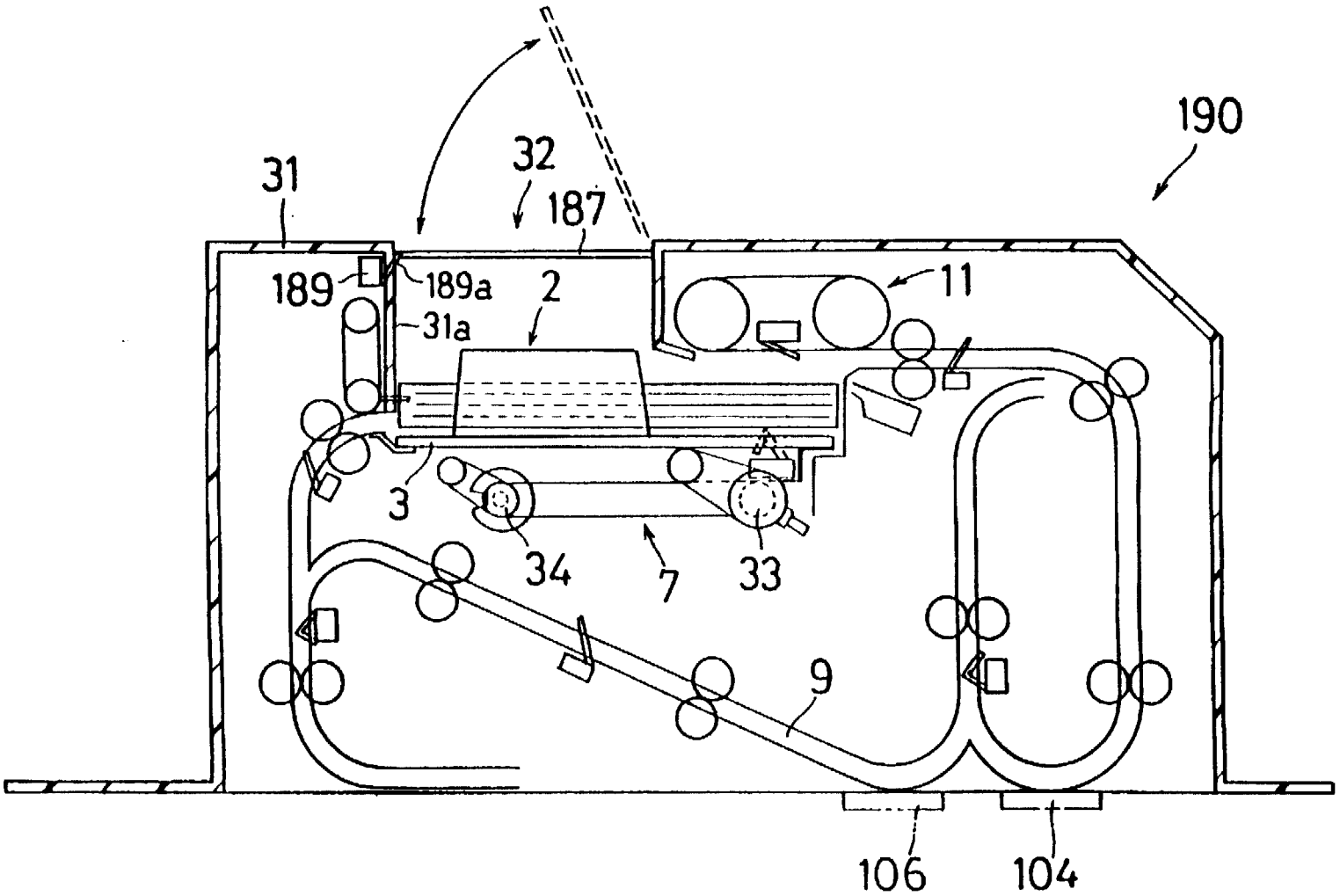
FIG. 53 is a cross-sectional view of an RDH 190 according to a nineteenth embodiment of the invention.

FIG. 53 is a cross sectional view of an RDH 190 according to a nineteenth embodiment of the invention. The present embodiment is characterized in that a cover switch 189 which detects that the cover 187 is closed is provided in the RDH 188 of the eighteenth embodiment. The cover switch 189 includes, for example, an actuator 189*a* which is pressed when the cover 187 is closed.

Figure 54:
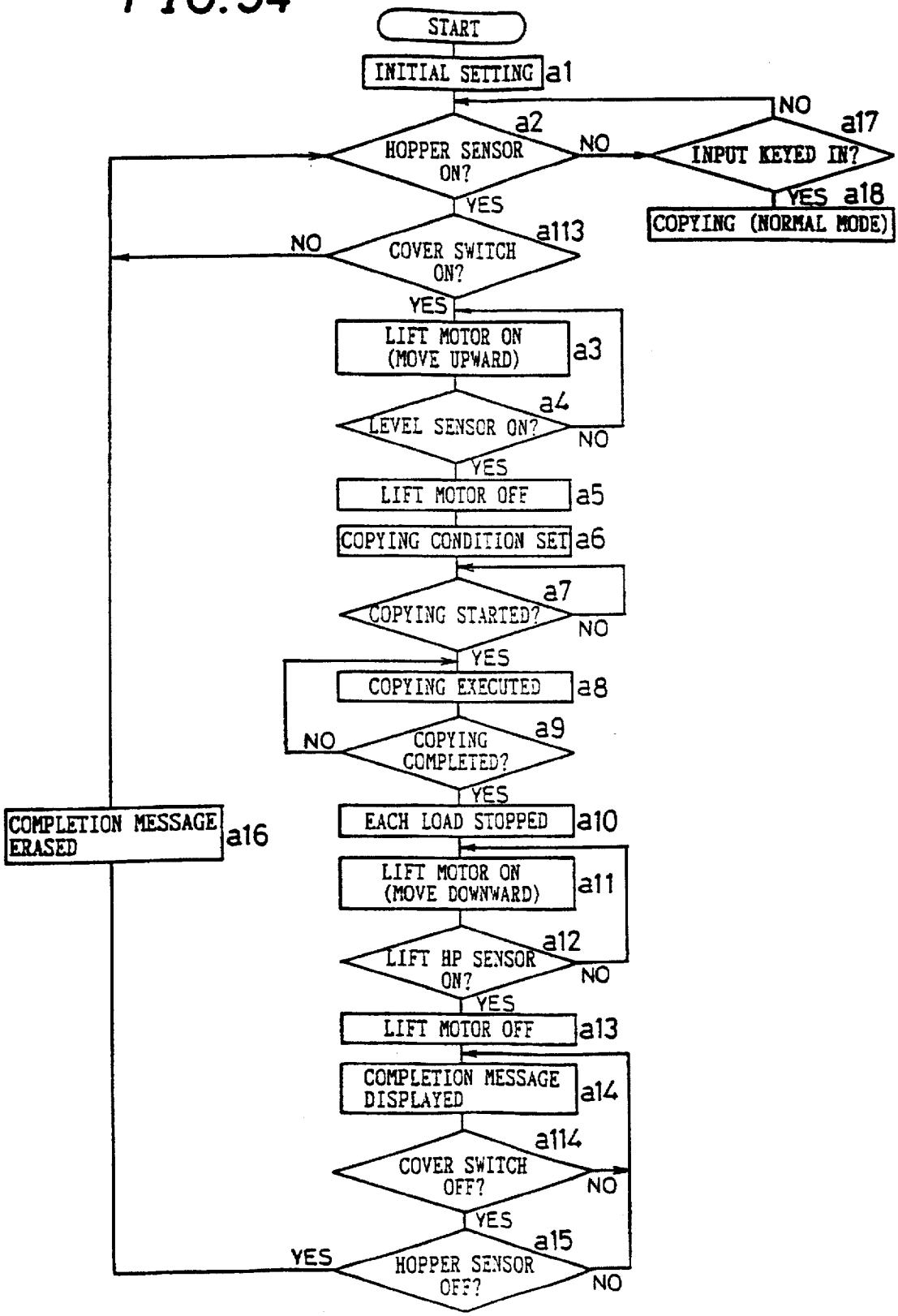
FIG. 54 is a flow chart showing an operation of the RDH 190.

FIG. 54 is a flow chart showing an operation of the RDH 190. This flow chart corresponds to a case where the cover 187 and the cover switch 189 are provided in the RDH 1 of the first embodiment. The flow chart of FIG. 54 is similar to the flow chart of FIG. 18 regarding the first embodiment as it is modified to additionally include Step a113 and Step a114. When it is judged at Step a2 that the hopper sensor 5 is ON, the sequence proceeds to Step a113 to determine whether the cover switch 189 is ON. When the cover switch 189 is ON, the sequence proceeds to Step a3. When the cover switch 189 is not ON, the sequence returns to Step a2.

Further, if the completion message is displayed at Step a14, whether the cover switch 189 is OFF is judged at Step a114. When the cover switch 189 is OFF, the sequence proceeds to Step a15. When the cover switch 189 is not OFF, the sequence returns to Step a14.

As described above, according to the nineteenth embodiment, upward/downward movement of the original document supporting plate 3 is controlled based on whether the cover 187 is opened or closed. Hence, it is not necessary to enter an input which indicates that stacking of the original documents 6 is completed by means of the operation panel or the like.

Figure 55:
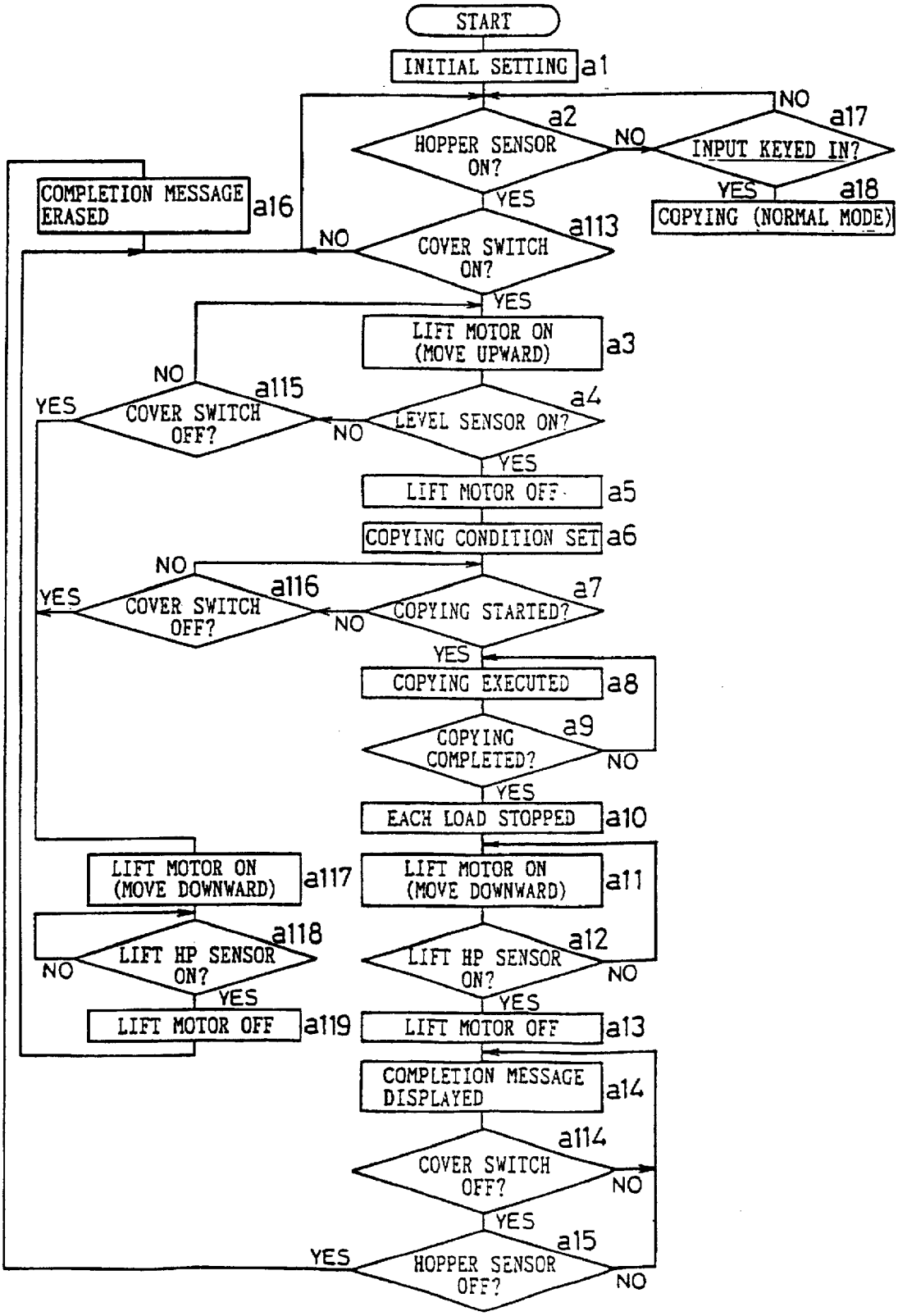
FIG. 55 is a flow chart showing another operation of the RDH 190 according to a twentieth embodiment of the invention.

FIG. 55 is a flow chart showing another operation of the RDH 190 according to a twentieth preferred embodiment of the invention. The flow chart of FIG. 55 is similar to the flow chart of FIG. 54 regarding the nineteenth embodiment as it is modified to additionally include Step a115 to Step a119. When it is judged at Step a4 that the level sensor 14 is not ON, the sequence proceeds to Step a115 to determine whether the cover switch 189 is OFF. When the cover switch 189 is OFF, the sequence proceeds to Step a117. When the cover switch 189 is not OFF, the sequence returns to Step a3. Further, when it is judged at Step a7 that an input which indicates the start of copying is not keyed in, the sequence proceeds to Step a116 to determine whether the cover switch 189 is OFF. When the cover switch 189 is OFF, the sequence proceeds to Step a117. When the cover switch 189 is not OFF, the sequence returns to Step a7.

At step a117, the lift motor 54 is turned on, so that the original document supporting plate 3 is moved downward. Whether the lift HP sensor 8 is ON is judged at Step a118. When the lift HP sensor 8 is ON, the sequence proceeds to Step a119. At Step a119, the lift motor 54 is turned off. After the lift motor 54 is turned off at Step a119, the sequence returns to Step a2.

As described above, according to the twentieth embodiment, upward/downward movement of the original document supporting plate 3 is controlled based on whether the cover 187 is opened or closed. Hence, it is not necessary to enter an input which indicates that stacking of the original documents 6 is completed by means of the operation panel or the like. Further, when the cover 187 is opened before copying is started, the original document supporting plate 3 is immediately moved downward. Therefore, it is possible to swiftly change the number of the original documents 6 and hence to shorten a time which is needed for copying.

Figure 56:
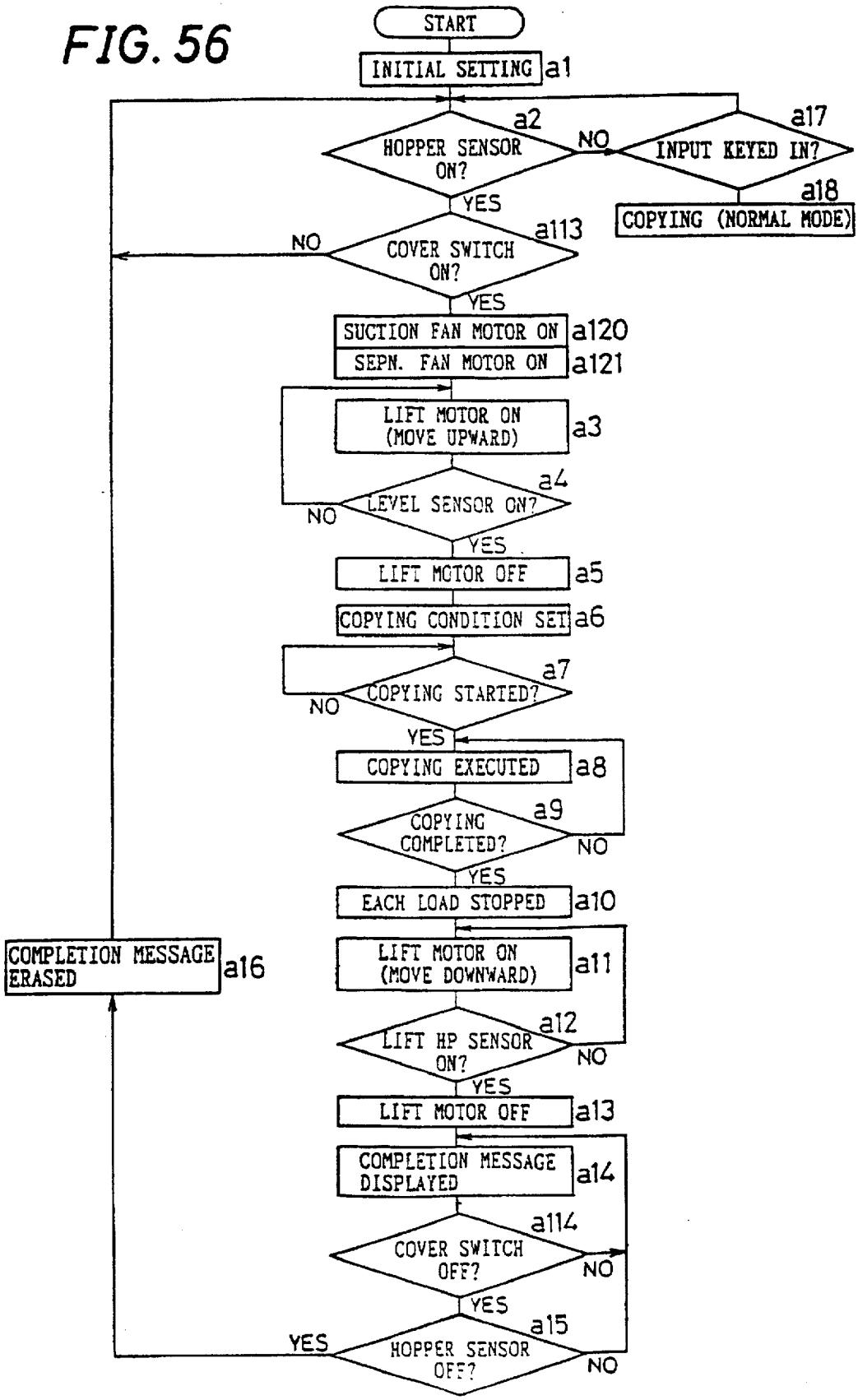
FIG. 56 is a flow chart showing still another operation of the RDH 190 according to a twenty-first embodiment of the invention.

FIG. 56 is a flow chart showing still another operation of the RDH 190 according to a twenty-first embodiment of the invention. The flow chart of FIG. 56 is similar to the flow chart of FIG. 54 regarding the nineteenth embodiment as it is modified to additionally include Step a120 and Step a121. When it is judged, at Step a113, that the cover switch 189 is ON, the sequence proceeds to Step a120 to turn on the suction fan motor 72. Next, the sequence proceeds to Step a121 to turn on the separation fan motor 74. After the separation fan motor 74 is turned on at Step a121, the sequence proceeds to Step a3.

As described above, according to the twenty-first embodiment, as in the nineteenth and the twentieth embodiments, since upward/downward movement of the original document supporting plate 3 is controlled based on whether the cover 187 is opened or closed and since the suction fan motor 72 and the separation fan motor 74 are turned on, a time which is needed until the original document is transported is shortened.

Figure 57:
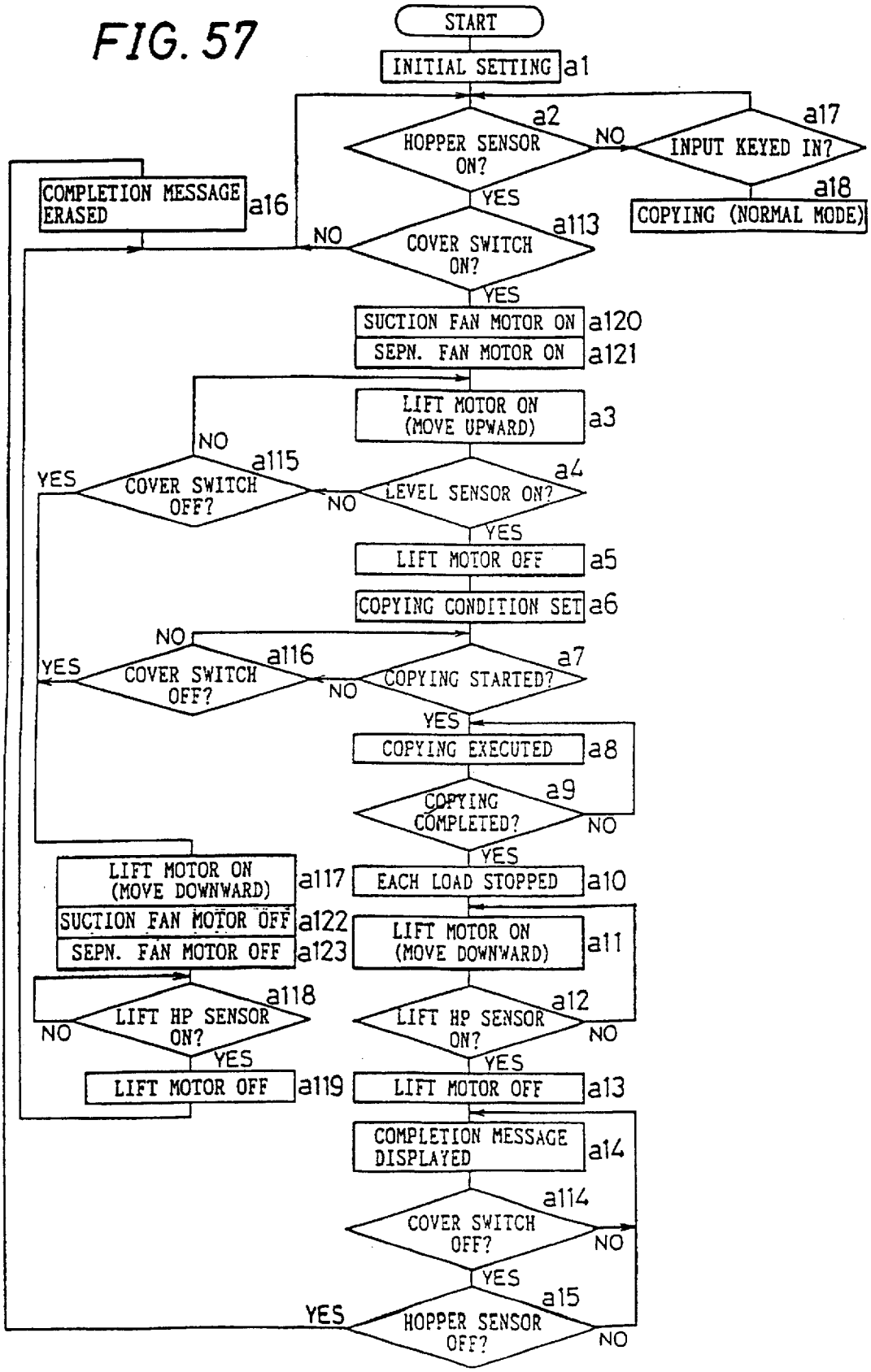
FIG. 57 is a flow chart showing still another operation of the RDH 190 according to a twenty-second embodiment of the invention.
Figure 58:
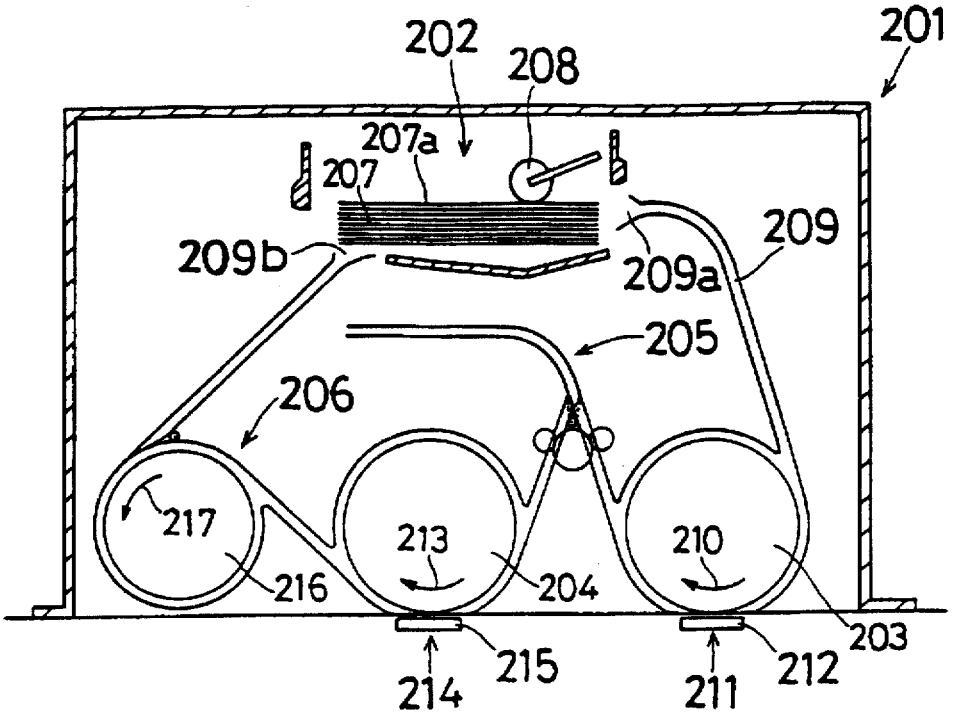
FIG. 58 PRIOR ART
FIG. 58 is a cross-sectional view showing a simplified structure of a conventional RDH 201.
Figure 59:
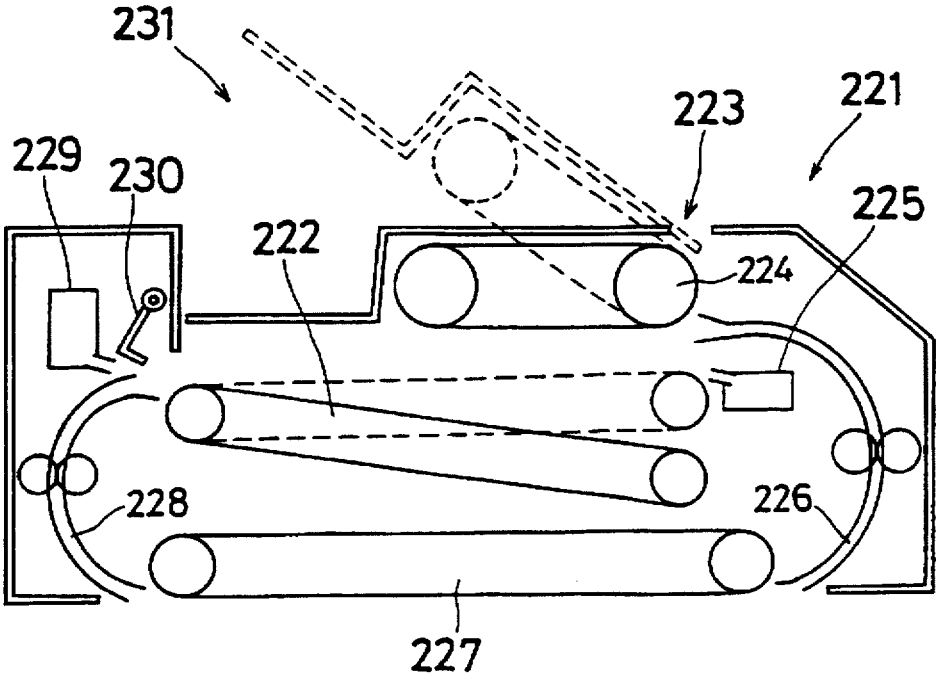
FIG. 59 PRIOR ART
FIG. 59 is a cross-sectional view showing a simplified structure of other conventional RDH 221.

FIG. 57 is a flow chart showing still another operation of the RDH 190 according to a twenty-second embodiment of the invention. The flow chart of FIG. 57 is similar to the flow chart of FIG. 55 regarding the twentieth embodiment as it is modified to additionally include Step a120 to a123. When it is judged, at Step a113, that the cover switch 189 is ON, the sequence proceeds to Step a120 to turn on the suction fan motor 72 described. Next, the sequence proceeds to Step a121 to turn on the separation fan motor 74. After the separation fan motor is turned on at Step a121, the sequence proceeds to Step a3.

When it is judged, at Step a4, that the level sensor 14 is not ON, the sequence proceeds to Step a115 to determine whether the cover switch 189 is OFF. When the cover switch 189 is OFF, the sequence proceeds to Step a117. When the cover switch 189 is not OFF, the sequence returns to Step a3. Further, whether an input which indicates the start of copying is keyed in is judged at Step a7. When it is judged that such an input is not keyed in, the sequence proceeds to Step a116 to determine whether the cover switch 189 is OFF. When the cover switch 189 is OFF, the sequence proceeds to Step a117. When the cover switch 189 is not OFF, the sequence returns to Step a7.

At Step a117, the lift motor 54 is turned on to move the original document supporting plate 3 downward. The sequence then proceeds to Step a122 to turn off the suction fan motor 72. The sequence moreover proceeds to Step a123 to turn off the separation fan motor 74. The sequence further proceeds to Step a118 to determine whether the lift HP sensor 8 is ON. When the lift HP sensor 8 is ON, the sequence proceeds to Step a119 to turn off the lift motor 54. Upon completion of the operation at Step a119, the sequence returns to Step a2.

As described above, according to the twenty-second embodiment, as in the nineteenth and the twentieth embodiments, since upward/downward movement of the original document supporting plate 3 is controlled based on whether the cover 187 is opened or closed, and since the suction fan motor 72 and the separation fan motor 74 are turned on, a time which is needed until the original documents are transported is shortened. Further, when the cover 187 is opened before copying is started, the original document supporting plate 3 is immediately moved downward. Therefore, it is possible to swiftly change the number of the original documents 6 and hence to shorten a time which is needed for copying.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An original document feeding apparatus comprising:

a predetermined transportation path;

an original document supporting plate on which original documents to be transported onto said transportation path are stacked;

paper feeding means for feeding the original documents stacked on said original document supporting plate onto said transportation path one by one, the original documents stacked on said original document supporting plate being supplied onto said transportation path one by one successively from a top of the stack of original documents, an original document discharged from said transportation path being inserted between said original document supporting plate and a lowermost one of the stack of original documents on said original document supporting plate;

upper surface detecting means for detecting an upper surface of an uppermost one of the original documents stacked on said original document supporting plate when the uppermost one of the original documents stacked on said original document supporting plate is moved to a paper feeding position facing an entrance of said transportation path;

vertical movement means for moving said original document supporting plate upward and downward between the paper feeding position and a waiting position which is where the original documents are stacked onto and removed from said original document supporting plate and is positioned below the paper feeding position;

original document stacking detecting means for detecting that the original documents are stacked on said original document supporting plate; and stacking completion detecting means for detecting that stacking of original documents onto said original document supporting plate is complete, said original document stacking detecting means detecting that the original documents have been stacked on said original document supporting plate, said vertical movement means moving said original document supporting plate upward to a preliminary waiting position preset between the waiting position and the paper feeding position, and when said stacking completion detecting means detects that stacking of the original documents onto said original document supporting plate is complete, said vertical movement means moving said original document supporting plate upward until said upper surface detecting means detects the upper surface of the uppermost one of the original documents stacked on said original document supporting plate.

2. The original document feeding apparatus of claim 1, wherein said stacking completion detecting means comprises:

timing means for timing a predetermined time, the original document feeding apparatus detecting that stacking of original documents onto said original document supporting plate has been completed when said timing means finishes timing the predetermined time while said original document supporting plate is at the preliminary waiting position.

3. The original document feeding apparatus of claim 1, further comprising:

inputting means for inputting original document feeding operation specifying data which specify a mode of an original document feeding operation from a plurality of modes, said stacking completion detecting means detecting that stacking of the original documents onto said document supporting plate is complete when said original document supporting plate is at the preliminary waiting position upon input of the original document feeding operation specifying data from said inputting means.

4. The original document feeding apparatus of claim 1, further comprising:

a cover for covering a predetermined insertion inlet of the original document feeding apparatus, the original documents being stackable onto said original document supporting plate through said predetermined insertion inlet; and open and close detecting means for detecting opened and closed states of said cover, said vertical movement means moving said original document supporting plate upward until said upper surface detecting means detects the upper surface of the uppermost one of the original documents stacked on said original document supporting plate when said open and close detecting means detects that said cover is closed, and said vertical movement means moving said original document supporting plate downward to the waiting position when said open and close detecting means detects that said cover is opened.

* * * * *